US010906066B2

(12) United States Patent
Loginov et al.

(10) Patent No.: US 10,906,066 B2
(45) **Date of Patent: *Feb. 2, 2021**

(54) APPARTUSES AND PROCESSES FOR PRODUCING OPTICAL EFFECT LAYERS COMPRISING ORIENTED NON-SPHERICAL MAGNETIC OR MAGNETIZABLE PIGMENT PARTICLES

(71) Applicant: SICPA HOLDING SA, Prilly (CH)

(72) Inventors: Evgeny Loginov, Renens (CH); Mathieu Schmid, Lausanne (CH); Claude-Alain Despland, Prilly (CH)

(73) Assignee: SICPA HOLDING SA, Prilly (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/769,571

(22) PCT Filed: Sep. 7, 2016

(86) PCT No.: PCT/EP2016/071055
§ 371 (c)(1),
(2) Date: Apr. 19, 2018

(87) PCT Pub. No.: WO2017/080698
PCT Pub. Date: May 18, 2017

(65) Prior Publication Data

US 2018/0311701 A1 Nov. 1, 2018

(30) Foreign Application Priority Data

Nov. 10, 2015 (EP) ..... 15193837

(51) Int. Cl.
*B05D 3/00* (2006.01)
*B05D 3/06* (2006.01)
(Continued)

(52) U.S. Cl.
CPC ..... *B05D 3/207* (2013.01); *B05D 3/067* (2013.01); *B05D 5/061* (2013.01); *B42D 25/369* (2014.10); *B42D 25/41* (2014.10); *H01F 41/16* (2013.01)

(58) Field of Classification Search
CPC ..... B05D 5/06; B05D 5/065; B05D 5/066; B05D 5/061; B05D 5/067; B05D 5/063; B05D 3/207
See application file for complete search history.

(56) References Cited

U.S. PATENT DOCUMENTS 2,570,856 A 10/1951 Carlton et al.
3,676,273 A 7/1972 Graves
(Continued)

FOREIGN PATENT DOCUMENTS

CN 102529326 8/2014
EP 0686675 2/1998
(Continued)

OTHER PUBLICATIONS

Handbook of Physics, Springer 2002, pp. 463-464.
(Continued)

*Primary Examiner* — Tabassom Tadayyon Eslami
(74) *Attorney, Agent, or Firm* — Muncy, Geissler, Olds & Lowe, P.C.

(57) ABSTRACT

The present invention relates to the field of magnetic assemblies and processes for producing optical effect layers (OEL) comprising magnetically oriented non-spherical magnetic or magnetizable pigment particles on a substrate. In particular, the present invention relates magnetic assemblies and processes for producing said OELs as anti-counterfeit means on security documents or security articles or for decorative purposes.

13 Claims, 23 Drawing Sheets

(51) Int. Cl.

| | |
|---|---|
| ***B05D 5/06*** | (2006.01) |
| ***B42D 25/41*** | (2014.01) |
| ***B42D 25/369*** | (2014.01) |
| ***H01F 41/16*** | (2006.01) |

(56) References Cited

U.S. PATENT DOCUMENTS

| | | | | |
|---|---|---|---|---|
| 3,791,864 | A | 2/1974 | Steingroever | |
| 4,838,648 | A | 6/1989 | Phillips et al. | |
| 5,364,689 | A | 11/1994 | Kashiwagi et al. | |
| 5,630,877 | A | 5/1997 | Kashiwagi et al. | |
| 6,410,130 | B1 | 6/2002 | Schuhmacher et al. | |
| 6,531,221 | B1 | 3/2003 | Schuhmacher et al. | |
| 6,582,781 | B1 | 6/2003 | Schuhmacher et al. | |
| 6,838,166 | B2 | 1/2005 | Phillips et al. | |
| 7,047,883 | B2 | 5/2006 | Raksha et al. | |
| 7,955,695 | B2 | 6/2011 | Argoitia | |
| 8,343,615 | B2 | 1/2013 | Raksha et al. | |
| 2007/0172261 | A1 | 7/2007 | Raksha et al. | |
| 2008/0213516 | A1* | 9/2008 | Wild | B05D 3/20 428/29 |
| 2010/0040845 | A1* | 2/2010 | Schmid | B05D 3/207 428/207 |
| 2013/0084411 | A1 | 4/2013 | Raksha et al. | |

FOREIGN PATENT DOCUMENTS

| | | | |
|---|---|---|---|
| EP | 1666546 | | 6/2006 |
| EP | 1710756 | | 10/2006 |
| EP | 2157141 | | 2/2010 |
| EP | 1819525 | | 3/2010 |
| EP | 2306222 | | 4/2011 |
| EP | 2325677 | | 5/2011 |
| EP | 2402401 | | 1/2012 |
| WO | 2002073250 | | 9/2002 |
| WO | 2003000801 | | 1/2003 |
| WO | 2005002866 | | 1/2005 |
| WO | 2006063926 | | 6/2006 |
| WO | 2006069218 | | 6/2006 |
| WO | 2007131833 | | 11/2007 |
| WO | 2008046702 | | 4/2008 |
| WO | 2011092502 | | 8/2011 |
| WO | 2014/108404 | * | 7/2014 |
| WO | 2014108303 | | 7/2014 |
| WO | 2014108404 | | 7/2014 |
| WO | 2015082344 | | 6/2015 |
| WO | 2015086257 | | 6/2015 |

OTHER PUBLICATIONS

Chemistry & Technology of UV & EB Formulation for Coatings, Inks & Paints, vol. III, "Photoinitiators for Free Radical Cationic and Anionic Polymerization", 2nd edition, by J. V. Crivello & K. Dietliker, edited by G. Bradley and published in 1998 by John Wiley & Sons in association with SITA Technology Limited.

Z.Q. Zhu and D. Howe (Halbach permanent magnet machines and applications: a review, IEE. Proc. Electric Power Appl., 2001, 148, p. 299-308).

Chemistry & Technology of UV & EB Formulation for Coatings, Inks & Paints, vol. IV, Formulation, by C. Lowe, G. Webster, S. Kessel and I. McDonald, 1996 by John Wiley & Sons in association with SITA Technology Limited.

DIN 5036-3 "Radiometric and photometric properties of materials Methods of measurement for photometric and spectral radiometric characteristic factors " (Nov. 1979). 27 pages.

International Search Report and Written Opinion issued with respect to application No. PCT/EP2016/071055.

* cited by examiner

Figure 1B1
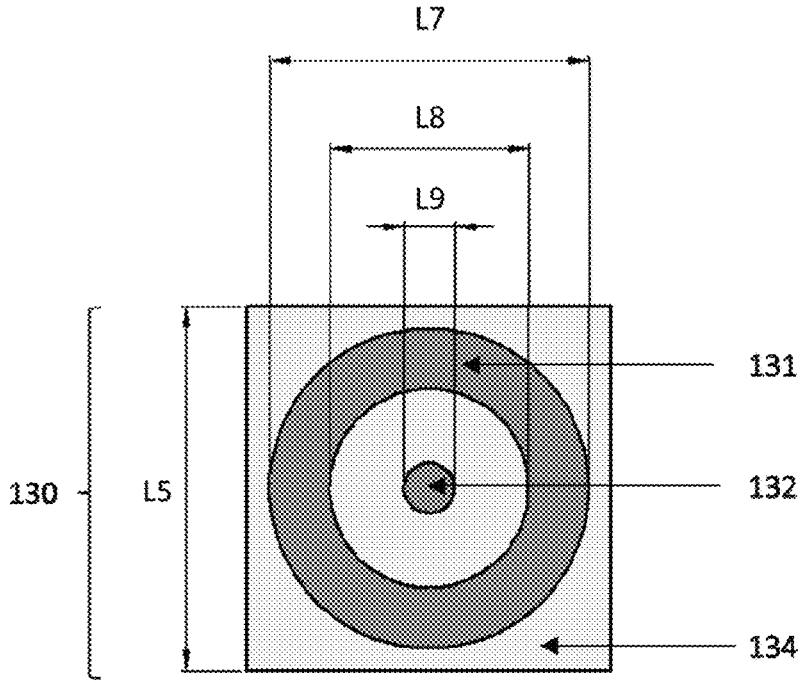
Figure 1B2
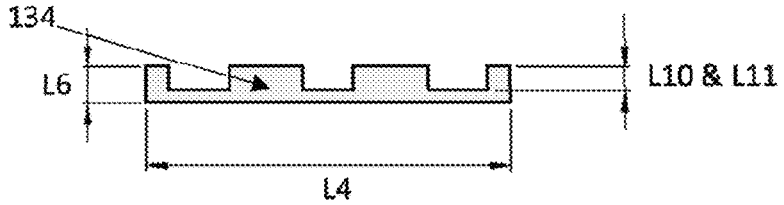
Figure 1C
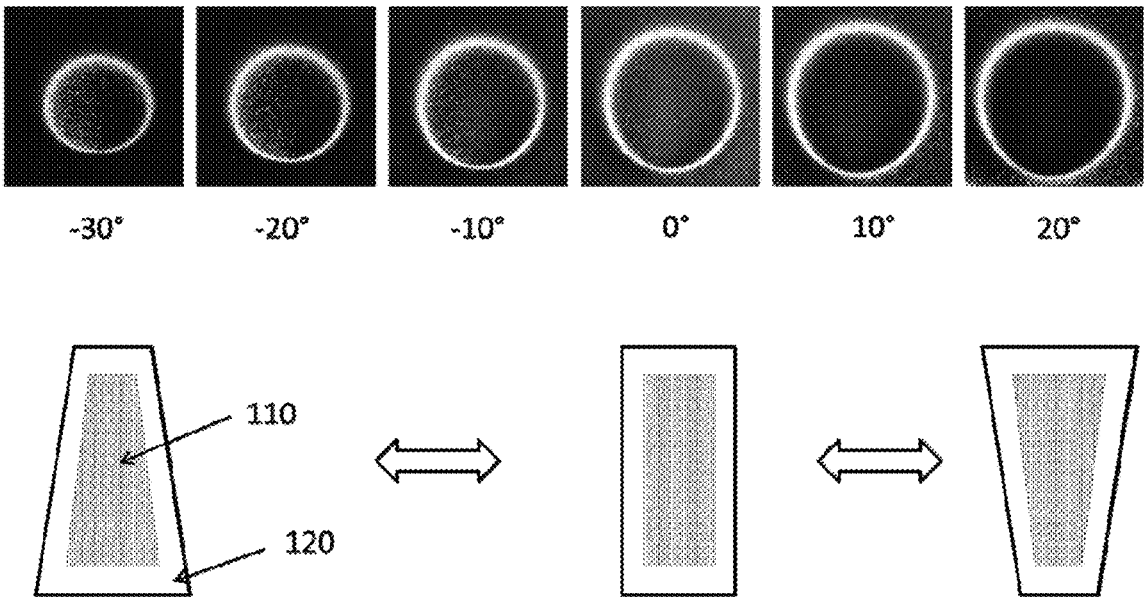

Figure 2B1
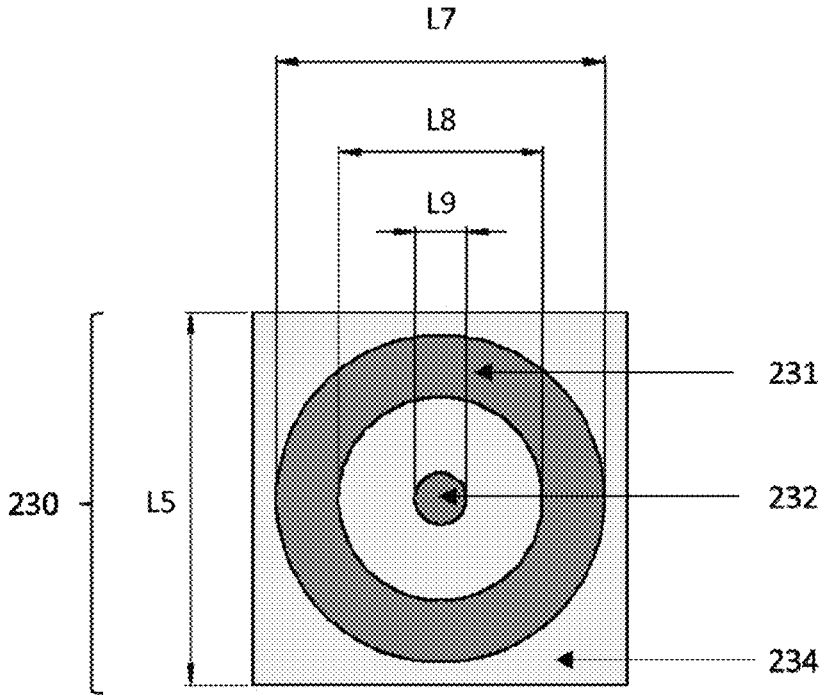
Figure 2B2
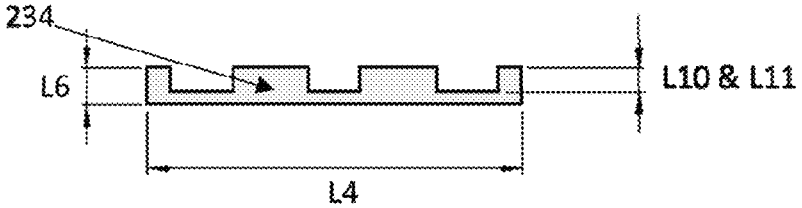
Figure 2C
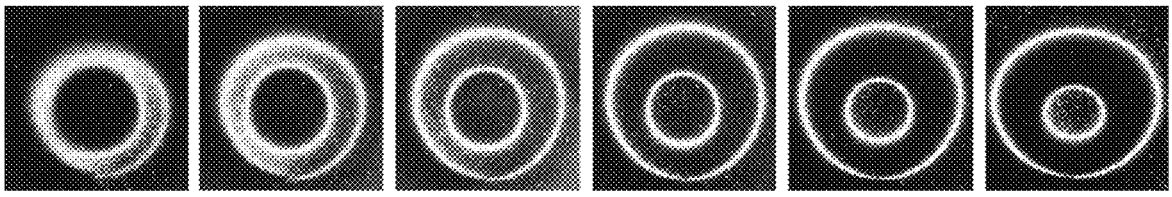
-20° -10° 0° 10° 20° 30°

Figure 3B1
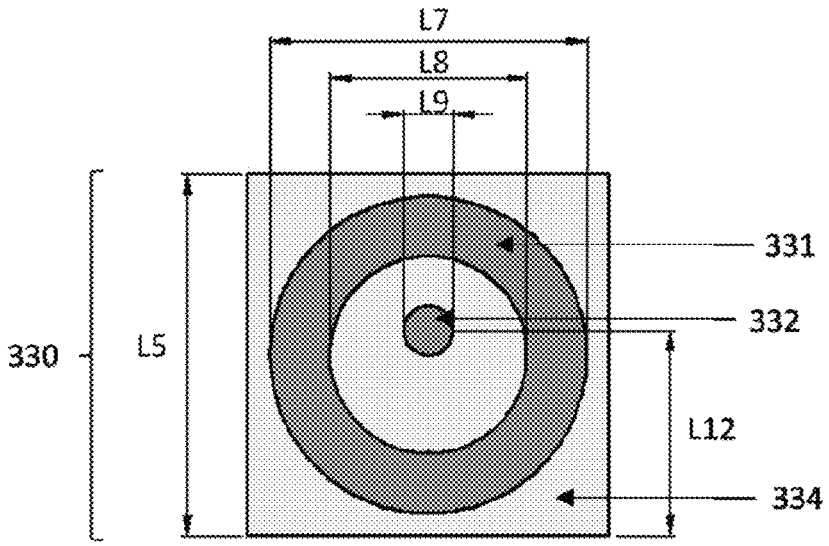
Figure 3B2
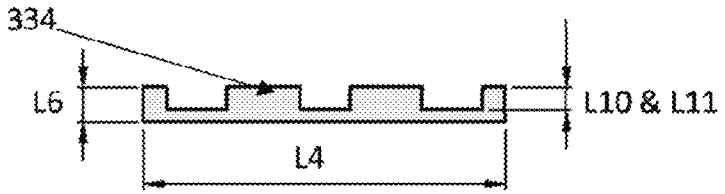
Figure 3C
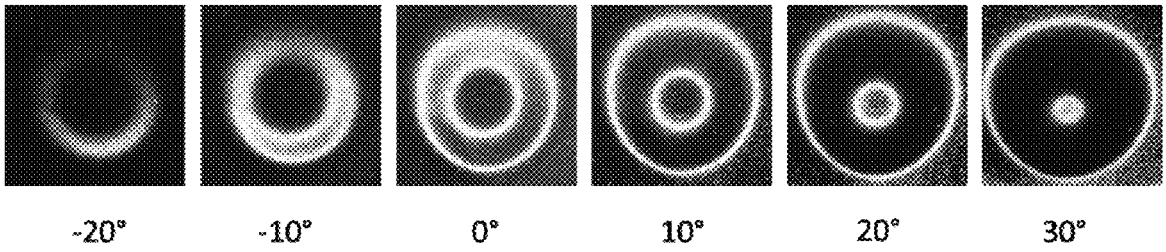

Figure 5B1
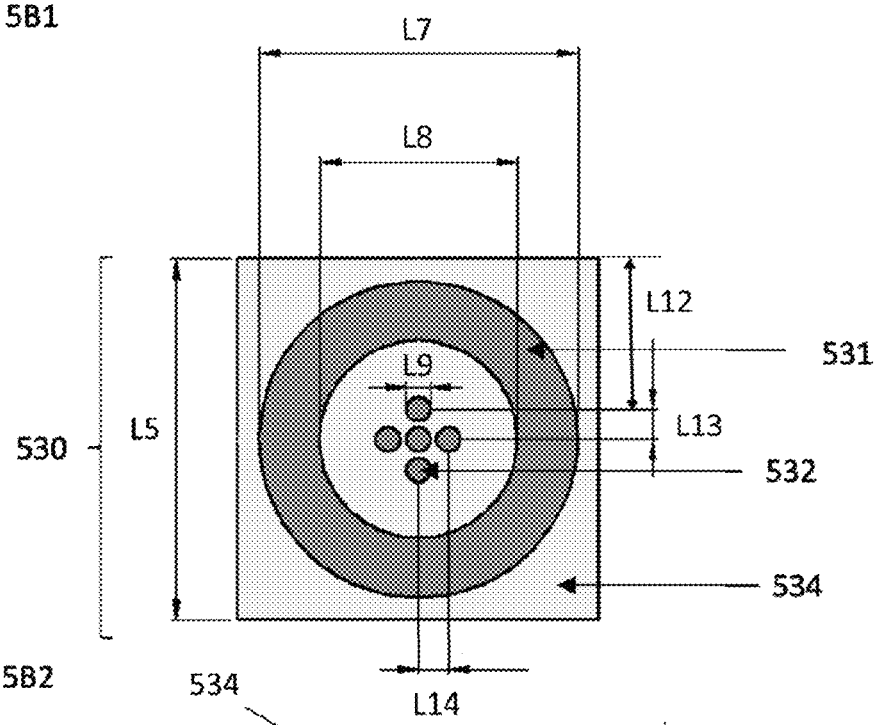
Figure 5B2
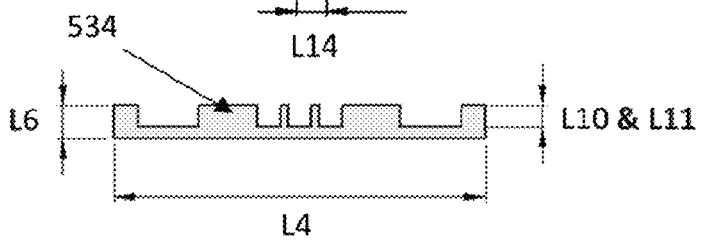
Figure 5C
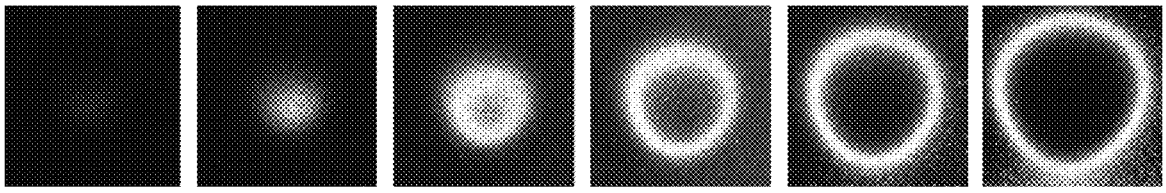
-30° -20° -10° 0° 10° 20°

Figure 6B1
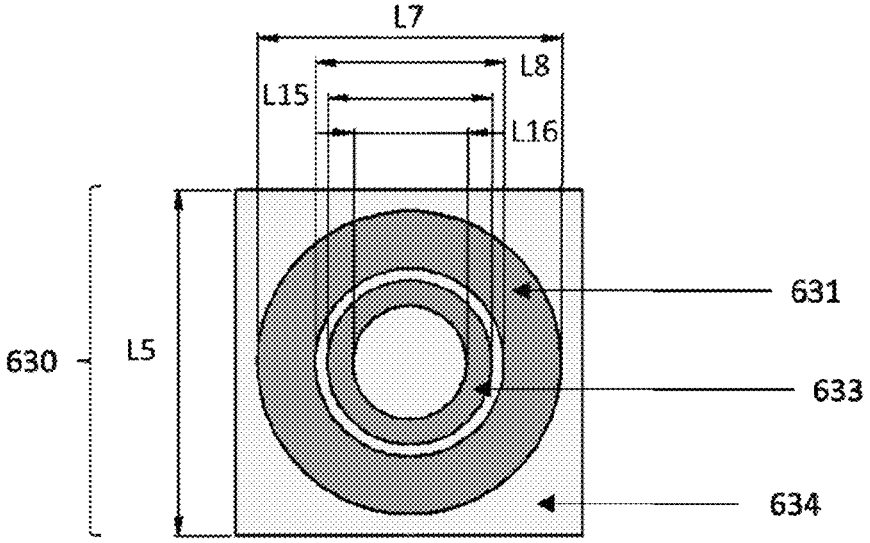
Figure 6B2
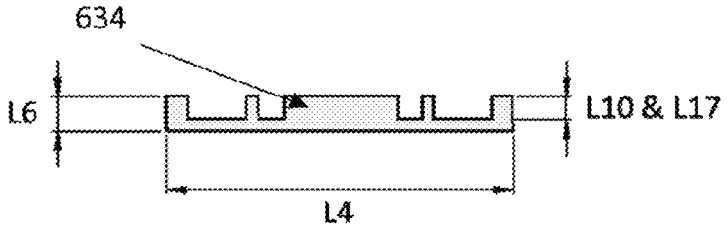
Figure 6C
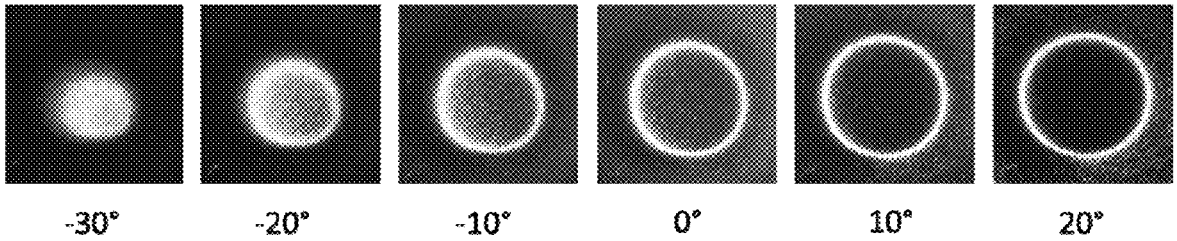

Figure 7B1
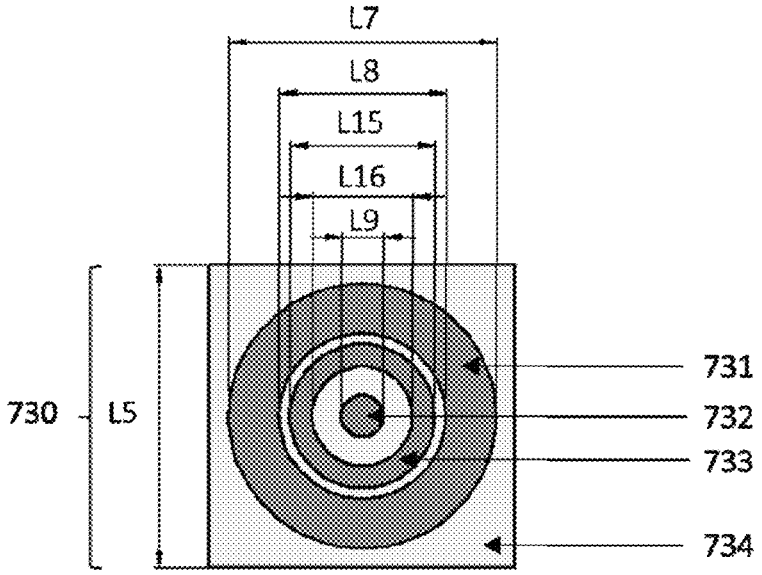
Figure 7B2
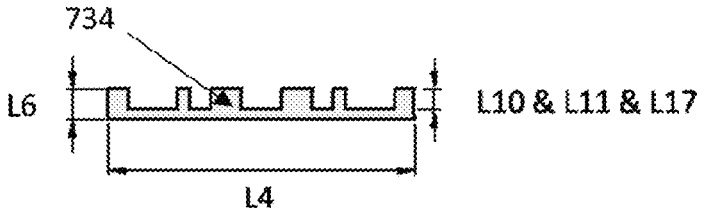
Figure 7C
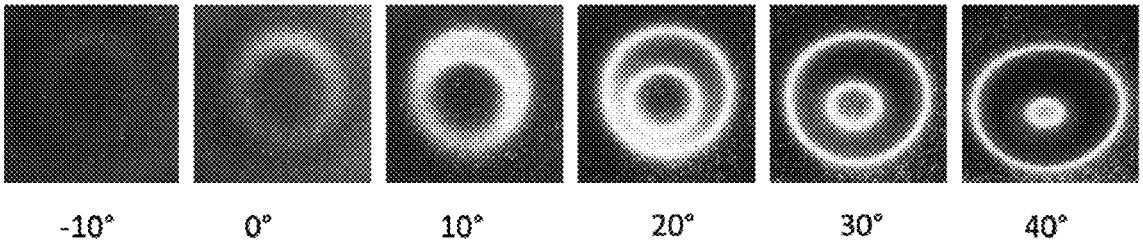

Figure 8B1
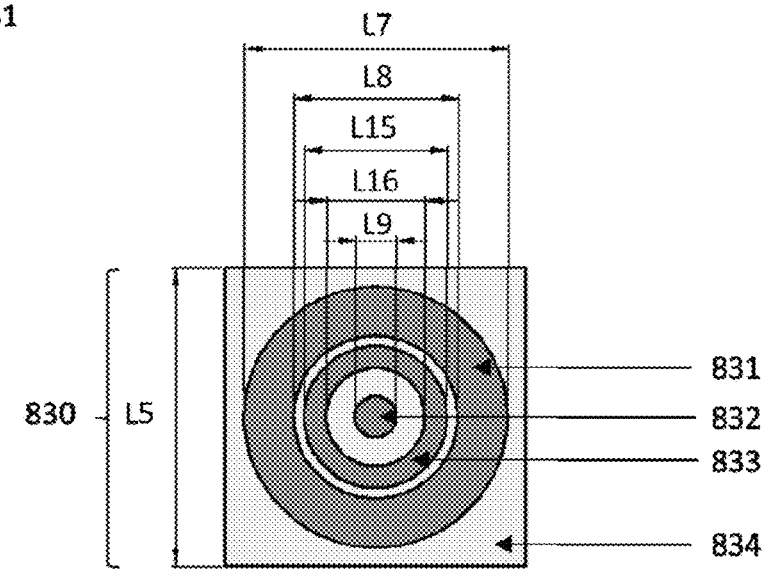
Figure 8B2
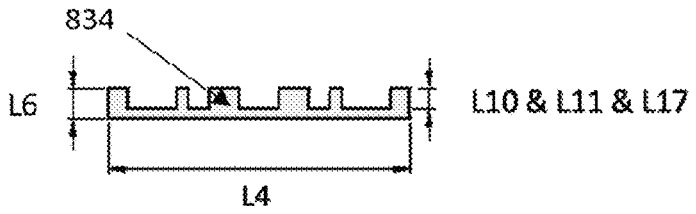
Figure 8C
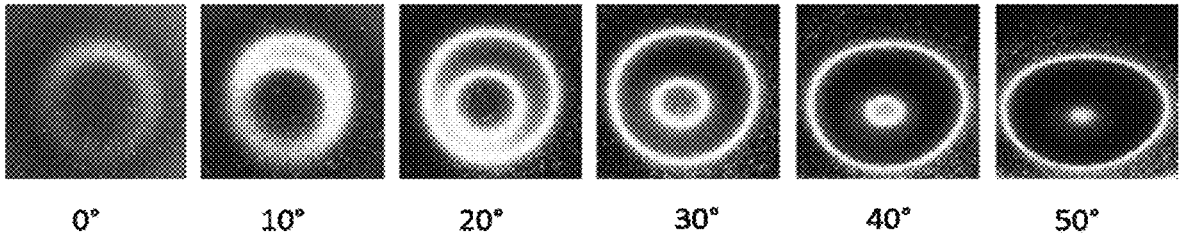

Figure 9B1
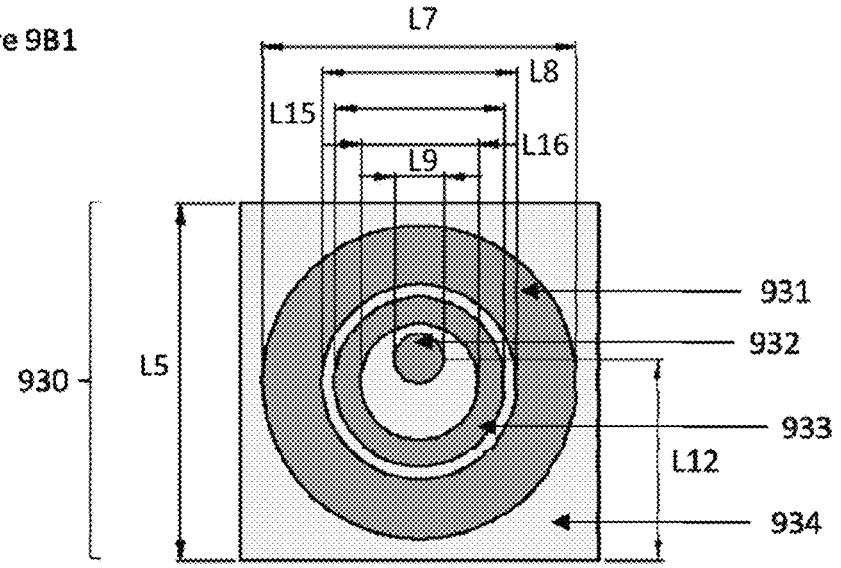
Figure 9B2
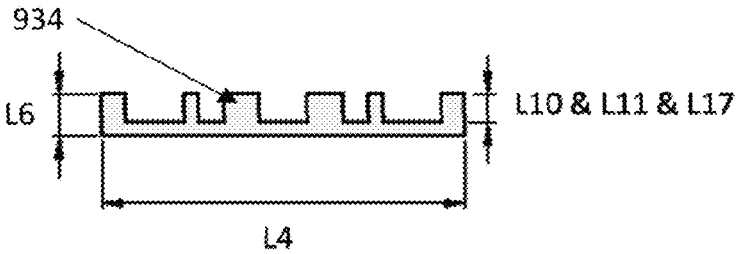
Figure 9C
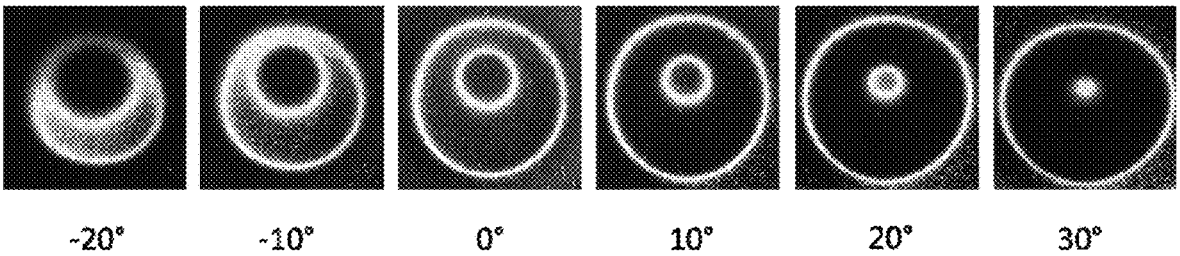

Figure 10B1
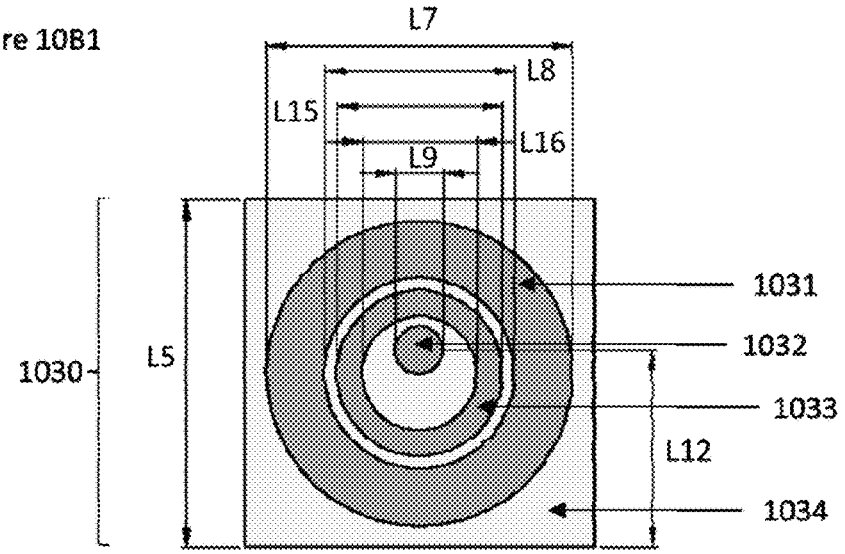
Figure 10B2
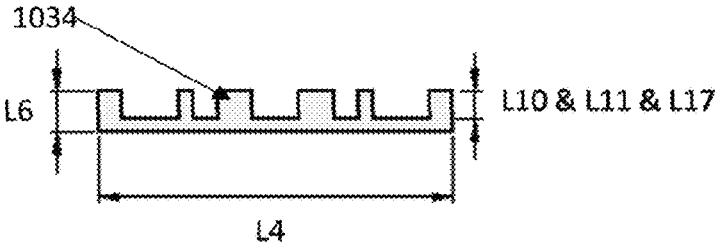
Figure 10C
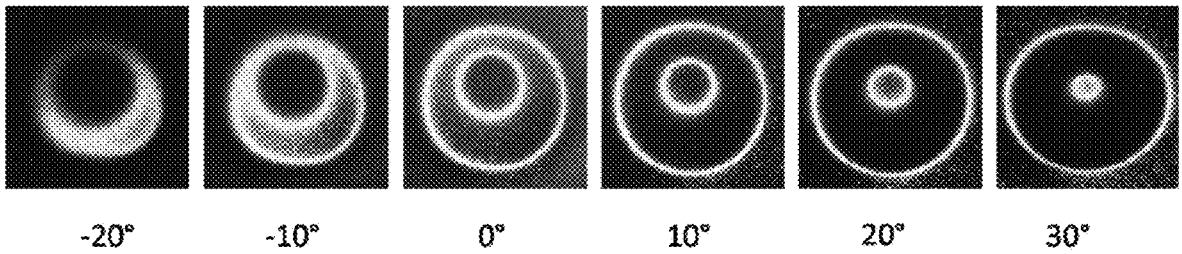

Figure 11B1
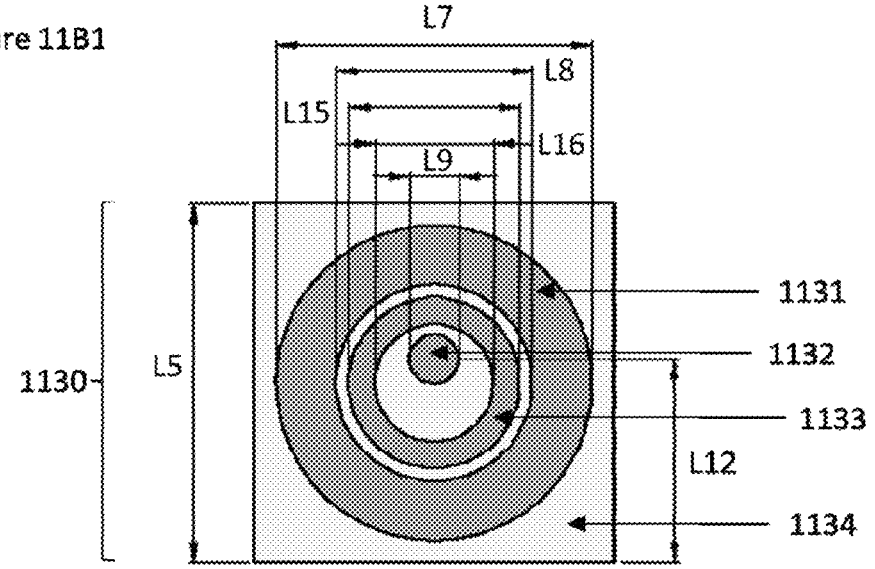
Figure 11B2
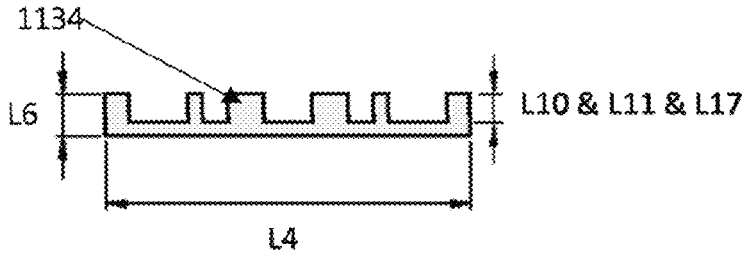
Figure 11C
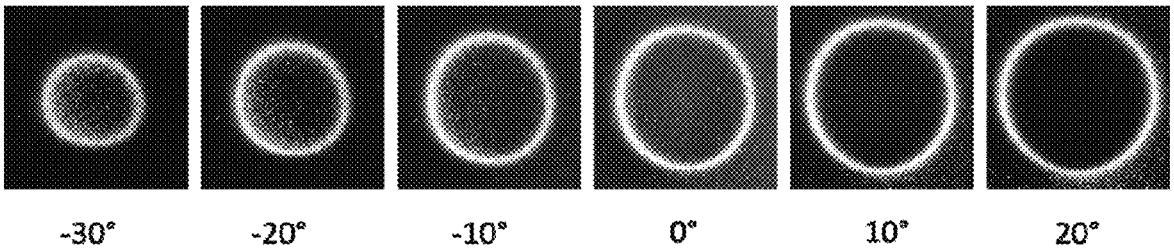

Figure 12B1
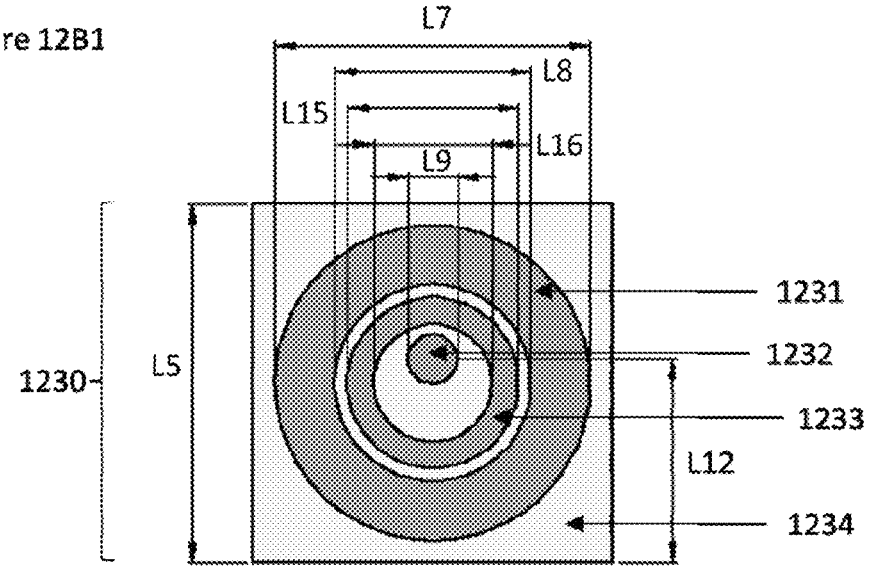
Figure 12B2
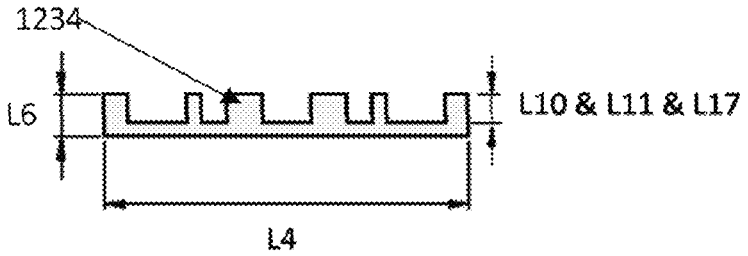
Figure 12C
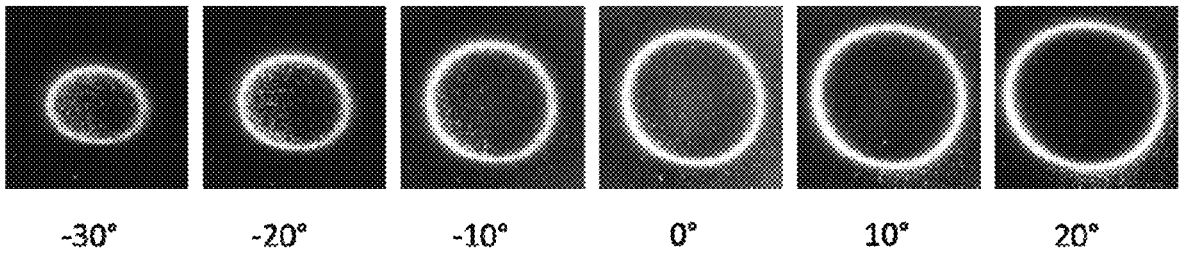

APPARTUSES AND PROCESSES FOR PRODUCING OPTICAL EFFECT LAYERS COMPRISING ORIENTED NON-SPHERICAL MAGNETIC OR MAGNETIZABLE PIGMENT PARTICLES

FIELD OF THE INVENTION

The present invention relates to the field of the protection of value documents and value commercial goods against counterfeit and illegal reproduction. In particular, the present invention relates to optical effect layers (OEL) showing a viewing-angle dependent optical effect, magnetic assemblies and processes for producing said OEL, as well as uses of said optical effect layers as an anti-counterfeit means on documents.

BACKGROUND OF THE INVENTION

The use of inks, coating compositions, coatings, or layers, containing magnetic or magnetizable pigment particles, in particular non-spherical optically variable magnetic or magnetizable pigment particles, for the production of security elements and security documents is known in the art.

Security features, e.g. for security documents, can be classified into "covert" and "overt" security features. The protection provided by covert security features relies on the concept that such features are hidden, typically requiring specialized equipment and knowledge for their detection, whereas "overt" security features are easily detectable with the unaided human senses, e.g. such features may be visible and/or detectable via the tactile senses while still being difficult to produce and/or to copy. However, the effectiveness of overt security features depends to a great extent on their easy recognition as a security feature, because users will only then actually perform a security check based on such security feature if they are aware of its existence and nature.

Coatings or layers comprising oriented magnetic or magnetizable pigment particles are disclosed for example in U.S. Pat. Nos. 2,570,856; 3,676,273; 3,791,864; 5,630,877 and 5,364,689. Magnetic or magnetizable pigment particles in coatings allow for the production of magnetically induced images, designs and/or patterns through the application of a corresponding magnetic field, causing a local orientation of the magnetic or magnetizable pigment particles in the unhardened coating, followed by hardening the latter. This results in specific optical effects, i.e. fixed magnetically induced images, designs or patterns which are highly resistant to counterfeit. The security elements based on oriented magnetic or magnetizable pigments particles can only be produced by having access to both the magnetic or magnetizable pigment particles or a corresponding ink or composition comprising said particles, and the particular technology employed to apply said ink or composition and to orient said pigment particles in the applied ink or composition.

For example, U.S. Pat. No. 7,047,883 discloses an apparatus and a method for producing optical effect layers (OELs), obtained by orienting magnetic or magnetizable optically variable pigment flakes in a coating composition; the disclosed apparatus consists in specific arrangements of permanent magnets placed under the substrate carrying said coating composition. According to U.S. Pat. No. 7,047,883, a first portion of the magnetic or magnetizable optically variable pigment flakes in the OEL is oriented such as to reflect light in a first direction and a second portion adjacent to the first one is aligned such as to reflect light in a second direction, producing a visual "flip-flop" effect upon tilting the OEL.

WO 2006/069218 A2 discloses a substrate comprising an OEL comprising optically variable magnetic or magnetizable pigment flakes, oriented in such a way that a bar appears to move when said OEL is tilted ("rolling bar"). According to WO 2006/069218 A2, specific arrangements of permanent magnets under the substrate carrying the optically variable magnetic or magnetizable pigment flakes serve to orient said flakes such as to imitate a curved surface.

U.S. Pat. No. 7,955,695 relates to an OEL wherein so-called grated magnetic or magnetizable pigment particles are oriented mainly vertical to the substrate surface, such as to produce visual effects imitating a butterfly's wing with strong interference colors. Here again, specific arrangements of permanent magnets under the substrate carrying the coating composition serve to orient the pigment particles.

EP 1 819 525 B1 discloses a security element having OEL which appears transparent at certain angles of view, thus giving visual access to underlying information, whilst staying opaque at other viewing angles. To obtain this effect, known as "Venetian blind effect", specific arrangements of permanent magnets under the substrate orient the optically variable magnetizable or magnetic pigment flakes at a predetermined angle relatively to the substrate surface.

Moving-ring effects have been developed as efficient security elements. Moving-ring effects consist of optically illusive images of objects such as funnels, cones, bowls, circles, ellipses, and hemispheres that appear to move in any x-y direction depending upon the angle of tilt of said optical effect layer. Methods for producing moving-ring effects are disclosed for example in EP 1 710 756 A1, U.S. Pat. No. 8,343,615, EP 2 306 222 A1, EP 2 325 677 A2, and US 2013/084411.

WO 2011/092502 A2 discloses an apparatus for producing moving-ring images displaying an apparently moving ring with changing viewing angle. The disclosed moving-ring images might be obtained or produced by using a device allowing the orientation of magnetic or magnetizable particles with the help of a magnetic field produced by the combination of a soft magnetizable sheet and a spherical magnet having its magnetic axis perpendicular to the plane of the coating layer and disposed below said soft magnetizable sheet.

The prior art moving ring images are generally produced by alignment of the magnetic or magnetizable particles according to the magnetic field of only one rotating or static magnet. Since the field lines of only one magnet generally bend relatively softly, i.e. have a low curvature, also the change in orientation of the magnetic or magnetizable particles is relatively soft over the surface of the OEL. Further, the intensity of the magnetic field decreases rapidly with increasing distance from the magnet when only a single magnet is used. This makes it difficult to obtain a highly dynamic and well-defined feature through orientation of the magnetic or magnetizable particles, and may result in visual effects that exhibit blurred ring edges.

WO 2014/108404 A2 discloses optical effect layers (OEL) comprising a plurality of magnetically oriented non-spherical magnetic or magnetizable particles, which are dispersed in a coating. The specific magnetic orientation pattern of the disclosed OELs provides a viewer the optical effect or impression of a loop-shaped body that moves upon tilting of the OEL. Moreover, WO 2014/108404 A2 discloses OELs further exhibiting an optical effect or impression of a protrusion within the loop-shaped body caused by a reflection zone in the central area surrounded by the loop-shaped body. The disclosed protrusion provides the impression of a three-dimensional object, such as a half-sphere, present in the central area surrounded by the loop-shape body.

WO 2014/108303 A1 discloses optical effect layers (OEL) comprising a plurality of magnetically oriented non-spherical magnetic or magnetizable particles, which are dispersed in a coating. The specific magnetic orientation pattern of the disclosed OELs provides a viewer the optical effect or impression of a plurality of nested loop-shaped bodies surrounding one common central area, wherein said bodies exhibit a viewing-angle dependent apparent motion. Moreover, WO 2014/108303 A1 discloses OELs further comprising a protrusion which is surrounded by the innermost loop-shaped body and partly fills the central area defined thereby. The disclosed protrusion provides the illusion of a three-dimensional object, such as a half-sphere, present in the central area.

A need remains for security features displaying an eye-catching dynamic loop-shaped effect on a substrate in good quality, which can be easily verified regardless of the orientation of the security document, is difficult to produce on a mass-scale with the equipment available to a counterfeiter, and which can be provided in great number of possible shapes and forms.

SUMMARY OF THE INVENTION

Accordingly, it is an object of the present invention to overcome the deficiencies of the prior art as discussed above.

In a first aspect, the present invention provides a process for producing an optical effect layer (OEL) on a substrate and optical effect layers (OEL) obtained thereof, said process comprising the steps of:

i) applying on a substrate surface a radiation curable coating composition comprising non-spherical magnetic or magnetizable pigment particles, said radiation curable coating composition being in a first state, ii) exposing the radiation curable coating composition to a magnetic field of an apparatus comprising:

a magnetic assembly comprising a supporting matrix and:

a1) a loop-shaped magnetic-field generating device being either a single loop-shaped dipole magnet having a magnetic axis substantially perpendicular to the substrate surface or a combination of two or more dipole magnets disposed in a loop-shaped arrangement, each of the two or more dipole magnets having a magnetic axis substantially perpendicular to the substrate surface and having a same magnetic field direction, and a2) a single dipole magnet having a magnetic axis substantially perpendicular to the substrate surface or two or more dipole magnets having a magnetic axis substantially perpendicular to the substrate surface and having a same magnetic field direction and/or one or more pole pieces, b) a magnetic-field generating device being either a single bar dipole magnet having a magnetic axis substantially parallel to the substrate surface or a combination of two or more bar dipole magnets, each of the two or more bar dipole magnets having a magnetic axis substantially parallel to the substrate surface and having a same magnetic field direction, so as to orient at least a part of the non-spherical magnetic or magnetizable pigment particles, and iii) at least partially curing the radiation curable coating composition of step ii) to a second state so as to fix the non-spherical magnetic or magnetizable pigment particles in their adopted positions and orientations, wherein the optical effect layer provides an optical impression of one or more loop-shaped bodies having a size that varies upon tilting the optical effect layer.

In a further aspect, the present invention provides an optical effect layer (OEL) prepared by the process recited above.

In a further aspect, a use of the optical effect layer (OEL) is provided for the protection of a security document against counterfeiting or fraud or for a decorative application.

In a further aspect, the present invention provides a security document or a decorative element or object comprising one or more optical effect layer such as those described herein.

In a further aspect, the present invention provides an apparatus for producing the optical effect layer (OEL) described herein on a substrate such as those described herein, said OEL said OEL providing an optical impression of one or more loop-shaped bodies having a size that varies upon tilting the optical effect layer and comprising oriented non-spherical magnetic or magnetizable pigment particles in a cured radiation curable coating composition, wherein the apparatus comprises the magnetic assembly described herein and the magnetic-field generating device described herein.

The magnetic assembly and the magnetic-field generating device may be arranged one on top of the other.

The magnetic field produced by the magnetic assembly and the magnetic field produced by the magnetic-field generating device may interact so that the resulting magnetic field of the apparatus is able to orient non-spherical magnetic or magnetizable pigment particles in an as yet uncured radiation curable coating composition on the substrate, which are disposed in the magnetic field of the apparatus to produce an optical impression of one or more loop-shaped bodies having a size that varies upon tilting the optical effect layer.

The optical impression may be such that when the substrate is tilted in one direction from a perpendicular viewing angle, the one or more loop-shaped bodies appear to enlarge and when the substrate is tilted from the perpendicular viewing angle in an opposed direction to the first direction, the one or more loop-shaped bodies appear to shrink.

The single dipole magnet or the two or more dipole magnets may be located within the loop defined by the single loop-shaped dipole magnet or within the loop defined by the two or more dipole magnets disposed in the loop-shaped arrangement.

The support matrix may hold the single dipole magnet or the two or more dipole magnets within the loop defined by, and in spaced relation to, the single loop-shaped dipole magnet or within the loop defined by, and in spaced relation to, the two or more dipole magnets in the loop-shaped arrangement.

The single loop-shaped dipole magnet or the two or more dipole magnets disposed in the loop-shaped arrangement and the single dipole magnet or the two or more dipole magnets are preferably disposed within the supporting matrix, e.g. within recesses or spaces provided therein.

The one or more pole pieces, in particular the one or more loop-shaped pole pieces, may also be disposed within the supporting matrix.

The supporting matrix may hold the one or more pole pieces, in particular the one or more loop-shaped pole pieces, in spaced relation to the single loop-shaped dipole magnet or the two or more dipole magnets disposed in the loop-shaped arrangement and in spaced relation to the single dipole magnet or the two or more dipole magnets.

The one or more pole pieces may each be loop-shaped and disposed within the loop defined by the single loop-shaped dipole magnet or the loop defined by the two or more dipole magnets disposed in the loop-shaped arrangement.

The single dipole magnet or the two or more dipole magnets and the optional one or more pole pieces, in particular the one or more loop-shaped pole pieces, may be arranged coplanar with the single loop-shaped dipole magnet or the two or more dipole magnets disposed in the loop-shaped arrangement.

In a further aspect, the present invention provides a use of the apparatus described herein for producing the optical effect layer (OEL) described herein on a substrate such as those described herein.

In a further aspect, the present invention provides printing apparatus comprising a rotating magnetic cylinder comprising at least one of the apparatuses described herein or a flatbed printing unit comprising at least one of the apparatuses described herein.

In a further aspect, the present invention provides a use of the printing apparatus recited described herein for producing the optical effect layer (OEL) described herein on a substrate such as those described herein.

BRIEF DESCRIPTION OF DRAWINGS

FIG. 1B1 schematically illustrates a top view of the magnetic assembly (130) of FIG. 1A.

FIG. 1B2 schematically illustrates a cross section of the supporting matrix (134) of FIG. 1A.

FIG. 1C shows pictures of an OEL obtained by using the apparatus illustrated in FIG. 1A-B, as viewed under different viewing angles.

FIG. 2B1 schematically illustrates a top view of the magnetic assembly (230) of FIG. 2A.

FIG. 2B2 schematically illustrates a cross section of the supporting matrix (234) of FIG. 2A.

FIG. 2C shows pictures of an OEL obtained by using the apparatus illustrated in FIG. 2A-B, as viewed under different viewing angles.

FIG. 3B1 schematically illustrates a bottom view of the magnetic assembly (330) of FIG. 3A.

FIG. 3B2 schematically illustrates a cross section of the supporting matrix (334) of FIG. 3A.

FIG. 3C shows pictures of an OEL obtained by using the apparatus illustrated in FIG. 3A-B, as viewed under different viewing angles.

FIG. 4B1 schematically illustrates a top view of the magnetic assembly (430) of FIG. 4A.

FIG. 4B2 schematically illustrates a cross section of the supporting matrix (434) of FIG. 4A.

FIG. 5B1 schematically illustrates a top view of the magnetic assembly (530) of FIG. 5A.

FIG. 5B2 schematically illustrates a cross section of the supporting matrix (534) of FIG. 5A.

FIG. 5C shows pictures of an OEL obtained by using the apparatus illustrated in FIG. 5A-B, as viewed under different viewing angles.

FIG. 6B1 schematically illustrates a bottom view of the magnetic assembly (630) of FIG. 6A.

FIG. 6B2 schematically illustrates a cross section of the supporting matrix (634) of FIG. 6A.

FIG. 6C shows pictures of an OEL obtained by using the apparatus illustrated in FIG. 6A-B, as viewed under different viewing angles.

FIG. 7B1 schematically illustrates a bottom view of the magnetic assembly (730) of FIG. 7A.

FIG. 7B2 schematically illustrates a cross section of the supporting matrix (734) of FIG. 7A.

FIG. 7C shows pictures of an OEL obtained by using the apparatus illustrated in FIG. 7A-B, as viewed under different viewing angles.

FIG. 8B1 schematically illustrates a bottom view of the magnetic assembly (830) of FIG. 8A.

FIG. 8B2 schematically illustrates a cross section of the supporting matrix (834) of FIG. 8A.

FIG. 8C shows pictures of an OEL obtained by using the apparatus illustrated in FIG. 8A-B, as viewed under different viewing angles.

FIG. 9B1 schematically illustrates a bottom view of the magnetic assembly (930) of FIG. 9A.

FIG. 9B2 schematically illustrates a cross section of the supporting matrix (934) of FIG. 9A.

FIG. 9C shows pictures of an OEL obtained by using the apparatus illustrated in FIG. 9A-B, as viewed under different viewing angles.

FIG. 10B1 schematically illustrates a bottom view of the magnetic assembly (1030) of FIG. 10A.

FIG. 10B2 schematically illustrates a cross section of the supporting matrix (1034) of FIG. 10A.

FIG. 10C shows pictures of an OEL obtained by using the apparatus illustrated in FIG. 10A-B, as viewed under different viewing angles.

FIG. 11B1 schematically illustrates a bottom view of the magnetic assembly (1130) of FIG. 11A.

FIG. 11B2 schematically illustrates a cross section of the supporting matrix (1134) of FIG. 11A.

FIG. 11C shows pictures of an OEL obtained by using the apparatus illustrated in FIG. 11A-B, as viewed under different viewing angles.

FIG. 12B1 schematically illustrates a top view of the magnetic assembly (1230) of FIG. 12A.

FIG. 12B2 schematically illustrates a cross section of the supporting matrix (1234) of FIG. 12A.

FIG. 12C shows pictures of an OEL obtained by using the apparatus illustrated in FIG. 12A-B, as viewed under different viewing angles.

DETAILED DESCRIPTION

Definitions

Figure 1A:
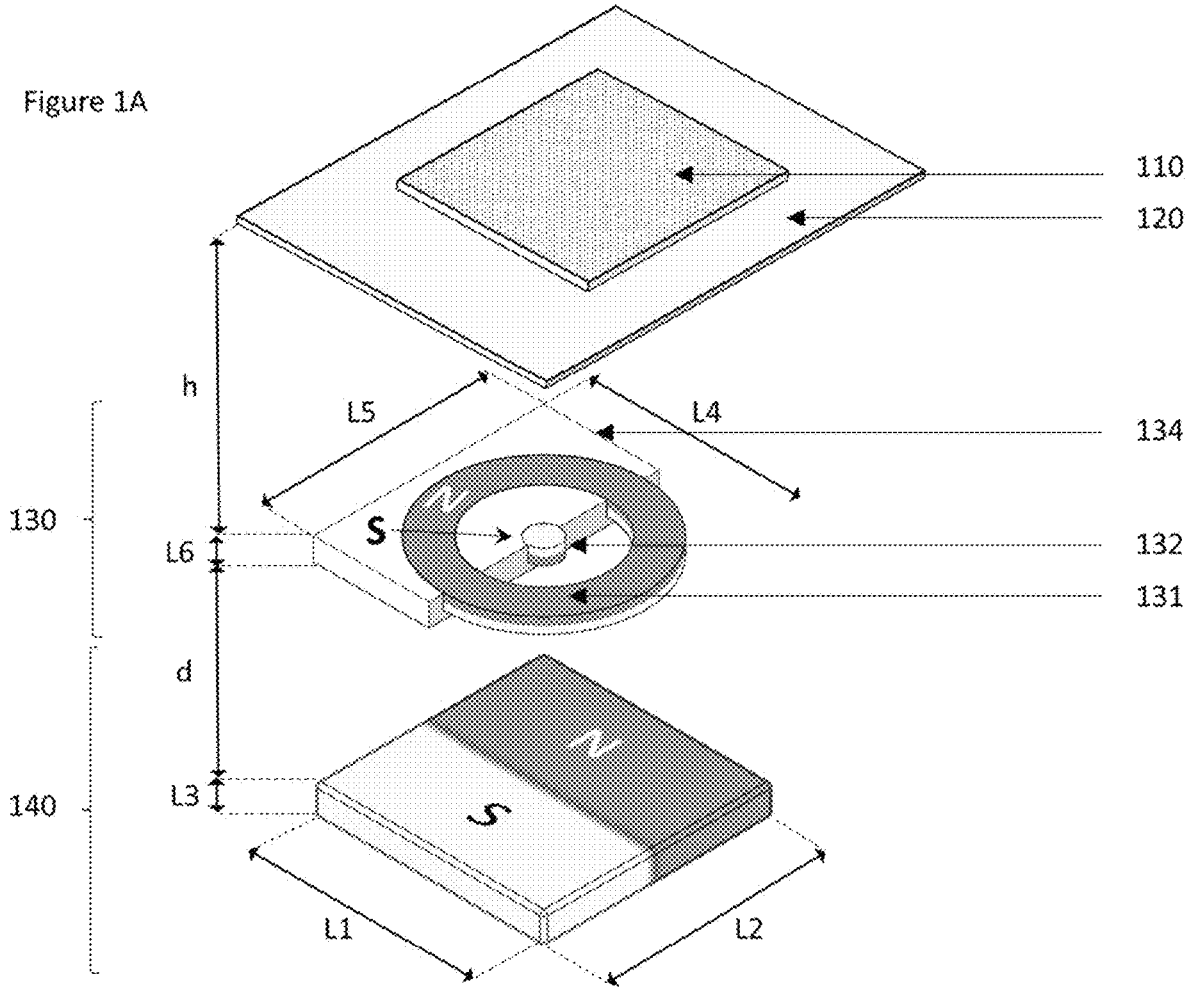
FIG. 1A schematically illustrates an apparatus comprising a) a magnetic assembly (130), said magnetic assembly comprising a supporting matrix (134), a loop-shaped magnetic-field generating device (131), in particular a ring-shaped dipole magnet, and a dipole magnet (132); and b) a magnetic-field generating device (140). Said apparatus is suitable for producing an optical effect layer (110) on a substrate (120).

The following definitions are to be used to interpret the meaning of the terms discussed in the description and recited in the claims.

As used herein, the indefinite article "a" indicates one as well as more than one and does not necessarily limit its referent noun to the singular.

As used herein, the term "about" means that the amount or value in question may be the specific value designated or some other value in its neighborhood. Generally, the term "about" denoting a certain value is intended to denote a range within ±5% of the value. As one example, the phrase "about 100" denotes a range of 100±5, i.e. the range from 95 to 105. Generally, when the term "about" is used, it can be expected that similar results or effects according to the invention can be obtained within a range of ±5% of the indicated value.

The term "substantially parallel" refers to deviating not more than 10° from parallel alignment and the term "substantially perpendicular" refers to deviating not more than 10° from perpendicular alignment.

As used herein, the term "and/or" means that either all or only one of the elements of said group may be present. For example, "A and/or B" shall mean "only A, or only B, or both A and B". In the case of "only A", the term also covers the possibility that B is absent, i.e. "only A, but not B".

The term "comprising" as used herein is intended to be non-exclusive and open-ended. Thus, for instance a fountain solution comprising a compound A may include other compounds besides A. However, the term "comprising" also covers, as a particular embodiment thereof, the more restrictive meanings of "consisting essentially of" and "consisting of", so that for instance "a fountain solution comprising A, B and optionally C" may also (essentially) consist of A and B, or (essentially) consist of A, B and C.

The term "coating composition" refers to any composition which is capable of forming an optical effect layer (OEL) of the present invention on a solid substrate and which can be applied preferentially but not exclusively by a printing method. The coating composition comprises at least a plurality of non-spherical magnetic or magnetizable particles and a binder.

The term "optical effect layer (OEL)" as used herein denotes a layer that comprises at least a plurality of magnetically oriented non-spherical magnetic or magnetizable particles and a binder, wherein the orientation of the non-spherical magnetic or magnetizable particles is fixed or frozen (fixed/frozen) within the binder.

The term "magnetic axis" denotes a theoretical line connecting the corresponding North and South poles of a magnet and extending through said poles. This term does not include any specific magnetic field direction.

The term "magnetic field direction" denotes the direction of the magnetic field vector along a magnetic field pointing from the North pole at the exterior of a magnet to the South pole (see Handbook of Physics, Springer 2002, pages 463-464).

The term "curing" is used to denote a process wherein an increased viscosity of a coating composition in reaction to a stimulus to convert a material into a state, i.e. a hardened or solid state, where the non-spherical magnetic or magnetizable pigment particles are fixed/frozen in their current positions and orientations and can no longer move nor rotate.

Where the present description refers to "preferred" embodiments/features, combinations of these "preferred" embodiments/features shall also be deemed as disclosed as long as this combination of "preferred" embodiments/features is technically meaningful.

As used herein, the term "at least" is meant to define one or more than one, for example one or two or three.

The term "security document" refers to a document which is usually protected against counterfeit or fraud by at least one security feature. Examples of security documents include without limitation value documents and value commercial goods.

The term "security feature" is used to denote an image, pattern or graphic element that can be used for authentication purposes.

The term "loop-shaped body" denotes that the non-spherical magnetic or magnetizable particles are provided such that the OEL confers to the viewer the visual impression of a closed body re-combining with itself, forming a closed loop-shaped body surrounding one central area. The "loop-shaped body" can have round, oval, ellipsoid, square, triangular, rectangular or any polygonal shape. Examples of loop-shapes include a ring or circle, a rectangle or square (with or without rounded corners), a triangle (with or without rounded corners), a (regular or irregular) pentagon (with or without rounded corners), a (regular or irregular) hexagon (with or without rounded corners), a (regular or irregular) heptagon (with or without rounded corners), an (regular or irregular) octagon (with or without rounded corners), any polygonal shape (with or without rounded corners), etc. In the present invention, the optical impression of one or more loop-shaped bodies is formed by the orientation of the non-spherical magnetic or magnetizable particles.

The present invention provides methods for producing an optical effect layer (OEL) on a substrate and optical effect layers (OELs) obtained thereof, wherein said methods comprise a step i) of applying on the substrate surface the radiation curable coating composition comprising non-spherical magnetic or magnetizable pigment particles described herein, said radiation curable coating composition being in a first state.

The applying step i) described herein is preferably carried out by a printing process preferably selected from the group consisting of screen printing, rotogravure printing, flexography printing, inkjet printing and intaglio printing (also referred in the art as engraved copper plate printing and engraved steel die printing), more preferably selected from the group consisting of screen printing, rotogravure printing and flexography printing.

Subsequently to, partially simultaneously with or simultaneously with the application of the radiation curable coating composition described herein on the substrate surface described herein (step i)), at least a part of the non-spherical magnetic or magnetizable pigment particles are oriented (step ii)) by exposing the radiation curable coating composition to the magnetic field of the apparatus described herein, so as to align at least part of the non-spherical magnetic or magnetizable pigment particles along the magnetic field lines generated by the apparatus.

Subsequently to or partially simultaneously with the steps of orienting/aligning at least a part of the non-spherical magnetic or magnetizable pigment particles by applying the magnetic field described herein, the orientation of the non-spherical magnetic or magnetizable pigment particles is fixed or frozen. The radiation curable coating composition must thus noteworthy have a first state, i.e. a liquid or pasty state, wherein the radiation curable coating composition is wet or soft enough, so that the non-spherical magnetic or magnetizable pigment particles dispersed in the radiation curable coating composition are freely movable, rotatable and/or orientable upon exposure to the magnetic field, and a second cured (e.g. solid) state, wherein the non-spherical magnetic or magnetizable pigment particles are fixed or frozen in their respective positions and orientations.

Accordingly, the methods for producing an optical effect layer (OEL) on a substrate described herein comprises a step iii) of at least partially curing the radiation curable coating composition of step ii) to a second state so as to fix the non-spherical magnetic or magnetizable pigment particles in their adopted positions and orientations. The step iii) of at least partially curing the radiation curable coating composition may be carried out subsequently to or partially simultaneously with the step of orienting/aligning at least a part of the non-spherical magnetic or magnetizable pigment particles by applying the magnetic field described herein (step ii)). Preferably, the step iii) of at least partially curing the radiation curable coating composition is carried out partially simultaneously with the step of orienting/aligning at least a part of the non-spherical magnetic or magnetizable pigment particles by applying the magnetic field described herein (step ii)). By "partially simultaneously", it is meant that both steps are partly performed simultaneously, i.e. the times of performing each of the steps partially overlap. In the context described herein, when curing is performed partially simultaneously with the orientation step ii), it must be understood that curing becomes effective after the orientation so that the pigment particles orient before the complete or partial hardening of the OEL.

The so-obtained optical effect layers (OELs) provides a viewer the optical impression of one more loop-shaped bodies having a size that varies upon tilting the substrate comprising the optical effect layer, i.e. the so-obtained OEL provides a viewer the optical impression of a loop-shaped body having a size that varies upon tilting the substrate comprising the optical effect layer or provide a viewer the optical impression of a plurality of nested loop-shaped bodies having a size that varies upon tilting the substrate comprising the optical effect layer. The optical impression may be such that when the substrate is tilted in one direction from a perpendicular viewing angle, the loop-shaped body appears to enlarge and when the substrate is tilted from the perpendicular viewing angle in an opposed direction to the first direction, the loop-shaped body appears to shrink.

The first and second states of the radiation curable coating composition are provided by using a certain type of radiation curable coating composition. For example, the components of the radiation curable coating composition other than the non-spherical magnetic or magnetizable pigment particles may take the form of an ink or radiation curable coating composition such as those which are used in security applications, e.g. for banknote printing. The aforementioned first and second states are provided by using a material that shows an increase in viscosity in reaction to an exposure to an electromagnetic radiation. That is, when the fluid binder material is cured or solidified, said binder material converts into the second state, where the non-spherical magnetic or magnetizable pigment particles are fixed in their current positions and orientations and can no longer move nor rotate within the binder material.

As known to those skilled in the art, ingredients comprised in a radiation curable coating composition to be applied onto a surface such as a substrate and the physical properties of said radiation curable coating composition must fulfil the requirements of the process used to transfer the radiation curable coating composition to the substrate surface. Consequently, the binder material comprised in the radiation curable coating composition described herein is typically chosen among those known in the art and depends on the coating or printing process used to apply the radiation curable coating composition and the chosen radiation curing process.

In the optical effect layers (OELs) described herein, the non-spherical magnetic or magnetizable pigment particles described herein are dispersed in the radiation curable coating composition comprising a cured binder material that fixes/freezes the orientation of the non-spherical magnetic or magnetizable pigment particles. The cured binder material is at least partially transparent to electromagnetic radiation of a range of wavelengths comprised between 200 nm and 2500 nm. The binder material is thus, at least in its cured or solid state (also referred to as second state herein), at least partially transparent to electromagnetic radiation of a range of wavelengths comprised between 200 nm and 2500 nm, i.e. within the wavelength range which is typically referred to as the "optical spectrum" and which comprises infrared, visible and UV portions of the electromagnetic spectrum, such that the particles contained in the binder material in its cured or solid state and their orientation-dependent reflectivity can be perceived through the binder material. Preferably, the cured binder material is at least partially transparent to electromagnetic radiation of a range of wavelengths comprised between 200 nm and 800 nm, more preferably comprised between 400 nm and 700 nm. Herein, the term "transparent" denotes that the transmission of electromagnetic radiation through a layer of 20 μm of the cured binder material as present in the OEL (not including the platelet-shaped magnetic or magnetizable pigment particles, but all other optional components of the OEL in case such components are present) is at least 50%, more preferably at least 60%, even more preferably at least 70%, at the wavelength(s) concerned. This can be determined for example by measuring the transmittance of a test piece of the cured binder material (not including the platelet-shaped magnetic or magnetizable pigment particles) in accordance with well-established test methods, e.g. DIN 5036-3 (1979-11). If the OEL serves as a covert security feature, then typically technical means will be necessary to detect the (complete) optical effect generated by the OEL under respective illuminating conditions comprising the selected non-visible wavelength; said detection requiring that the wavelength of incident radiation is selected outside the visible range, e.g. in the near UV-range. In this case, it is preferable that the OEL comprises luminescent pigment particles that show luminescence in response to the selected wavelength outside the visible spectrum contained in the incident radiation. The infrared, visible and UV portions of the electromagnetic spectrum approximately correspond to the wavelength ranges between 700-2500 nm, 400-700 nm, and 200-400 nm respectively.

As mentioned hereabove, the radiation curable coating composition described herein depends on the coating or printing process used to apply said radiation curable coating composition and the chosen curing process. Preferably, curing of the radiation curable coating composition involves a chemical reaction which is not reversed by a simple temperature increase (e.g. up to 80° C.) that may occur during a typical use of an article comprising the OEL described herein. The term "curing" or "curable" refers to processes including the chemical reaction, crosslinking or polymerization of at least one component in the applied radiation curable coating composition in such a manner that it turns into a polymeric material having a greater molecular weight than the starting substances. Radiation curing advantageously leads to an instantaneous increase in viscosity of the radiation curable coating composition after exposure to the curing irradiation, thus preventing any further movement of the pigment particles and in consequence any loss of information after the magnetic orientation step. Preferably, the curing step (step iii)) is carried out by radiation curing including UV-visible light radiation curing or by E-beam radiation curing, more preferably by UV-Vis light radiation curing.

Therefore, suitable radiation curable coating compositions for the present invention include radiation curable compositions that may be cured by UV-visible light radiation (hereafter referred as UV-Vis radiation) or by E-beam radiation (hereafter referred as EB radiation). Radiation curable compositions are known in the art and can be found in standard textbooks such as the series "Chemistry & Technology of UV & EB Formulation for Coatings, Inks & Paints", Volume IV, Formulation, by C. Lowe, G. Webster, S. Kessel and I. McDonald, 1996 by John Wiley & Sons in association with SITA Technology Limited. According to one particularly preferred embodiment of the present invention, the radiation curable coating composition described herein is a UV-Vis radiation curable coating composition.

Preferably, the UV-Vis radiation curable coating composition comprises one or more compounds selected from the group consisting of radically curable compounds and cationically curable compounds. The UV-Vis radiation curable coating composition described herein may be a hybrid system and comprise a mixture of one or more cationically curable compounds and one or more radically curable compounds. Cationically curable compounds are cured by cationic mechanisms typically including the activation by radiation of one or more photoinitiators which liberate cationic species, such as acids, which in turn initiate the curing so as to react and/or cross-link the monomers and/or oligomers to thereby cure the radiation curable coating composition. Radically curable compounds are cured by free radical mechanisms typically including the activation by radiation of one or more photoinitiators, thereby generating radicals which in turn initiate the polymerization so as to cure the radiation curable coating composition. Depending on the monomers, oligomers or prepolymers used to prepare the binder comprised in the UV-Vis radiation curable coating compositions described herein, different photoinitiators might be used. Suitable examples of free radical photoinitiators are known to those skilled in the art and include without limitation acetophenones, benzophenones, benzyldimethyl ketals, alpha-aminoketones, alpha-hydroxyketones, phosphine oxides and phosphine oxide derivatives, as well as mixtures of two or more thereof. Suitable examples of cationic photoinitiators are known to those skilled in the art and include without limitation onium salts such as organic iodonium salts (e.g. diaryl iodoinium salts), oxonium (e.g. triaryloxonium salts) and sulfonium salts (e.g. triarylsulphonium salts), as well as mixtures of two or more thereof. Other examples of useful photoinitiators can be found in standard textbooks such as "Chemistry & Technology of UV & EB Formulation for Coatings, Inks & Paints", Volume III, "Photoinitiators for Free Radical Cationic and Anionic Polymerization", 2nd edition, by J. V. Crivello & K. Dietliker, edited by G. Bradley and published in 1998 by John Wiley & Sons in association with SITA Technology Limited. It may also be advantageous to include a sensitizer in conjunction with the one or more photoinitiators in order to achieve efficient curing. Typical examples of suitable photosensitizers include without limitation isopropyl-thioxanthone (ITX), 1-chloro-2-propoxy-thioxanthone (CPTX), 2-chloro-thioxanthone (CTX) and 2,4-diethyl-thioxanthone (DETX) and mixtures of two or more thereof. The one or more photoinitiators comprised in the UV-Vis radiation curable coating compositions are preferably present in a total amount from about 0.1 wt-% to about 20 wt-%, more preferably about 1 wt-% to about 15 wt-%, the weight percents being based on the total weight of the UV-Vis radiation curable coating compositions.

The radiation curable coating composition described herein may further comprise one or more marker substances or taggants and/or one or more machine readable materials selected from the group consisting of magnetic materials (different from the platelet-shaped magnetic or magnetizable pigment particles described herein), luminescent materials, electrically conductive materials and infrared-absorbing materials. As used herein, the term "machine readable material" refers to a material which exhibits at least one distinctive property which is not perceptible by the naked eye, and which can be comprised in a layer so as to confer a way to authenticate said layer or article comprising said layer by the use of a particular equipment for its authentication.

The radiation curable coating composition described herein may further comprise one or more coloring components selected from the group consisting of organic pigment particles, inorganic pigment particles, and organic dyes, and/or one or more additives. The latter include without limitation compounds and materials that are used for adjusting physical, rheological and chemical parameters of the radiation curable coating composition such as the viscosity (e.g. solvents, thickeners and surfactants), the consistency (e.g. anti-settling agents, fillers and plasticizers), the foaming properties (e.g. antifoaming agents), the lubricating properties (waxes, oils), UV stability (photostabilizers), the adhesion properties, the antistatic properties, the storage stability (polymerization inhibitors) etc. Additives described herein may be present in the radiation curable coating composition in amounts and in forms known in the art, including so-called nano-materials where at least one of the dimensions of the additive is in the range of 1 to 1000 nm.

The radiation curable coating composition described herein comprises non-spherical magnetic or magnetizable pigment particles described herein. Preferably, the non-spherical magnetic or magnetizable pigment particles are present in an amount from about 2 wt-% to about 40 wt-%, more preferably about 4 wt-% to about 30 wt-%, the weight percents being based on the total weight of the radiation curable coating composition comprising the binder material, the non-spherical magnetic or magnetizable pigment particles and other optional components of the radiation curable coating composition.

Non-spherical magnetic or magnetizable pigment particles described herein are defined as having, due to their non-spherical shape, non-isotropic reflectivity with respect to an incident electromagnetic radiation for which the hardened binder material is at least partially transparent. As used herein, the term "non-isotropic reflectivity" denotes that the proportion of incident radiation from a first angle that is reflected by a particle into a certain (viewing) direction (a second angle) is a function of the orientation of the particles, i.e. that a change of the orientation of the particle with respect to the first angle can lead to a different magnitude of the reflection to the viewing direction. Preferably, the non-spherical magnetic or magnetizable pigment particles described herein have a non-isotropic reflectivity with respect to incident electromagnetic radiation in some parts or in the complete wavelength range of from about 200 to about 2500 nm, more preferably from about 400 to about 700 nm, such that a change of the particle's orientation results in a change of reflection by that particle into a certain direction. As known by the man skilled in the art, the magnetic or magnetizable pigment particles described herein are different from conventional pigments, said conventional pigment particles displaying the same color for all viewing angles, whereas the magnetic or magnetizable pigment particles described herein exhibit non-isotropic reflectivity as described hereabove.

The non-spherical magnetic or magnetizable pigment particles are preferably prolate or oblate ellipsoid-shaped, platelet-shaped or needle-shaped particles or a mixture of two or more thereof and more preferably platelet-shaped particles.

Suitable examples of non-spherical magnetic or magnetizable pigment particles described herein include without limitation pigment particles comprising a magnetic metal selected from the group consisting of cobalt (Co), iron (Fe), gadolinium (Gd) and nickel (Ni); magnetic alloys of iron, manganese, cobalt, nickel and mixtures of two or more thereof; magnetic oxides of chromium, manganese, cobalt, iron, nickel and mixtures of two or more thereof; and mixtures of two or more thereof. The term "magnetic" in reference to the metals, alloys and oxides is directed to ferromagnetic or ferrimagnetic metals, alloys and oxides. Magnetic oxides of chromium, manganese, cobalt, iron, nickel or a mixture of two or more thereof may be pure or mixed oxides. Examples of magnetic oxides include without limitation iron oxides such as hematite ($Fe_2O_3$), magnetite ($Fe_3O_4$), chromium dioxide ($CrO_2$), magnetic ferrites ($MFe_2O_4$), magnetic spinels ($MR_2O_4$), magnetic hexaferrites ($MFe_{12}O_{19}$), magnetic orthoferrites ($RFeO_3$), magnetic garnets $M_3R_2(AO_4)_3$, wherein M stands for two-valent metal, R stands for three-valent metal, and A stands for four-valent metal.

Examples of non-spherical magnetic or magnetizable pigment particles described herein include without limitation pigment particles comprising a magnetic layer M made from one or more of a magnetic metal such as cobalt (Co), iron (Fe), gadolinium (Gd) or nickel (Ni); and a magnetic alloy of iron, cobalt or nickel, wherein said platelet-shaped magnetic or magnetizable pigment particles may be multilayered structures comprising one or more additional layers. Preferably, the one or more additional layers are layers A independently made from one or more materials selected from the group consisting of metal fluorides such as magnesium fluoride ($MgF_2$), silicium oxide (SiO), silicium dioxide ($SiO_2$), titanium oxide ($TiO_2$), zinc sulphide (ZnS) and aluminum oxide ($Al_2O_3$), more preferably silicium dioxide ($SiO_2$); or layers B independently made from one or more materials selected from the group consisting of metals and metal alloys, preferably selected from the group consisting of reflective metals and reflective metal alloys, and more preferably selected from the group consisting of aluminum (Al), chromium (Cr), and nickel (Ni), and still more preferably aluminum (Al); or a combination of one or more layers A such as those described hereabove and one or more layers B such as those described hereabove. Typical examples of the platelet-shaped magnetic or magnetizable pigment particles being multilayered structures described hereabove include without limitation A/M multilayer structures, A/M/A multilayer structures, A/M/B multilayer structures, A/B/M/A multilayer structures, A/B/M/B multilayer structures, A/B/M/B/A multilayer structures, B/M multilayer structures, B/M/B multilayer structures, B/A/M/A multilayer structures, B/A/M/B multilayer structures, B/A/M/B/A/multilayer structures, wherein the layers A, the magnetic layers M and the layers B are chosen from those described hereabove.

At least part of the non-spherical magnetic or magnetizable pigment particles described herein may be constituted by non-spherical optically variable magnetic or magnetizable pigment particles and/or non-spherical magnetic or magnetizable pigment particles having no optically variable properties. Preferably, at least a part of the non-spherical magnetic or magnetizable pigment particles described herein is constituted by non-spherical optically variable magnetic or magnetizable pigment particles. In addition to the overt security provided by the colorshifting property of non-spherical optically variable magnetic or magnetizable pigment particles, which allows easily detecting, recognizing and/or discriminating an article or security document carrying an ink, radiation curable coating composition, coating or layer comprising the non-spherical optically variable magnetic or magnetizable pigment particles described herein from their possible counterfeits using the unaided human senses, the optical properties of the platelet-shaped optically variable magnetic or magnetizable pigment particles may also be used as a machine readable tool for the recognition of the OEL. Thus, the optical properties of the non-spherical optically variable magnetic or magnetizable pigment particles may simultaneously be used as a covert or semi-covert security feature in an authentication process wherein the optical (e.g. spectral) properties of the pigment particles are analyzed. The use of non-spherical optically variable magnetic or magnetizable pigment particles in radiation curable coating compositions for producing an OEL enhances the significance of the OEL as a security feature in security document applications, because such materials (i.e. non-spherical optically variable magnetic or magnetizable pigment particles) are reserved to the security document printing industry and are not commercially available to the public.

Moreover, and due to their magnetic characteristics, the non-spherical magnetic or magnetizable pigment particles described herein are machine readable, and therefore radiation curable coating compositions comprising those pigment particles may be detected for example with specific magnetic detectors. Radiation curable coating compositions comprising the non-spherical magnetic or magnetizable pigment particles described herein may therefore be used as a covert or semi-covert security element (authentication tool) for security documents.

As mentioned above, preferably at least a part of the non-spherical magnetic or magnetizable pigment particles is constituted by non-spherical optically variable magnetic or magnetizable pigment particles. These can more preferably be selected from the group consisting of non-spherical magnetic thin-film interference pigment particles, non-spherical magnetic cholesteric liquid crystal pigment particles, non-spherical interference coated pigment particles comprising a magnetic material and mixtures of two or more thereof.

Magnetic thin film interference pigment particles are known to those skilled in the art and are disclosed e.g. in U.S. Pat. No. 4,838,648; WO 2002/073250 A2; EP 0 686 675 B1; WO 2003/000801 A2; U.S. Pat. No. 6,838,166; WO 2007/131833 A1; EP 2 402 401 A1 and in the documents cited therein. Preferably, the magnetic thin film interference pigment particles comprise pigment particles having a five-layer Fabry-Perot multilayer structure and/or pigment particles having a six-layer Fabry-Perot multilayer structure and/or pigment particles having a seven-layer Fabry-Perot multilayer structure.

Preferred five-layer Fabry-Perot multilayer structures consist of absorber/dielectric/reflector/dielectric/absorber multilayer structures wherein the reflector and/or the absorber is also a magnetic layer, preferably the reflector and/or the absorber is a magnetic layer comprising nickel, iron and/or cobalt, and/or a magnetic alloy comprising nickel, iron and/or cobalt and/or a magnetic oxide comprising nickel (Ni), iron (Fe) and/or cobalt (Co).

Preferred six-layer Fabry-Perot multilayer structures consist of absorber/dielectric/reflector/magnetic/dielectric/absorber multilayer structures.

Preferred seven-layer Fabry Perot multilayer structures consist of absorber/dielectridreflector/magnetic/reflector/dielectric/absorber multilayer structures such as disclosed in U.S. Pat. No. 4,838,648.

Preferably, the reflector layers described herein are independently made from one or more materials selected from the group consisting of metals and metal alloys, preferably selected from the group consisting of reflective metals and reflective metal alloys, more preferably selected from the group consisting of aluminum (Al), silver (Ag), copper (Cu), gold (Au), platinum (Pt), tin (Sn), titanium (Ti), palladium (Pd), rhodium (Rh), niobium (Nb), chromium (Cr), nickel (Ni), and alloys thereof, even more preferably selected from the group consisting of aluminum (Al), chromium (Cr), nickel (Ni) and alloys thereof, and still more preferably aluminum (Al). Preferably, the dielectric layers are independently made from one or more materials selected from the group consisting of metal fluorides such as magnesium fluoride ($MgF_2$), aluminum fluoride ($AlF_3$), cerium fluoride ($CeF_3$), lanthanum fluoride ($LaF_3$), sodium aluminum fluorides (e.g. $Na_3AlF_6$), neodymium fluoride ($NdF_3$), samarium fluoride ($SmF_3$), barium fluoride ($BaF_2$), calcium fluoride ($CaF_2$), lithium fluoride (LiF), and metal oxides such as silicium oxide (SiO), silicium dioxide ($SiO_2$), titanium oxide ($TiO_2$), aluminum oxide ($Al_2O_3$), more preferably selected from the group consisting of magnesium fluoride ($MgF_2$) and silicium dioxide ($SiO_2$) and still more preferably magnesium fluoride ($MgF_2$). Preferably, the absorber layers are independently made from one or more materials selected from the group consisting of aluminum (Al), silver (Ag), copper (Cu), palladium (Pd), platinum (Pt), titanium (Ti), vanadium (V), iron (Fe) tin (Sn), tungsten (W), molybdenum (Mo), rhodium (Rh), Niobium (Nb), chromium (Cr), nickel (Ni), metal oxides thereof, metal sulfides thereof, metal carbides thereof, and metal alloys thereof, more preferably selected from the group consisting of chromium (Cr), nickel (Ni), metal oxides thereof, and metal alloys thereof, and still more preferably selected from the group consisting of chromium (Cr), nickel (Ni), and metal alloys thereof. Preferably, the magnetic layer comprises nickel (Ni), iron (Fe) and/or cobalt (Co); and/or a magnetic alloy comprising nickel (Ni), iron (Fe) and/or cobalt (Co); and/or a magnetic oxide comprising nickel (Ni), iron (Fe) and/or cobalt (Co). When magnetic thin film interference pigment particles comprising a seven-layer Fabry-Perot structure are preferred, it is particularly preferred that the magnetic thin film interference pigment particles comprise a seven-layer Fabry-Perot absorber/dielectric/reflector/magnetic/reflector/dielectric/absorber multilayer structure consisting of a $Cr/MgF_2/Al/M/Al/MgF_2/Cr$ multilayer structure, wherein M a magnetic layer comprising nickel (Ni), iron (Fe) and/or cobalt (Co); and/or a magnetic alloy comprising nickel (Ni), iron (Fe) and/or cobalt (Co); and/or a magnetic oxide comprising nickel (Ni), iron (Fe) and/or cobalt (Co).

The magnetic thin film interference pigment particles described herein may be multilayer pigment particles being considered as safe for human health and the environment and being based for example on five-layer Fabry-Perot multilayer structures, six-layer Fabry-Perot multilayer structures and seven-layer Fabry-Perot multilayer structures, wherein said pigment particles include one or more magnetic layers comprising a magnetic alloy having a substantially nickel-free composition including about 40 wt-% to about 90 wt-% iron, about 10 wt-% to about 50 wt-% chromium and about 0 wt-% to about 30 wt-% aluminum. Typical examples of multilayer pigment particles being considered as safe for human health and the environment can be found in EP 2 402 401 A1 which is hereby incorporated by reference in its entirety.

Magnetic thin film interference pigment particles described herein are typically manufactured by a conventional deposition technique for the different required layers onto a web. After deposition of the desired number of layers, e.g. by physical vapor deposition (PVD), chemical vapor deposition (CVD) or electrolytic deposition, the stack of layers is removed from the web, either by dissolving a release layer in a suitable solvent, or by stripping the material from the web. The so-obtained material is then broken down to platelet-shaped pigment particles which have to be further processed by grinding, milling (such as for example jet milling processes) or any suitable method so as to obtain pigment particles of the required size. The resulting product consists of flat platelet-shaped pigment particles with broken edges, irregular shapes and different aspect ratios. Further information on the preparation of suitable platelet-shaped magnetic thin film interference pigment particles can be found e.g. in EP 1 710 756 A1 and EP 1 666 546 A1 which are hereby incorporated by reference.

Suitable magnetic cholesteric liquid crystal pigment particles exhibiting optically variable characteristics include without limitation magnetic monolayered cholesteric liquid crystal pigment particles and magnetic multilayered cholesteric liquid crystal pigment particles. Such pigment particles are disclosed for example in WO 2006/063926 A1, U.S. Pat. Nos. 6,582,781 and 6,531,221. WO 2006/063926 A1 discloses monolayers and pigment particles obtained therefrom with high brilliance and colorshifting properties with additional particular properties such as magnetizability. The disclosed monolayers and pigment particles, which are obtained therefrom by comminuting said monolayers, include a three-dimensionally crosslinked cholesteric liquid crystal mixture and magnetic nanoparticles. U.S. Pat. Nos. 6,582,781 and 6,410,130 disclose cholesteric multilayer pigment particles which comprise the sequence $A^1/B/A^2$, wherein $A^1$ and $A^2$ may be identical or different and each comprises at least one cholesteric layer, and B is an interlayer absorbing all or some of the light transmitted by the layers $A^1$ and $A^2$ and imparting magnetic properties to said interlayer. U.S. Pat. No. 6,531,221 discloses platelet-shaped cholesteric multilayer pigment particles which comprise the sequence A/B and optionally C, wherein A and C are absorbing layers comprising pigment particles imparting magnetic properties, and B is a cholesteric layer.

Suitable interference coated pigments comprising one or more magnetic materials include without limitation structures consisting of a substrate selected from the group consisting of a core coated with one or more layers, wherein at least one of the core or the one or more layers have magnetic properties. For example, suitable interference coated pigments comprise a core made of a magnetic material such as those described hereabove, said core being coated with one or more layers made of one or more metal oxides, or they have a structure consisting of a core made of synthetic or natural micas, layered silicates (e.g. talc, kaolin and sericite), glasses (e.g. borosilicates), silicium dioxides ($SiO_2$), aluminum oxides ($Al_2O_3$), titanium oxides ($TiO_2$), graphites and mixtures of two or more thereof. Furthermore, one or more additional layers such as coloring layers may be present.

The non-spherical magnetic or magnetizable pigment particles described herein may be surface treated so at to protect them against any deterioration that may occur in the radiation curable coating composition and/or to facilitate their incorporation in the radiation curable coating composition; typically corrosion inhibitor materials and/or wetting agents may be used.

According to one embodiment and provided that the non-spherical magnetic or magnetizable pigment particles are platelet-shaped pigment particles, the process for producing the optical effect layer described herein may further comprise a step of exposing the radiation curable coating composition described herein to a dynamic magnetic field of a first magnetic-field-generating device so as to bi-axially orient at least a part of the platelet-shaped magnetic or magnetizable pigment particles, said step being carried out after step i) and before step ii). Processes comprising such a step of exposing a coating composition to a dynamic magnetic field of a first magnetic-field-generating device so as to bi-axially orient at least a part of the platelet-shaped magnetic or magnetizable pigment particles before a step of further exposing the coating composition to a second magnetic-field-generating device, in particular to the magnetic field of the magnetic assembly described herein, are disclosed in WO 2015/086257 A1. Subsequently to the exposure of the radiation curable coating composition to the dynamic magnetic field of the first magnetic-field-generating device described herein and while the radiation curable coating composition is still wet or soft enough so that the platelet-shaped magnetic or magnetizable pigment particles therein can be further moved and rotated, the platelet-shaped magnetic or magnetizable pigment particles are further re-oriented by the use of the magnetic field of magnetic assembly described herein.

Carrying out a bi-axial orientation means that platelet-shaped magnetic or magnetizable pigment particles are made to orientate in such a way that their two main axes are constrained. That is, each platelet-shaped magnetic or magnetizable pigment particle can be considered to have a major axis in the plane of the pigment particle and an orthogonal minor axis in the plane of the pigment particle. The major and minor axes of the platelet-shaped magnetic or magnetizable pigment particles are each caused to orient according to the dynamic magnetic field. Effectively, this results in neighboring platelet-shaped magnetic pigment particles that are close to each other in space to be essentially parallel to each other. In order to perform a bi-axial orientation, the platelet-shaped magnetic pigment particles must be subjected to a strongly time-dependent external magnetic field. Put another way, bi-axial orientation aligns the planes of the platelet-shaped magnetic or magnetizable pigment particles so that the planes of said pigment particles are oriented to be essentially parallel relative to the planes of neighboring (in all directions) platelet-shaped magnetic or magnetizable pigment particles. In an embodiment, both the major axis and the minor axis perpendicular to the major axis described hereabove of the planes of the platelet-shaped magnetic or magnetizable pigment particles are oriented by the dynamic magnetic field so that neighboring (in all directions) pigment particles have their major and minor axes aligned with each other.

According to one embodiment, the step of carrying out a bi-axial orientation of the platelet-shaped magnetic or magnetizable pigment particles leads to a magnetic orientation wherein the platelet-shaped magnetic or magnetizable pigment particles have their two main axes substantially parallel to the substrate surface. For such an alignment, the platelet-shaped magnetic or magnetizable pigment particles are planarized within the radiation curable coating composition on the substrate and are oriented with both their X-axis and Y-axis (shown in FIG. 1 of WO 2015/086257 A1) parallel with the substrate surface.

According to another embodiment, the step of carrying a bi-axial orientation of the platelet-shaped magnetic or magnetizable pigment particles leads to a magnetic orientation wherein the platelet-shaped magnetic or magnetizable pigment particles have a first axis within the X-Y plane substantially parallel to the substrate surface and a second axis being substantially perpendicular to said first axis at a substantially non-zero elevation angle to the substrate surface.

According to another embodiment, the step of carrying a bi-axial orientation of the platelet-shaped magnetic or magnetizable pigment particles leads to a magnetic orientation wherein the platelet-shaped magnetic or magnetizable pigment particles have their X-Y plane substantially parallel to an imaginary spheroid surface.

Particularly preferred magnetic-field-generating devices for bi-axially orienting the platelet-shaped magnetic or magnetizable pigment particles are disclosed in EP 2 157 141 A1. The magnetic-field-generating device disclosed in EP 2 157 141 A1 provides a dynamic magnetic field that changes its direction forcing the platelet-shaped magnetic or magnetizable pigment particles to rapidly oscillate until both main axes, X-axis and Y-axis, become substantially parallel to the substrate surface, i.e. the platelet-shaped magnetic or magnetizable pigment particles rotate until they come to the stable sheet-like formation with their X and Y axes substantially parallel to the substrate surface and are planarized in said two dimensions.

Other particularly preferred magnetic-field-generating devices for bi-axially orienting the platelet-shaped magnetic or magnetizable pigment particles comprise linear permanent magnet Halbach arrays, i.e. assemblies comprising a plurality of magnets with different magnetization directions. Detailed description of Halbach permanent magnets was given by Z. Q. Zhu et D. Howe (Halbach permanent magnet machines and applications: a review, *IEE. Proc. Electric Power Appl.*, 2001, 148, p. 299-308). The magnetic field produced by such a Halbach array has the properties that it is concentrated on one side while being weakened almost to zero on the other side. The co-pending Application EP 14195159.0 discloses suitable devices for bi-axially orienting platelet-shaped magnetic or magnetizable pigment particles, wherein said devices comprise a Halbach cylinder assembly. Other particularly preferred magnetic-field-generating devices for bi-axially orienting the platelet-shaped magnetic or magnetizable pigment particles are spinning magnets, said magnets comprising disc-shaped spinning magnets or magnet assemblies that are essentially magnetized along their diameter. Suitable spinning magnets or magnet assemblies are described in US 2007/0172261 A1, said spinning magnets or magnet assemblies generate radially symmetrical time-variable magnetic fields, allowing the bi-orientation of platelet-shaped magnetic or magnetizable pigment particles of a not yet hardened coating composition. These magnets or magnet assemblies are driven by a shaft (or spindle) connected to an external motor. CN 102529326 B discloses examples of magnetic-field-generating devices comprising spinning magnets that might be suitable for bi-axially orienting platelet-shaped magnetic or magnetizable pigment particles. In a preferred embodiment, suitable magnetic-field-generating devices for bi-axially orienting platelet-shaped magnetic or magnetizable pigment particles are shaft-free disc-shaped spinning magnets or magnet assemblies constrained in a housing made of non-magnetic, preferably non-conducting, materials and are driven by one or more magnet-wire coils wound around the housing. Examples of such shaft-free disc-shaped spinning magnets or magnet assemblies are disclosed in WO 2015/082344 A1 and in the co-pending Application EP 14181939.1.

The substrate described herein is preferably selected from the group consisting of papers or other fibrous materials, such as cellulose, paper-containing materials, glasses, metals, ceramics, plastics and polymers, metalized plastics or polymers, composite materials and mixtures or combinations thereof. Typical paper, paper-like or other fibrous materials are made from a variety of fibers including without limitation abaca, cotton, linen, wood pulp, and blends thereof. As is well known to those skilled in the art, cotton and cotton/linen blends are preferred for banknotes, while wood pulp is commonly used in non-banknote security documents. Typical examples of plastics and polymers include polyolefins such as polyethylene (PE) and polypropylene (PP), polyamides, polyesters such as poly(ethylene terephthalate) (PET), poly(1,4-butylene terephthalate) (PBT), poly(ethylene 2,6-naphthoate) (PEN) and polyvinylchlorides (PVC). Spunbond olefin fibers such as those sold under the trademark Tyvek® may also be used as substrate. Typical examples of metalized plastics or polymers include the plastic or polymer materials described hereabove having a metal disposed continuously or discontinuously on their surface. Typical example of metals include without limitation aluminum (Al), chromium (Cr), copper (Cu), gold (Au), iron (Fe), nickel (Ni), silver (Ag), combinations thereof or alloys of two or more of the aforementioned metals. The metallization of the plastic or polymer materials described hereabove may be done by an electrodeposition process, a high-vacuum coating process or by a sputtering process. Typical examples of composite materials include without limitation multilayer structures or laminates of paper and at least one plastic or polymer material such as those described hereabove as well as plastic and/or polymer fibers incorporated in a paper-like or fibrous material such as those described hereabove. Of course, the substrate can comprise further additives that are known to the skilled person, such as sizing agents, whiteners, processing aids, reinforcing or wet strengthening agents, etc. The substrate described herein may be provided under the form of a web (e.g. a continuous sheet of the materials described hereabove) or under the form of sheets. Should the OEL produced according to the present invention be on a security document, and with the aim of further increasing the security level and the resistance against counterfeiting and illegal reproduction of said security document, the substrate may comprise printed, coated, or laser-marked or laser-perforated indicia, watermarks, security threads, fibers, planchettes, luminescent compounds, windows, foils, decals and combinations of two or more thereof. With the same aim of further increasing the security level and the resistance against counterfeiting and illegal reproduction of security documents, the substrate may comprise one or more marker substances or taggants and/or machine readable substances (e.g. luminescent substances, UV/visible/IR absorbing substances, magnetic substances and combinations thereof).

Also described herein are apparatuses for producing an OEL such as those described herein on the substrate described herein, said OEL comprising the non-spherical magnetic or magnetizable pigment particles being oriented in the cured radiation curable coating composition such as described herein.

The apparatus described herein for producing the OEL on a substrate such as those described herein comprises:

a) a magnetic assembly (130, 230, 330, 430, 530, 630, 730, 830, 930, 1030, 1130, 1230) comprising a supporting matrix (134, 234, 334, 434, 534, 634, 734, 834, 934, 1034, 1134, 1234), and a1) a magnetic-field generating device (131, 231, 331, 431, 531, 631, 731, 831, 931, 1031, 1131, 1231) forming a loop-shaped form (hereafter referred as loop-shaped magnetic-field generating device), being either a single loop-shaped dipole magnet having a magnetic axis substantially perpendicular to the substrate (120, 220, 320, 420, 520, 620, 720, 820, 920, 1020, 1120, 1220) surface or a combination of two or more dipole magnets disposed in a loop-shaped arrangement, each of the two or more dipole magnets having a magnetic axis substantially perpendicular to the substrate (120, 220, 320, 420, 520, 620, 720, 820, 920, 1020, 1120, 1220) surface and having a same magnetic field direction, and a2) a single dipole magnet (132, 232, 332, 432, 532, 632, 732, 832, 932, 1032, 1132, 1232) having a magnetic axis substantially perpendicular to the substrate (120, 220, 320, 420, 520, 620, 720, 820, 920, 1020, 1120, 1220) surface or two or more dipole magnets (132, 232, 332, 432, 532, 632, 732, 832, 932, 1032, 1132, 1232), each of the two or more dipole magnets having a magnetic axis substantially perpendicular to the substrate (120, 220, 320, 420, 520, 620, 720, 820, 920, 1020, 1120, 1220) surface and having a same magnetic field direction and/or one or more pole pieces (533, 633, 733, 833, 933, 1033, 1133, 1233), and b) a magnetic-field generating device (140, 240, 340, 440, 540, 640, 740, 840, 940, 1040, 1140, 1240) being either a single bar dipole magnet having a magnetic axis substantially parallel to the substrate (120, 220, 320, 420, 520, 620, 720, 820, 920, 1020, 1120, 1220) surface or a combination of two or more bar dipole magnets (141, 241, 341, 441, 541, 641, 741, 841, 941, 1041, 1141,1241), each of the two or more bar dipole magnets (141, 241, 341, 441, 541, 641, 741, 841, 941, 1041, 1141, 1241) having a magnetic axis substantially parallel to the substrate (120, 220, 320, 420, 520, 620, 720, 820, 920, 1020, 1120, 1220) surface and having a same magnetic field direction.

The magnetic assembly (130, 230, 330, 430, 530, 630, 730, 830, 930, 1030, 1130, 1230) and the magnetic-field generating device (140, 240, 340, 440, 540, 640, 740, 840, 940, 1040, 1140, 1240) may be arranged one on top of the other.

The supporting matrix is made of a non-magnetic material. The non-magnetic materials are preferably selected from the group consisting of low conducting materials, non-conducting materials and mixtures thereof, such as for example engineering plastics and polymers, aluminum, aluminum alloys, titanium, titanium alloys and austenitic steels (i.e. non-magnetic steels). Engineering plastics and polymers include without limitation polyaryletherketones (PAEK) and its derivatives polyetheretherketones (PEEK), poletherketoneketones (PEKK), polyetheretherketoneketones (PEEKK) and polyetherketoneetherketoneketone (PEKEKK); polyacetals, polyamides, polyesters, polyethers, copolyetheresters, polyimides, polyetherimides, high-density polyethylene (HDPE), ultra-high molecular weight polyethylene (UHMWPE), polybutylene terephthalate (PBT), polypropylene, acrylonitrile butadiene styrene (ABS) copolymer, fluorinated and perfluorinated polyethylenes, polystyrenes, polycarbonates, polyphenylenesulfide (PPS) and liquid crystal polymers. Preferred materials are PEEK (polyetheretherketone), POM (polyoxymethylene), PTFE (polytetrafluoroethylene), Nylon® (polyamide) and PPS.

The magnetic assemblies (130, 230, 330, 430, 530, 630, 730, 830, 930, 1030, 1130, 1230) described herein comprise a loop-shaped magnetic-field generating device (131, 231, 331, 431, 531, 631, 731, 831, 931, 1031, 1131, 1231) which i) may be made of a single loop-shaped dipole magnet having a magnetic axis substantially perpendicular to the substrate (120, 220, 320, 420, 520, 620, 720, 820, 920, 1020, 1120, 1220) surface, or ii) may be a combination of two or more dipole magnets disposed in a loop-shaped arrangement, each of the two or more dipole magnets having a magnetic axis substantially perpendicular to the substrate (120, 220, 320, 420, 520, 620, 720, 820, 920, 1020, 1120, 1220) surface and having a same magnetic field direction.

Typical examples of combinations of two or more dipole magnets disposed in a loop-shaped arrangement include without limitation a combination of three dipole magnets disposed in a triangular loop-shaped arrangement or a combination of four dipole magnets disposed in a square or rectangular loop-shaped arrangement.

The a loop-shaped magnetic-field generating device (131, 231, 331, 431, 531, 631, 731, 831, 931, 1031, 1131, 1231) may be disposed symmetrically within the supporting matrix (134, 234, 334, 434, 534, 634, 734, 834, 934, 1034, 1134, 1234) or may be disposed non-symmetrically within the supporting matrix (134, 234, 334, 434, 534, 634, 734, 834, 934, 1034, 1134, 1234).

The loop-shaped dipole magnets and the two or more dipole magnets (131, 231, 331, 431, 531, 631, 731, 831, 931, 1031, 1131, 1231) disposed in a loop-shaped arrangement and comprised in the magnetic assemblies (130, 230, 330, 430, 530, 630, 730, 830, 930, 1030, 1130, 1230) are preferably independently made of materials selected from the group comprising Alnico alloys, such as for example Alnico 5 (R1-1-1), Alnico 5 DG (R1-1-2), Alnico 5-7 (R1-1-3), Alnico 6 (R1-1-4), Alnico 8 (R1-1-5), Alnico 8 HC (R1-1-7) and Alnico 9 (R1-1-6); ferrites such as for example strontium hexaferrite ($SrFe_{12}O_{19}$), barium hexaferrite, cobalt alloys, ceramic 5 (SI-1-6), ceramic 7 (SI-1-2), ceramic 8 (SI-1-5), or rare-earth-iron alloys such as $RECo_5$ (with RE=Sm or Pr), $RE_2TM_{17}$ (with RE=Sm, TM=Fe, Cu, Co, Zr , Hf), $RE_2TM_{14}B$ (with RE=Nd, Pr, Dy, TM =Fe, Co); anisotropic alloys of Fe Cr Co; materials selected from the group of PtCo, MnAlC, RE Cobalt 5/16, RE Cobalt 14. Particularly preferred are easily workable permanent-magnetic composite materials that comprise a permanent-magnetic filler, such as strontium-hexaferrite ($SrFe_{12}O_{19}$) or neodymium-iron-boron ($Nd_2Fe_{14}B$) powder, in a plastic- or rubber-type matrix.

According to one embodiment, the magnetic assembly (130, 230, 330, 430, 530, 630, 730, 830, 930, 1030, 1130, 1230) described herein comprises a single dipole magnet (132, 232, 332, 432, 532, 632, 732, 832, 932, 1032, 1132, 1232) or two or more dipole magnets (132, 232, 332, 432, 532, 632, 732, 832, 932, 1032, 1132, 1232) such as those described herein. The single dipole magnet or two or more dipole magnets (132, 232, 332, 432, 532, 632, 732, 832, 932, 1032, 1132, 1232) are disposed within the loop-shaped dipole magnet (131, 231, 331, 431, 531, 631, 731, 831, 931, 1031, 1131, 1231) or within the combination of dipole magnets disposed in a loop-shaped form. The single dipole (132, 232, 332, 432, 532, 632, 732, 832, 932, 1032, 1132, 1232) or two or more dipole magnets (132, 232, 332, 432, 532, 632, 732, 832, 932, 1032, 1132, 1232) may be disposed symmetrically within the loop of the loop-shaped magnetic-field generating device (131, 231, 331, 431, 531, 631, 731, 831, 931, 1031, 1131, 1231) (as shown in FIGS. 1, 2, 5, 7 and 8) or may be disposed non-symmetrically within the loop of the loop-shaped magnetic-field generating device (131, 231, 331, 431, 531, 631, 731, 831, 931, 1031, 1131, 1231) (as shown in FIGS. 3, 4, 9, 10, 11 and 12).

According to another embodiment, the magnetic assembly (130, 230, 330, 430, 530, 630, 730, 830, 930, 1030, 1130, 1230) described herein comprises one or more pole pieces (533, 633, 733, 833, 933, 1033, 1133, 1233). According to a preferred embodiment, said one or more pole pieces (533, 633, 733, 833, 933, 1033, 1133, 1233) are loop-shaped pole pieces (533, 633, 733, 833, 933, 1033, 1133, 1233). Preferably, the one or more pole pieces (533, 633, 733, 833, 933, 1033, 1133, 1233), preferably the one or more loop-shaped pole pieces (533, 633, 733, 833, 933, 1033, 1133, 1233), are disposed within the loop-shaped dipole magnet (131, 231, 331, 431, 531, 631, 731, 831, 931, 1031, 1131, 1231) or within the combination of dipole magnets disposed in a loop-shaped form. The one or more pole pieces (533, 633, 733, 833, 933, 1033, 1133, 1233), preferably the one or more loop-shaped pole pieces (533, 633, 733, 833, 933, 1033, 1133, 1233), may be disposed symmetrically within the loop of the loop-shaped magnetic-field generating device (131, 231, 331, 431, 531, 631, 731, 831, 931, 1031, 1131, 1231) (as shown in FIGS. 6-12) or may be disposed non-symmetrically within the loop of the loop-shaped magnetic-field generating device (131, 231, 331, 431, 531, 631, 731, 831, 931, 1031, 1131, 1231).

According to another embodiment, the magnetic assembly (130, 230, 330, 430, 530, 630, 730, 830, 930, 1030, 1130, 1230) described herein comprises a single dipole magnet (132, 232, 332, 432, 532, 632, 732, 832, 932, 1032, 1132, 1232) or two or more dipole magnets (132, 232, 332, 432, 532, 632, 732, 832, 932, 1032, 1132, 1232) such as those described herein and one or more pole pieces (533, 633, 733, 833, 933, 1033, 1133, 1233), preferably the one or more loop-shaped pole pieces (533, 633, 733, 833, 933, 1033, 1133, 1233). The single dipole magnet (132, 232, 332, 432, 532, 632, 732, 832, 932, 1032, 1132, 1232) or two or more dipole magnets (132, 232, 332, 432, 532, 632, 732, 832, 932, 1032, 1132, 1232) and the one or more pole pieces (533, 633, 733, 833, 933, 1033, 1133, 1233), preferably the one or more loop-shaped pole pieces (533, 633, 733, 833, 933, 1033, 1133, 1233), (533, 633, 733, 833, 933, 1033, 1133, 1233) are independently disposed within the loop-shaped dipole magnet (131, 231, 331, 431, 531, 631, 731, 831, 931, 1031, 1131, 1231) or within the combination of dipole magnets disposed in a loop-shaped form. The single dipole magnet (132, 232, 332, 432, 532, 632, 732, 832, 932, 1032, 1132, 1232) or two or more dipole magnets (132, 232, 332, 432, 532, 632, 732, 832, 932, 1032, 1132, 1232) and the one or more pole pieces (533, 633, 733, 833, 933, 1033, 1133, 1233), preferably the one or more loop-shaped pole pieces (533, 633, 733, 833, 933, 1033, 1133, 1233), may be independently disposed symmetrically or non-symmetrically within the loop of the loop-shaped magnetic-field generating device (131, 231, 331, 431, 531, 631, 731, 831, 931, 1031, 1131, 1231).

The single dipole magnets (132, 232, 332, 432, 532, 632, 732, 832, 932, 1032, 1132, 1232) and the two or more dipole magnets (132, 232, 332, 432, 532, 632, 732, 832, 932, 1032, 1132, 1232) are preferably independently made of materials selected from the group comprising Alnico alloy, such as for example Alnico 5 (R1-1-1), Alnico 5 DG (R1-1-2), Alnico 5-7 (R1-1-3), Alnico 6 (R1-1-4), Alnico 8 (R1-1-5), Alnico 8 HC (R1-1-7) and Alnico 9 (R1-1-6); ferrites such as for example strontium hexaferrite ($SrFe_{12}O_{19}$), barium hexaferrite, cobalt alloys, ceramic 5 (SI-1-6), ceramic 7 (SI-1-2), ceramic 8 (SI-1-5), or rare-earth-iron alloys such as $RECo_5$ (with RE=Sm or Pr), $RE_2TM_{17}$ (with RE=Sm, TM=Fe, Cu, Co, Zr , Hf), $RE_2TM_{14}B$ (with RE=Nd, Pr, Dy, TM=Fe, Co); anisotropic alloys of Fe Cr Co; materials selected from the group of PtCo, MnAlC, RE Cobalt 5/16, RE Cobalt 14. Particularly preferred are easily workable permanent-magnetic composite materials that comprise a permanent-magnetic filler, such as strontium-hexaferrite ($SrFe_{12}O_{19}$) or neodymium-iron-boron ($Nd_2Fe_{14}B$) powder, in a plastic- or rubber-type matrix.

A pole piece denotes a structure composed of a material having high magnetic permeability, preferably a permeability between about 2 and about 1000000 $N \cdot A^{-2}$ (Newton per square Ampere), more preferably between about 5 and about 50000 $N \cdot A^{-2}$ and still more preferably between about 10 and about 10000 $N \cdot A^{-2}$. The pole piece serves to direct the magnetic field produced by a magnet. Preferably, the one or more pole pieces (533, 633, 733, 833, 933, 1033, 1133, 1233) described herein comprises or consists of an iron yoke (Y).

The supporting matrix (134, 234, 334, 434, 534, 634, 734, 834, 934, 1034, 1134, 1234) comprises one or more indentations or grooves for receiving the loop-shaped magnetic-field generating device (131, 231, 331, 431, 531, 631, 731, 831, 931, 1031, 1131, 1231) or the two or more dipole magnets (132, 232, 332, 432, 532, 632, 732, 832, 932, 1032, 1132, 1232) such as those described herein and/or the one or more pole pieces (533, 633, 733, 833, 933, 1033, 1133, 1233), preferably the one or more loop-shaped pole pieces.

The apparatuses described herein for producing an OEL on a substrate such as those described herein comprises the magnetic-field generating device (140, 240, 340, 440, 540, 640, 740, 840, 940, 1040, 1140, 1240) described herein, said magnetic-field generating device (140, 240, 340, 440, 540, 640, 740, 840, 940, 1040, 1140, 1240)

i) may be made of a single bar dipole magnet having a magnetic axis substantially parallel to the substrate (120, 220, 320, 420, 520, 620, 720, 820, 920, 1020, 1120, 1220) surface, or ii) may be a combination of two or more bar dipole magnets (141, 241, 341, 441, 541, 641, 741, 841, 941, 1041, 1141, 1241), each of the two or more bar dipole magnets (141, 241, 341, 441, 541, 641, 741, 841, 941, 1041, 1141, 1241) having a magnetic axis substantially parallel to the substrate (120, 220, 320, 420, 520, 620, 720, 820, 920, 1020, 1120, 1220) surface and having a same magnetic field direction, i.e. all of them have their North pole facing the same direction.

According to one embodiment, the magnetic-field generating device (140, 240, 340, 440, 540, 640, 740, 840, 940, 1040, 1140, 1240) is made of a single a bar.

According to another embodiment, the magnetic-field generating device (140, 240, 340, 440, 540, 640, 740, 840, 940, 1040, 1140, 1240) is a combination of two or more bar dipole magnets (141, 241, 341, 441, 541, 641, 741, 841, 941, 1041, 1141, 1241), each of the two or more bar dipole magnets (141, 241, 341, 441, 541, 641, 741, 841, 941, 1041, 1141, 1241) having a magnetic axis substantially parallel to the substrate (120, 220, 320, 420, 520, 620, 720, 820, 920, 1020, 1120, 1220) surface and having a same magnetic field direction, i.e. all of them have their North pole facing the same direction. The two or more bar dipole magnets (141, 241, 341, 441, 541, 641, 741, 841, 941, 1041, 1141, 1241) may be arranged in a symmetric configuration (as shown in FIGS. 3, 8, 10 and 11) or in an non-symmetric configuration (as shown in FIGS. 4, 5, 6 and 12).

The bar dipole magnets of the magnetic-field generating device (140, 240, 340, 440, 540, 640, 740, 840, 940, 1040, 1140, 1240) are preferably made of materials independently selected from the group comprising Alnico alloy, such as for example Alnico 5 (R1-1-1), Alnico 5 DG (R1-1-2), Alnico 5-7 (R1-1-3), Alnico 6 (R1-1-4), Alnico 8 (R1-1-5), Alnico 8 HC (R1-1-7) and Alnico 9 (R1-1-6); ferrites such as for example strontium hexaferrite ($SrFe_{12}O_{19}$), barium hexaferrite, cobalt alloys, ceramic 5 (SI-1-6), ceramic 7 (SI-1-2), ceramic 8 (SI-1-5), or rare-earth-iron alloys such as $RECo_5$ (with RE=Sm or Pr), $RE_2TM_{17}$ (with RE=Sm, TM=Fe, Cu, Co, Zr , Hf), $RE_2TM_{14}B$ (with RE=Nd, Pr, Dy, TM=Fe, Co); anisotropic alloys of Fe Cr Co; materials selected from the group of PtCo, MnAlC, RE Cobalt 5/16, RE Cobalt 14. Particularly preferred are, however, easily workable permanent-magnetic composite materials that comprise a permanent-magnetic filler, such as strontium-hexaferrite ($SrFe_{12}O_{19}$) or neodymium-iron-boron ($Nd_2Fe_{14}B$) powder, in a plastic- or rubber-type matrix.

When the magnetic-field generating device (140, 240, 340, 440, 540, 640, 740, 840, 940, 1040, 1140, 1240) is a combination of two or more bar dipole magnets (141, 241, 341, 441, 541, 641, 741, 841, 941, 1041, 1141, 1241), said two or more bar dipole magnets (141, 241, 341, 441, 541, 641, 741, 841, 941, 1041, 1141, 1241) may be separated by one or more spacer pieces (x42) made of a non-magnetic material or may be comprised in a supporting matrix made of a non-magnetic material. The non-magnetic materials are preferably selected from the group consisting of low conducting materials, non-conducting materials and mixtures thereof, such as for example engineering plastics and polymers, aluminum, aluminum alloys, titanium, titanium alloys and austenitic steels (i.e. non-magnetic steels). Engineering plastics and polymers include without limitation polyaryletherketones (PAEK) and its derivatives polyetheretherketones (PEEK), poletherketoneketones (PEKK), polyetheretherketoneketones (PEEKK) and polyetherketoneetherketoneketone (PEKEKK); polyacetals, polyamides, polyesters, polyethers, copolyetheresters, polyimides, polyetherimides, high-density polyethylene (HDPE), ultra-high molecular weight polyethylene (UHMWPE), polybutylene terephthalate (PBT), polypropylene, acrylonitrile butadiene styrene (ABS) copolymer, fluorinated and perfluorinated polyethylenes, polystyrenes, polycarbonates, polyphenylenesulfide (PPS) and liquid crystal polymers. Preferred materials are PEEK (polyetheretherketone), POM (polyoxymethylene), PTFE (polytetrafluoroethylene), Nylon® (polyamide) and PPS. The magnetic assembly (130, 230, 330, 430, 530, 630, 730, 830, 930, 1030, 1130, 1230) may located between the magnetic-field generating device (140, 240, 340, 440, 540, 640, 740, 840, 940, 1040, 1140, 1240) and the substrate (120, 220, 320, 420, 520, 620, 720, 820, 920, 1020, 1120, 1220) carrying the radiation curable coating composition (110, 210, 310, 410, 510, 610, 710, 810, 910, 1010, 1110, 1210) comprising the non-spherical magnetic or magnetizable pigment particles described herein to be oriented by the apparatus described herein, or alternatively the magnetic-field generating device (140, 240, 340, 440, 540, 640, 740, 840, 940, 1040, 1140, 1240) may be located between the magnetic assembly (130, 230, 330, 430, 530, 630, 730, 830, 930, 1030, 1130, 1230) and the substrate (120, 220, 320, 420, 520, 620, 720, 820, 920, 1020, 1120, 1220).

The distance (d) between the magnetic assembly (130, 230, 330, 430, 530, 630, 730, 830, 930, 1030, 1130, 1230) and the magnetic-field generating device (140, 240, 340, 440, 540, 640, 740, 840, 940, 1040, 1140, 1240) may be comprised in the range comprised between about 0 and about 10 mm, preferably between about 0 and about 3 mm so as to have a more compact magnetic assembly.

The distance (h) between the upper surface of magnetic (130, 230, 330, 430, 530, 630, 730, 830, 930, 1030, 1130, 1230) or the upper surface of magnetic-field generating device (140, 240, 340, 440, 540, 640, 740, 840, 940, 1040, 1140, 1240), (i.e. the part that is the closest to the substrate (120, 220, 320, 420, 520, 620, 720, 820, 920, 1020, 1120, 1220 surface), and the surface of the substrate (120, 220, 320, 420, 520, 620, 720, 820, 920, 1020, 1120, 1220) facing said magnetic assembly (130, 230, 330, 430, 530, 630, 730, 830, 930, 1030, 1130, 1230) or said magnetic-field generating device (140, 240, 340, 440, 540, 640, 740, 840, 940, 1040, 1140, 1240) is preferably between about 0.1 and about 10 mm and more preferably between about 0.2 and about 5 mm.

The materials of the loop-shaped magnetic-field generating device (131, 231, 331, 431, 531, 631, 731, 831, 931, 1031, 1131, 1231), the materials of the dipole magnets (132, 232, 332, 432, 532, 632, 732, 832, 932, 1032, 1132, 1232), the materials of the one or more pole pieces (533, 633, 733, 833, 933, 1033, 1133, 1233), the materials of the magnetic-field generating device (140, 240, 340, 440, 540, 640, 740, 840, 940, 1040, 1140, 1240), the materials of the two or more bar dipole magnets (141, 241, 341, 441, 541, 641, 741, 841, 941, 1041, 1141, 1241), and the distances (d) and (h) are selected such that the magnetic field resulting from the interaction of the magnetic field produced by the magnet assembly (130, 230, 330, 430, 530, 630, 730, 830, 930, 1030, 1130, 1230) and the magnetic field produced by the magnetic-field generating device (140, 240, 340, 440, 540, 640, 740, 840, 940, 1040, 1140, 1240), i.e. the resulting magnetic field of the apparatuses described herein, is suitable for producing the optical effects layers described herein. The magnetic field produced by the magnetic assembly (130, 230, 330, 430, 530, 630, 730, 830, 930, 1030, 1130, 1230) and the magnetic field produced by the magnetic-field generating device (140, 240, 340, 440, 540, 640, 740, 840, 940, 1040, 1140, 1240) may interact so that the resulting magnetic field of the apparatus is able to orient non-spherical magnetic or magnetizable pigment particles in an as yet uncured radiation curable coating composition on the substrate, which are disposed in the magnetic field of the apparatus to produce an optical impression of the optical effect layer of one or more loop-shaped bodies having a size that varies upon tilting the optical effect layer.

The apparatuses for producing an OEL described herein may further comprise an engraved magnetic plate, such as those disclosed for example in WO 2005/002866 A1 and WO 2008/046702 A1. The engraved magnetic plate is located between the magnetic assembly (130, 230, 330, 430, 530, 630, 730, 830, 930, 1030, 1130, 1230) or the magnetic-field generating device (140, 240, 340, 440, 540, 640, 740, 840, 940, 1040, 1140, 1240) and the substrate surface, so as to locally modify the magnetic field of the apparatus. Such an engraved plate may be made from iron (iron yokes). Alternatively, such an engraved plate may be made from a plastic material such as those described herein in which magnetic particles are dispersed (such as for example Plastoferrite).

FIG. 1-5 illustrate examples of apparatuses suitable for producing optical effect layers (OELs) (110, 210, 310, 410, 510) comprising non-spherical magnetic or magnetizable pigment particles on a substrate (120, 220, 320, 420, 520) according to the present invention, wherein said apparatuses comprises a magnetic assembly (130, 230, 330, 430, 530) comprising the supporting matrix (134, 234, 334, 434, 534) described herein, a1) the loop-shaped magnetic-field generating device (131, 231, 331, 431, 531) described herein, and a2) the single dipole magnet (132, 232, 332, 432, 532) or the two or more dipole magnets (132, 232, 332, 432, 532) described herein.

According to one embodiment and as shown for example in FIG. 1, the magnetic assemblies (130) comprises the supporting matrix (134) described herein, a1) the loop-shaped magnetic-field generating device (131) described herein, and a2) the dipole magnet (132) described herein, wherein both the loop-shaped magnetic-field generating device (131) and the dipole magnet (132) have a magnetic axis substantially perpendicular to the substrate surface and wherein the loop-shaped magnetic-field generating device (131) and the dipole magnet (132) have an opposite magnetic field direction.

According to another embodiment and as shown for example in FIGS. 2 and 3, the magnetic assemblies (230, 330) comprises a supporting matrix (234, 334), a1) the loop-shaped magnetic-field generating device (231, 331) described herein, and a2) the dipole magnet (232, 332) described herein, wherein both the loop-shaped magnetic-field generating device (231, 331) and the dipole magnet (232, 332) have a magnetic axis substantially perpendicular to the substrate surface and wherein both the loop-shaped magnetic-field generating device (231, 331) and the dipole magnet (232, 332) have the same magnetic field direction.

FIG. 1A-B illustrate an example of an apparatus suitable for producing optical effect layers (OELs) (110) comprising non-spherical magnetic or magnetizable pigment particles on a substrate (120) according to the present invention. The apparatus of FIG. 1A comprises a magnetic-field generating device (140) being a bar dipole magnet, said bar dipole magnet being disposed below a magnetic assembly (130). The magnetic-field generating device (140) may be a parallelepiped having a width (L1), a length (L2) and a thickness (L3) as shown in FIG. 1A. The magnetic axis of the magnetic-field generating device (140) is substantially parallel to the substrate (120) surface.

The magnetic assembly (130) of FIG. 1A comprises a supporting matrix (134) which may be of a parallelepiped having a length (L4), a width (L5) and a thickness (L6) as shown in FIG. 1A.

The magnetic assembly (130) of FIG. 1A comprises a loop-shaped magnetic-field generating device (131) being a ring-shaped dipole magnet and a dipole magnet (132) as shown in FIG. 1A-B. As shown in FIGS. 1A and 1B1, the dipole magnet (132) may be disposed symmetrically within the loop of the loop-shaped magnetic-field generating device (131).

The loop-shaped magnetic-field generating device being a ring-shaped dipole magnet (131) has an external diameter (L7), an internal diameter (L8) and a thickness (L10). The magnetic axis of the loop-shaped magnetic-field generating device (131) is substantially perpendicular to the magnetic axis of the magnetic-field generating device (140), i.e. substantially perpendicular to the substrate (120) surface with the North pole facing the substrate (120).

The dipole magnet (132) has a diameter (L9). The magnetic axis of the dipole magnet (132) is substantially perpendicular to the magnetic axis of the magnetic-field generating device (140), i.e. substantially perpendicular to the substrate (120) surface with the South pole facing the substrate (120).

The magnetic assembly (130) and the magnetic-field generating device (140) being a bar dipole magnet are preferably in direct contact, i.e. the distance (d) between the lower surface of the magnetic assembly (130) and the upper surface of the bar dipole magnet (140) is about 0 mm (not shown true to scale in FIG. 1A for the clarity of the drawing). The distance between the upper surface of the magnetic assembly (130) and the surface of the substrate (120) facing said magnetic assembly (130) is illustrated by the distance (h). Preferably, the distance (h) is between about 0.1 and about 10 mm and more preferably between about 0.2 and about 5 mm.

The resulting OEL produced by the apparatus illustrated in FIG. 1A-B is shown in FIG. 1C as seen under different viewing angles by tilting the substrate (120) between −30° and +20°. The so-obtained OEL provides an optical impression of a ring-shaped body having a size that varies upon tilting the substrate comprising the optical effect layer.

Figure 2A:
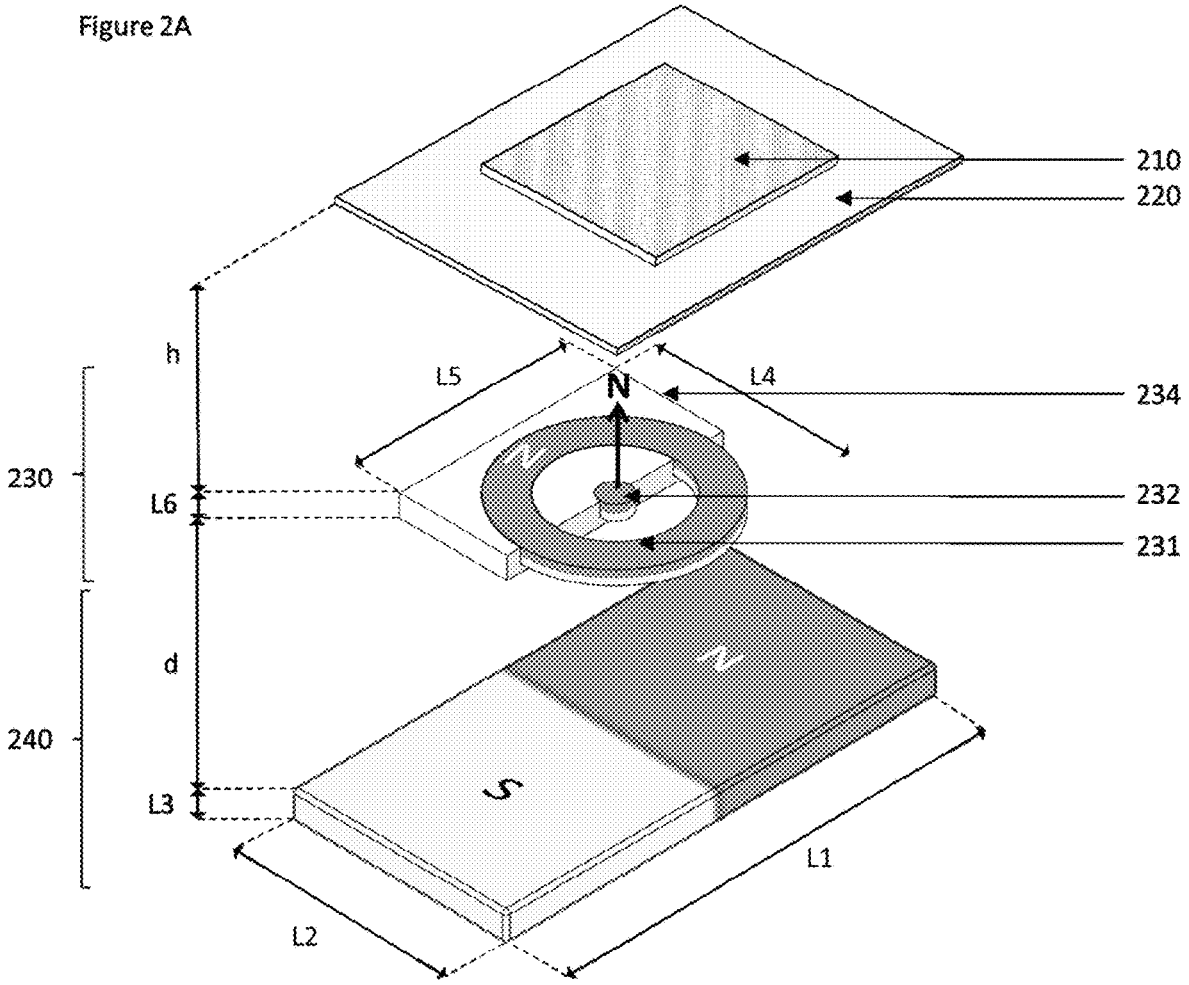
FIG. 2A schematically illustrate an apparatus comprising a) a magnetic assembly (230), said magnetic assembly comprising a supporting matrix (234), a loop-shaped magnetic-field generating device (231), in particular a ring-shaped dipole magnet, and a dipole magnet (232); and b) a magnetic-field generating device (240). Said apparatus is suitable for producing an optical effect layer (210) on a substrate (220).

FIG. 2A-B illustrate an example of an apparatus suitable for producing optical effect layers (OELs) (210) comprising non-spherical magnetic or magnetizable pigment particles on a substrate (220) according to the present invention. The apparatus of FIG. 2A comprises a magnetic-field generating device (240) being a bar dipole magnet, said bar dipole magnet being disposed below a magnetic assembly (230). The magnetic-field generating device (240) may be a parallelepiped having a length (L1), a width (L2) and a thickness (L3) as shown in FIG. 2A. The magnetic axis of the magnetic-field generating device (240) is substantially parallel to the substrate (220) surface.

The magnetic assembly (230) comprises a supporting matrix (234) which may be a parallelepiped having a length (L4), a width (L5) and a thickness (L6) as shown in FIG. 2A.

The magnetic assembly (230) of FIG. 2A comprises a loop-shaped magnetic-field generating device being a ring-shaped dipole magnet (231) and a dipole magnet (232) as shown in FIG. 2A-B. As shown in FIGS. 2A and 2B1, the dipole magnet (232) may be disposed symmetrically within the loop of the loop-shaped magnetic-field generating device (231).

The loop-shaped magnetic-field generating device being a ring-shaped dipole magnet (231) has an external diameter (L7), an internal diameter (L8) and a thickness (L10). The magnetic axis of the loop-shaped magnetic-field generating device (231) is substantially perpendicular to the magnetic axis of the magnetic-field generating device (240), i.e. substantially perpendicular to the substrate (220) surface with the North pole facing the substrate (120).

The dipole magnet (232) has a diameter (L9). The magnetic axis of the dipole magnet (232) is substantially perpendicular to the magnetic axis of the magnetic-field generating device (240), i.e. substantially perpendicular to the substrate (220) surface with the North pole facing the substrate (220).

The magnetic assembly (230) and the magnetic-field generating device being a bar dipole magnet (240) are preferably in direct contact, i.e. the distance (d) between the lower surface of the magnetic assembly (230) and the upper surface of the bar dipole magnet (240) is about 0 mm (not shown true to scale in FIG. 2A for the clarity of the drawing). The distance between the upper surface of the magnetic assembly (230) and the surface of the substrate (220) facing said supporting matrix is illustrated by the distance (h). Preferably, the distance (h) is between about 0.1 and about 10 mm and more preferably between about 0.2 and about 5 mm.

The resulting OEL produced by the apparatus illustrated in FIG. 2A-B is shown in FIG. 2C as seen under different viewing angles by tilting the substrate (220) between −20° and +30°. The so-obtained OEL provides an optical impression of two nested loop-shaped bodies surrounding one central area, i.e. two ring-shaped bodies wherein both loop-shaped bodies have a size that varies upon tilting the substrate comprising the optical effect layer.

Figure 3A:
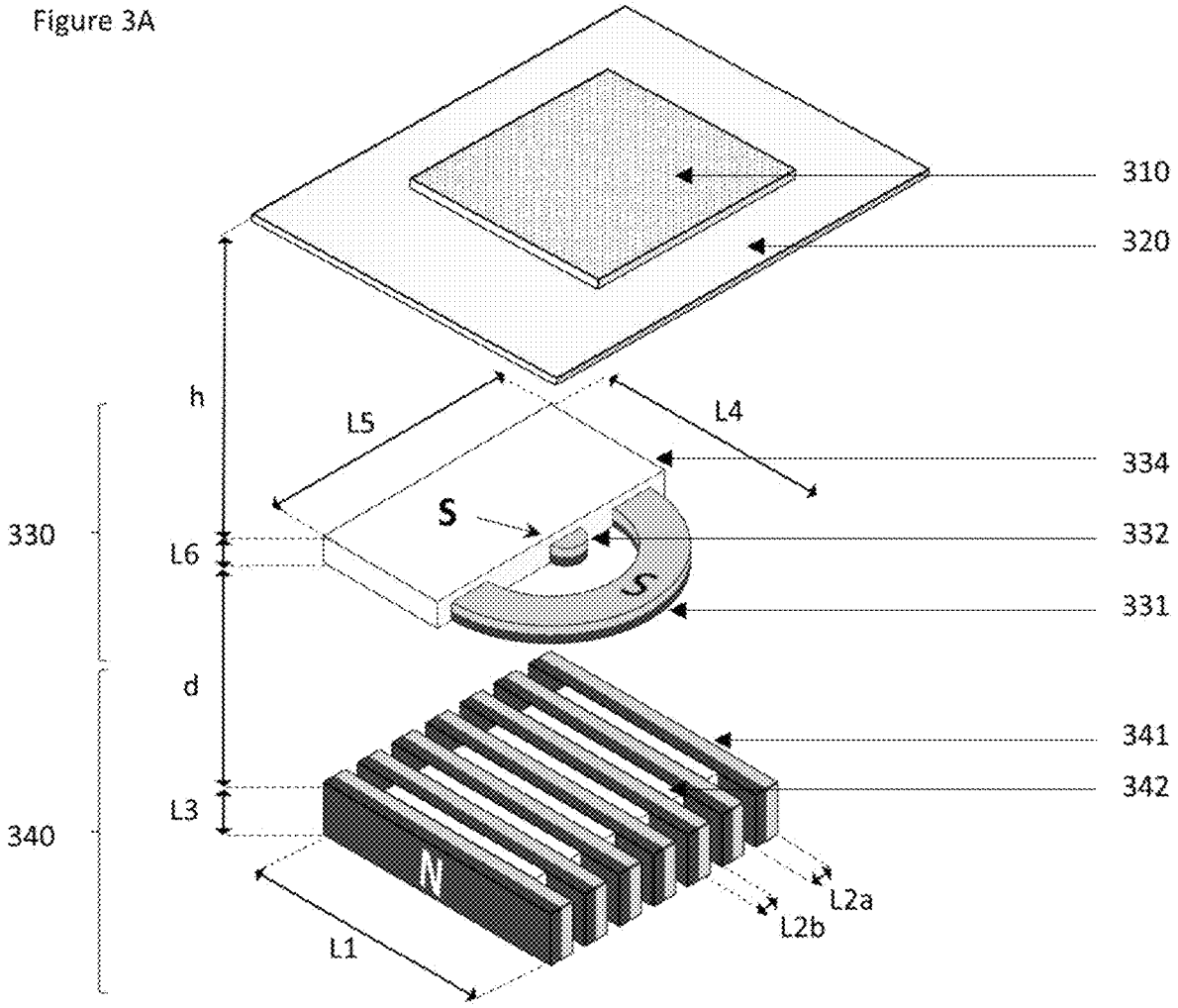
FIG. 3A schematically illustrate an apparatus comprising a) a magnetic assembly (330), said magnetic assembly comprising a supporting matrix (334), a loop-shaped magnetic-field generating device (331), in particular a ring-shaped dipole magnet, and a dipole magnet (332); and b) a magnetic-field generating device (240). Said apparatus is suitable for producing an optical effect layer (310) on a substrate (320).

FIG. 3A-B illustrate an example of an apparatus suitable for producing optical effect layers (OELs) (310) comprising non-spherical magnetic or magnetizable pigment particles on a substrate (320) according to the present invention. The apparatus of FIG. 3A comprises a magnetic-field generating device (340) being a combination of two or more bar dipole magnets (341), said magnetic-field generating device (340) being disposed below a magnetic assembly (330), wherein each of the two or more bar dipole magnets (341) has a magnetic axis substantially parallel to the substrate (320) surface and their North pole facing the same direction.

Figure 4A:
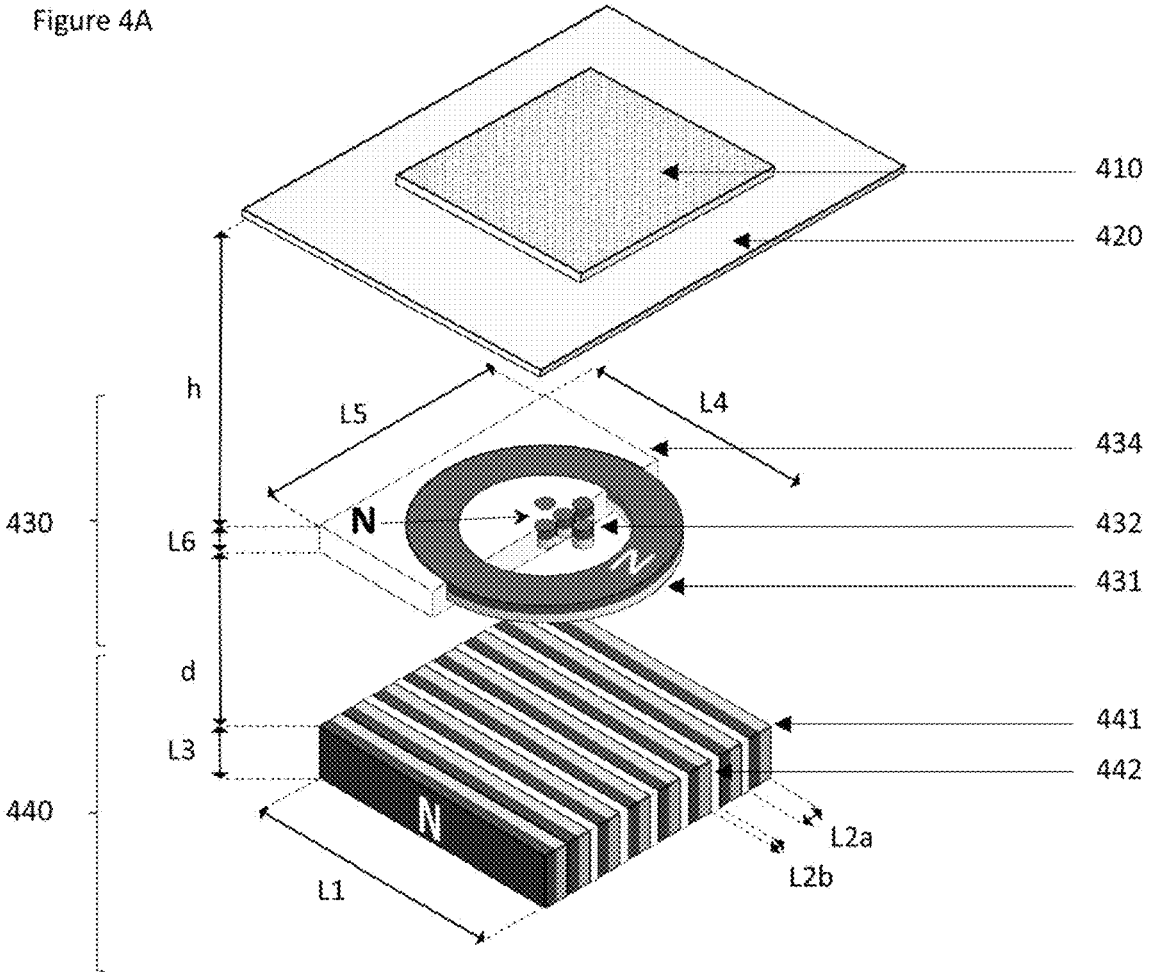
FIG. 4A schematically illustrate an apparatus comprising a) a magnetic assembly (430), said magnetic assembly comprising a supporting matrix (434), a loop-shaped magnetic-field generating device (431), in particular a ring-shaped dipole magnet, and five dipole magnets (432); and b) a magnetic-field generating device (440). Said apparatus is suitable for producing an optical effect layer (410) on a substrate (420).
Figure 4A:
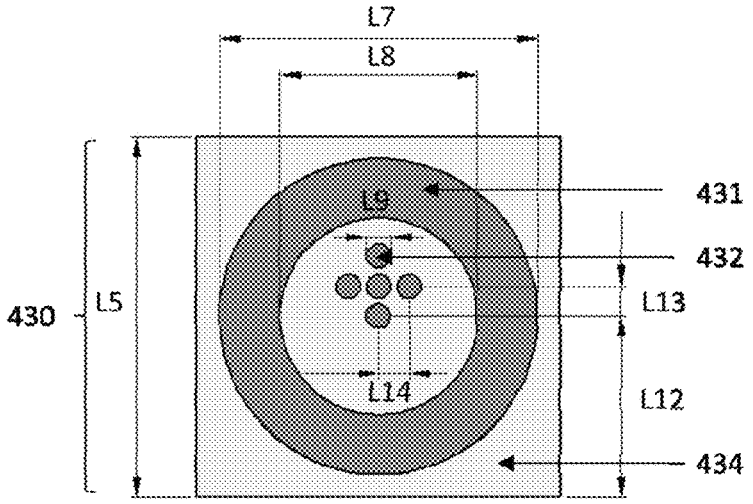
Figure 4A:
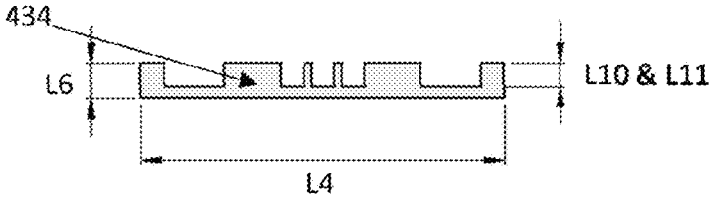
Figure 5A:
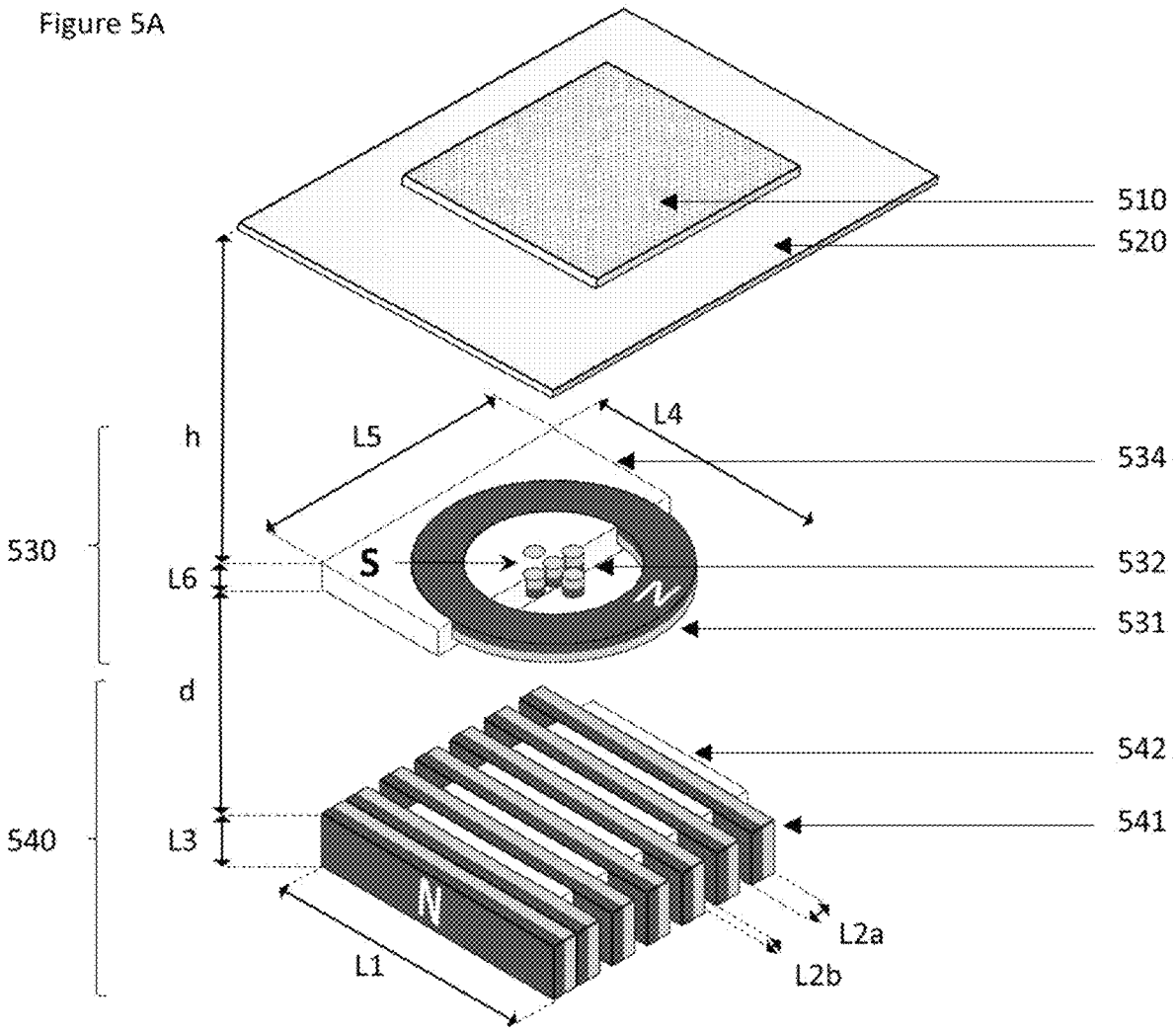
FIG. 5A schematically illustrate an apparatus comprising a) a magnetic assembly (530), said magnetic assembly comprising a supporting matrix (534), a loop-shaped magnetic-field generating device (531), in particular a ring-shaped dipole magnet, and five dipole magnets (532); and b) a magnetic-field generating device (540) comprising seven dipole magnets (541) and six spacers (542). Said apparatus is suitable for producing an optical effect layer (510) on a substrate (520).

The magnetic-field generating device (340) is a combination of two or more bar dipole magnets (341), seven magnets in FIG. 3A, and of one or more spacer pieces (342), six spacer pieces in FIG. 3A, independently made of a non-magnetic material such as those described herein for the supporting matrix. The one or more spacer pieces (342) are disposed between the two or more bar dipole magnets (341). The arrangement of the bar dipole magnets and the spacer pieces may be symmetrical (as illustrated in FIG. 3A) or non-symmetrical (as illustrated in FIGS. 4A and 5A).

Each of the two or more, in particular seven, bar dipole magnets (341) may be a parallelepiped having a length (L1), a width (L2*a*) and a thickness (L3) as shown in FIG. 3A. Each of the spacer pieces (342) may be a parallelepiped having a width (L2*b*) and a thickness (L3).

The magnetic assembly (330) comprises a supporting matrix (334) which may be a parallelepiped having a length (L4), a width (L5) and a thickness (L6) as shown in FIG. 3A.

The magnetic assembly (330) of FIG. 3A comprises a loop-shaped magnetic-field generating device being a ring-shaped dipole magnet (331) and a dipole magnet (332) as shown in FIG. 3A-B. As shown in FIGS. 3A and 3B1, the dipole magnet (332) may be disposed non-symmetrically within the loop of the loop-shaped magnetic-field generating device (331).

The loop-shaped magnetic-field generating device being a ring-shaped dipole magnet (331) has an external diameter (L7), an internal diameter (L8) and a thickness (L10). The magnetic axis of the loop-shaped magnetic-field generating device (331) is substantially perpendicular to the magnetic axis of the magnetic-field generating device (340), i.e. substantially perpendicular to the substrate (320) surface with the South pole facing the substrate (320).

The dipole magnet (332) has a diameter (L9). The magnetic axis of the dipole magnet (332) is substantially perpendicular to the magnetic axis of the magnetic-field generating device (340), i.e. substantially perpendicular to the substrate (320) surface with the South pole facing the substrate (320).

The magnetic assembly (330) and the magnetic-field generating device (340) are preferably in direct contact, i.e. the distance (d) between the lower surface of the magnetic assembly (330) and the upper surface of the bar dipole magnet (340) is about 0 mm (not shown true to scale in FIG. 3A for the clarity of the drawing). The distance between the upper surface of the supporting matrix (334) and the surface of the substrate (320) facing said supporting matrix (334) is illustrated by the distance h. Preferably, the distance h is between about 0.1 and about 10 mm and more preferably between about 0.2 and about 5 mm.

The resulting OEL produced by the apparatus illustrated in FIG. 3A-B is shown in FIG. 3C as seen under different viewing angles by tilting the substrate (320) between −20° and +30°. The so-obtained OEL provides an optical impression of two nested loop-shaped bodies surrounding one central area, i.e. two ring-shaped bodies wherein both loop-shaped bodies have a size that varies upon tilting the substrate comprising the optical effect layer.

FIG. 4A-B illustrate an example of an apparatus suitable for producing optical effect layers (OELs) (410) comprising non-spherical magnetic or magnetizable pigment particles on a substrate (420) according to the present invention. The apparatus of FIG. 4A comprises a magnetic-field generating device (440) being a combination of two or more bar dipole magnets (441), said magnetic-field generating device (440) being disposed below a magnetic assembly (430), wherein each of the two or more bar dipole magnets (441) has a magnetic axis substantially parallel to the substrate surface and their North pole facing the same direction.

The magnetic-field generating device (440) is a combination of two or more bar dipole magnets (441), eight bar dipole magnets in FIG. 4A, and of one or more spacer pieces (442), six spacer pieces in FIG. 4A, made of a non-magnetic material such as those described herein for the supporting matrix. The one or more spacer pieces (442) are disposed between the two or more bar dipole magnets (441). As shown in FIG. 4A, the arrangement of the two or more bar dipole magnets and the spacer pieces may be non-symmetrical.

Each of the two or more bar dipole magnets (441) may be a parallelepiped having a length (L1), a width (L2*a*) and a thickness (L3) as shown in FIG. 4A. Each of the spacer pieces (442) may be a parallelepiped having a width (L2*b*) and a thickness (L3).

The magnetic assembly (430) comprises a supporting matrix (434) which may be a parallelepiped having a length (L4), a width (L5) and a thickness (L6) as shown in FIG. 4A.

The magnetic assembly of FIG. 4A comprises a loop-shaped magnetic-field generating device being a ring-shaped dipole magnet (431) and two or more dipole magnets (432), for example five dipole magnets as shown in FIG. 4A-B. As shown in FIGS. 4A and 4B1, the two or more dipole magnet (432) may be disposed non-symmetrically within the loop of the loop-shaped magnetic-field generating device (431).

The loop-shaped magnetic-field generating device being a ring-shaped dipole magnet (431) has an external diameter (L7), an internal diameter (L8) and a thickness (L10). The magnetic axis of the loop-shaped magnetic-field generating (431) is substantially perpendicular to the magnetic axis of the magnetic-field generating device (440), i.e. substantially perpendicular to the substrate (420) surface with the North pole facing the substrate (420).

The two or more, in particular five, dipole magnets (432) may have a same diameter (L9) or may have different diameters. The magnetic axis of each of the two or more, in particular five, dipole magnets (432) is substantially perpendicular to the magnetic axis of the magnetic-field generating device (440), i.e. substantially perpendicular to the substrate (420) surface with their North pole facing the substrate (420).

The magnetic assembly (430) and the magnetic-field generating device (440) are preferably in direct contact, i.e. the distance (d) between the upper surface of the magnetic assembly (430) and the lower surface of the bar dipole magnet (440) is about 0 mm (not shown true to scale in FIG. 4A for the clarity of the drawing). The distance between the upper surface of magnetic assembly (430) and the surface of the substrate (420) facing said magnetic assembly (430) is illustrated by the distance (h). Preferably, the distance (h) is between about 0.1 and about 10 mm.

Figure 4C:
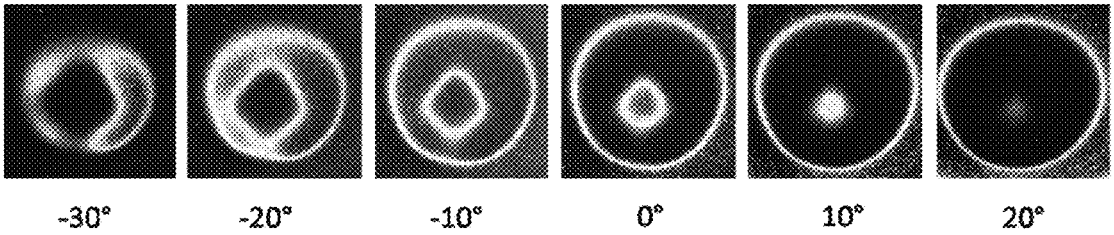
FIG. 4C shows pictures of an OEL obtained by using the apparatus illustrated in FIG. 4A-B, as viewed under different viewing angles.

The resulting OEL produced by the apparatus illustrated in FIG. 4A-B is shown in FIG. 4C as seen under different viewing angles by tilting the substrate (420) between −30° and +20°. The so-obtained OEL provides an optical impression of two nested loop-shaped bodies surrounding one central area, i.e. an irregular square-shaped body and a ring-shaped body wherein both loop-shaped bodies have a size that varies upon tilting the substrate comprising the optical effect layer.

FIG. 5A-B illustrate an example of an apparatus suitable for producing optical effect layers (OELs) (510) comprising non-spherical magnetic or magnetizable pigment particles on a substrate (520) according to the present invention. The apparatus of FIG. 5A comprises a magnetic-field generating device (540) being a combination of two or more bar dipole magnets (541), said magnetic-field generating device (540) being disposed below a magnetic assembly (530), wherein each of the two or more bar dipole magnets (541) has a magnetic axis substantially parallel to the substrate surface and their North pole facing the same direction.

The magnetic-field generating device (540) is a combination of two or more bar dipole magnets (541), seven bar dipole magnets in FIG. 5A, and of one or more spacer pieces (542), six spacer pieces in FIG. 5A, made of a non-magnetic material such as those described herein for the supporting matrix. The one or more spacer pieces (542) are disposed between the two or more bar dipole magnets (541). As shown in FIG. 5A, the arrangement of the two or more bar dipole magnets (541) and the spacer pieces (542) may be non-symmetrical.

Each of the two or more bar dipole magnets (541) may be a parallelepiped having a length (L1), a width (L2*a*) and a thickness (L3) as shown in FIG. 5A. Each of the spacer pieces (542) may be a parallelepiped having a width (L2*b*) and a thickness (L3).

The magnetic assembly (530) of FIG. 5A comprises a supporting matrix (534) which may be a parallelepiped having a length (L4), a width (L5) and a thickness (L6) as shown in FIG. 5A.

The magnetic assembly (530) of FIG. 5A comprises a loop-shaped magnetic-field generating device being a ring-shaped dipole magnet (531) and two or more dipole magnets (532), for example five dipole magnet as shown in FIG. 5A-B. As shown in FIGS. 5A and 5B1, the two or more dipole magnet (532) may be disposed symmetrically within the loop of the loop-shaped magnetic-field generating device (531).

The loop-shaped magnetic-field generating device being a ring-shaped dipole magnet (531) has an external diameter (L7), an internal diameter (L8) and a thickness (L10). The magnetic axis of the ring-shaped dipole magnet (531) is substantially perpendicular to the magnetic axis of the magnetic-field generating device (540), i.e. substantially perpendicular to the substrate (520) surface with the North pole facing the substrate (520).

The two or more, in particular five, dipole magnets (532) may have a same diameter (L9) or may have different diameters. The magnetic axis of each of the two or more, in particular five, dipole magnets (532) is substantially perpendicular to the magnetic axis of the magnetic-field generating device (540), i.e. substantially perpendicular to the substrate (520) surface with their South pole facing the substrate (520).

The magnetic assembly (530) and the magnetic-field generating device (540) are preferably in direct contact, i.e. the distance (d) between the lower surface of the magnetic assembly (530) and the upper surface of the bar dipole magnet (540) is about 0 mm (not shown true to scale in FIG. 5A for the clarity of the drawing). The distance between the upper surface of the supporting matrix (534) and the surface of the substrate (520) facing said supporting matrix (534) is illustrated by the distance (h). Preferably, the distance (h) is between about 0.1 and about 10 mm and more preferably between about 0.2 and about 5 mm.

The resulting OEL produced by the apparatus illustrated in FIG. 5A-B is shown in FIG. 4C as seen under different viewing angles by tilting the substrate (520) between −30° and +20°. The so-obtained OEL provides an optical impression of a ring-shaped body having a size that varies upon tilting the substrate comprising the optical effect layer.

FIG. 6 illustrates an example of an apparatus suitable for producing optical effect layers (OELs) (610) comprising non-spherical magnetic or magnetizable pigment particles on a substrate (620) according to the present invention, wherein said apparatus comprises a magnetic assembly (630) such as those described herein, wherein said magnetic assembly (630) comprises the supporting matrix (634) described herein, a1) the loop-shaped magnetic-field generating device (631) described herein, and a2) the one or more pole pieces (633) being loop-shaped pole pieces described herein.

Figure 6A:
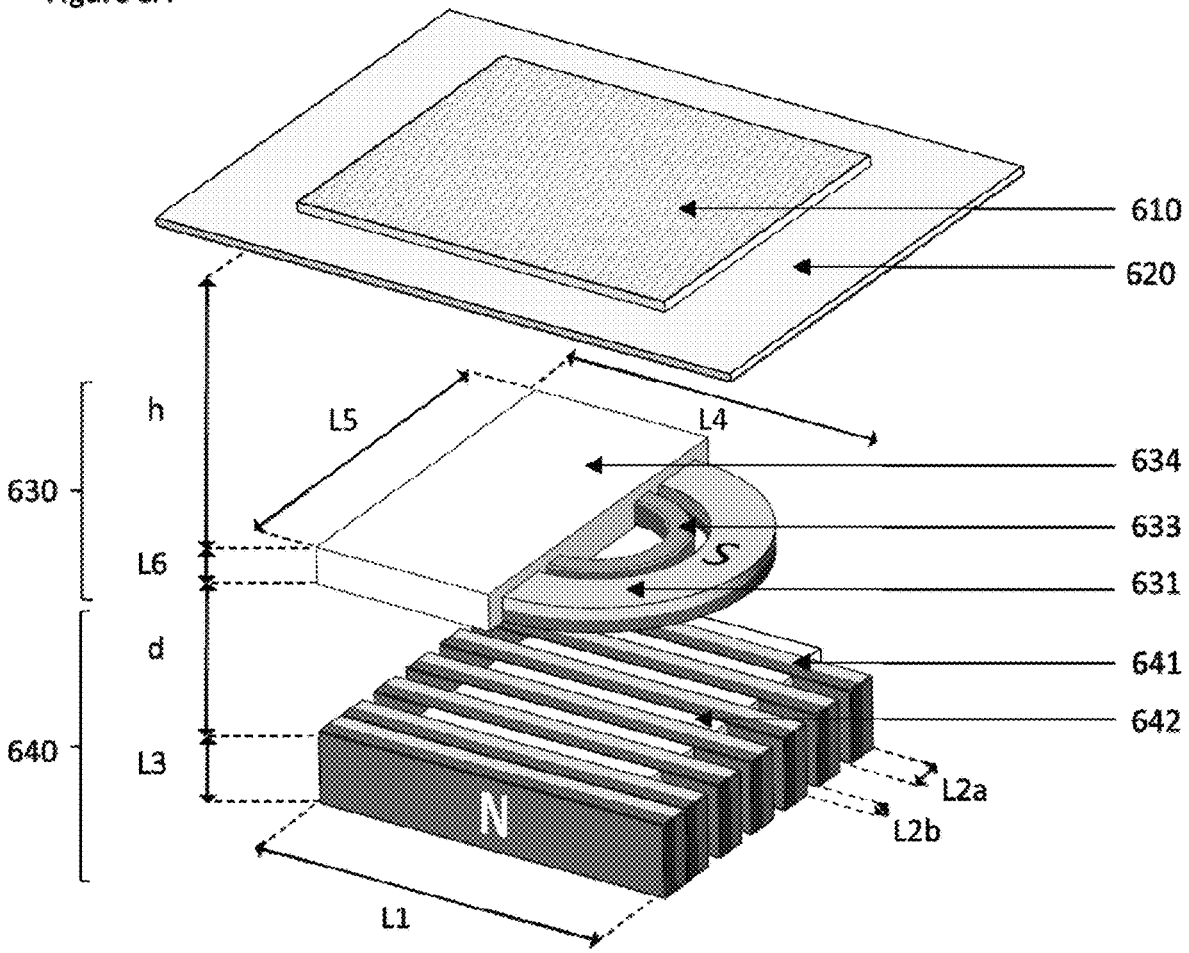
FIG. 6A schematically illustrate an apparatus comprising a) a magnetic assembly (630), said magnetic assembly comprising a supporting matrix (634), a loop-shaped magnetic-field generating device (631), in particular a ring-shaped dipole magnet, and a loop-shaped pole piece (633), in particular a ring-shaped pole piece); and b) a magnetic-field generating device (640) comprising seven dipole magnets (641) and six spacers (642). Said apparatus is suitable for producing an optical effect layer (610) on a substrate (620).

FIG. 6A-B illustrate an example of an apparatus suitable for producing optical effect layers (OELs) (610) comprising non-spherical magnetic or magnetizable pigment particles on a substrate (620) according to the present invention. The apparatus of FIG. 6A comprises a magnetic-field generating device (640) being a combination of two or more bar dipole magnets (641), said two or more bar dipole magnets (641) being disposed below a magnetic assembly (630), wherein each of the two or more bar dipole magnets (641) has a magnetic axis substantially parallel to the substrate (620) surface and their North pole facing the same direction.

The magnetic-field generating device (640) is a combination of two or more bar dipole magnets (641), seven bar dipole magnets in FIG. 6A, and of one or more spacer pieces (642), six spacer pieces in FIG. 6A, made of a non-magnetic material such as those described herein for the supporting matrix. The one or more spacer pieces (642) are disposed between the two or more bar dipole magnets (641). As shown in FIG. 6A, the arrangement of the two or more bar dipole magnets and the spacer pieces may be non-symmetrical.

Each of the two or more bar dipole magnets (641) may be a parallelepiped having a length (L1), a width (L2*a*) and a thickness (L3) as shown in FIG. 6A. Each of the spacer pieces (642) may be a parallelepiped having a width (L2*b*) and a thickness (L3).

The magnetic assembly (630) comprises a supporting matrix (634) which may be a parallelepiped having a length (L4), a width (L5) and a thickness (L6) as shown in FIG. 6A.

The magnetic assembly (630) of FIG. 6A comprises a supporting matrix (634), a loop-shaped magnetic-field generating device being a ring-shaped dipole magnet (631) and one or more loop-shaped pole pieces (633), in particular one ring-shaped pole piece as shown in FIG. 6A. The loop-shaped magnetic-field generating device being a ring-shaped dipole magnet (631) has an external diameter (L7), an internal diameter (L8) and a thickness (L10). The magnetic axis of the ring-shaped dipole magnet (631) is substantially perpendicular to the magnetic axis of the magnetic-field generating device (640), i.e. substantially perpendicular to the substrate (620) surface with the South pole facing the substrate (620).

The one or more, in particular one, loop-shaped pole pieces (633) being a ring-shaped pole piece (633) has an external diameter (L15), an internal diameter (16) and a thickness (L17).

The magnetic assembly (630) and the magnetic-field generating device (640) are preferably in direct contact, i.e. the distance (d) between the supporting matrix (634) and the bar dipole magnet (640) is about 0 mm (not shown true to scale in FIG. 6A for the clarity of the drawing). The distance between the upper surface of the supporting matrix (634) and the surface of the substrate (620) facing said supporting matrix (634) is illustrated by the distance (h). Preferably, the distance (h) is between about 0.1 and about 10 mm and more preferably between about 0.2 and about 5 mm.

The resulting OEL produced by the apparatus illustrated in FIG. 6A-B is shown in FIG. 6C as seen under different viewing angles by tilting the substrate (620) between −30° and +20°. The so-obtained OEL provides an optical impression of a ring-shaped body having a size that varies upon tilting the substrate comprising the optical effect layer.

FIG. 7-12 illustrate examples of apparatuses suitable for producing optical effect layers (OELs) (710, 810, 910, 1010, 1110, 1210) comprising non-spherical magnetic or magnetizable pigment particles on a substrate (720, 820, 920, 1020, 1120, 1220) according to the present invention, wherein said apparatuses comprises a magnetic assembly (730, 830, 930, 1030, 1130, 1230) comprising the supporting matrix (134, 234, 334, 434, 534, 634, 734, 834, 934, 1034, 1134, 1234) described herein, a1) the loop-shaped magnetic-field generating device (731, 831, 931, 1031, 1131, 1231) described herein, a2) the dipole magnet (732, 832, 932, 1032, 1132, 1232) or the two or more dipole magnets (732, 832, 932, 1032, 1132, 1232) described herein and a2) the one or more pole pieces (733, 833, 933, 1030, 1133, 1233), being loop-shaped pole pieces (733, 833, 933, 1030, 1133, 1233), described herein.

According to one embodiment and as shown for example in FIG. 7-10, the magnetic assemblies (730, 830, 930, 1030, 1130) comprises the supporting matrix (734, 834, 934 1034) described herein, a1) the loop-shaped magnetic-field generating device (731, 831, 931, 1031, 1131) described herein, a2) the dipole magnet (732, 832, 932, 1032) described herein and a2) the one or more pole pieces (733, 833, 933, 1030), being loop-shaped pole pieces (733, 833, 933, 1030, 1133), wherein both the loop-shaped magnetic-field generating device (731, 831, 931, 1031, 1131) and the dipole magnet (732, 832, 932, 1032) have a magnetic axis substantially perpendicular to the substrate surface and wherein the loop-shaped magnetic-field generating device (731, 831, 931,1031, 1131) and the dipole magnet (732, 832, 932, 1032) have a same magnetic field direction.

According to another embodiment and as shown for example in FIG. 11-12, the magnetic assemblies (1130, 1230) comprises a supporting matrix (1134, 1234), a1) the loop-shaped magnetic-field generating device (1131, 1231) described herein, a2) the dipole magnet (1132, 1232) described herein a2) the one or more pole pieces (1133, 1233 being loop-shaped pole pieces (1133,1233) described herein, wherein both the loop-shaped magnetic-field generating device (1131, 1231) and the dipole magnet (1132, 1232) have a magnetic axis substantially perpendicular to the substrate surface and wherein both the loop-shaped magnetic-field generating device (1131, 1231) and the dipole magnet (1132, 1232) have a different magnetic field direction.

Figure 7A:
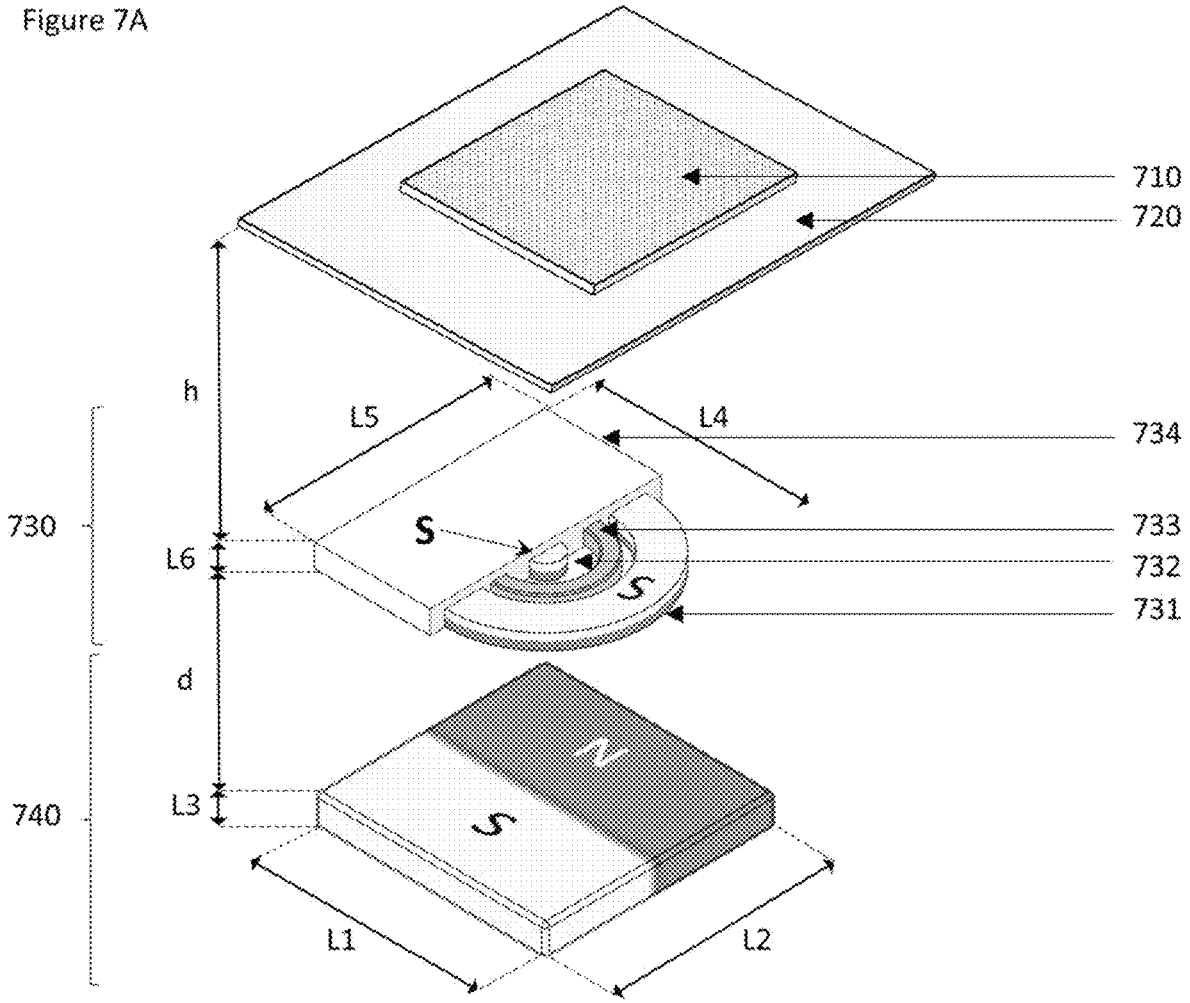
FIG. 7A schematically illustrate an apparatus comprising a) a magnetic assembly (730), said magnetic assembly comprising a supporting matrix (734), a loop-shaped magnetic-field generating device (731), in particular a ring-shaped dipole magnet, a loop-shaped pole piece (733), in particular a ring-shaped pole piece, and a dipole magnet (732); and b) a magnetic-field generating device (740). Said apparatus is suitable for producing an optical effect layer (710) on a substrate (720).

FIG. 7A-B illustrate an example of an apparatus suitable for producing optical effect layers (OELs) (710) comprising non-spherical magnetic or magnetizable pigment particles on a substrate (720) according to the present invention. The apparatus of FIG. 7A comprises a magnetic-field generating device (740) being a bar dipole magnet, said bar dipole magnet being disposed below a magnetic assembly (730).

The magnetic-field generating device (740) may be a parallelepiped having a length (L1), a width (L2) and a thickness (L3) as shown in FIG. 7A. The magnetic axis of the magnetic-field generating device (740) is substantially parallel to the substrate (720) surface.

The magnetic assembly (730) comprises a supporting matrix (734) which may be a parallelepiped having a length (L4), a width (L5) and a thickness (L6) as shown in FIG. 7A.

The magnetic assembly (730) of FIG. 7A comprises a loop-shaped magnetic-field generating device being a ring-shaped dipole magnet (731), a dipole magnet (732) and a loop-shaped pole piece (733) being a ring-shaped pole piece (733) as shown in FIG. 7A-B. As shown in FIGS. 7A and 7B1, the dipole magnet (732) and the loop-shaped pole piece (733) may be disposed symmetrically within the loop of the loop-shaped magnetic-field generating device (731).

The loop-shaped magnetic-field generating device being a ring-shaped dipole magnet (731) has an external diameter (L7), an internal diameter (L8) and a thickness (L10). The magnetic axis of the loop-shaped magnetic-field generating device (731) is substantially perpendicular to the magnetic axis of the magnetic-field generating device (740), i.e.

substantially perpendicular to the substrate (720) surface with the South pole facing the substrate (720).

The dipole magnet (732) has a diameter (L9). The magnetic axis of the dipole magnet (732) is substantially perpendicular to the magnetic axis of the magnetic-field generating device (740), i.e. substantially perpendicular to the substrate (720) surface with the South pole facing the substrate (720). The one or more, in particular one, loop-shaped pole pieces (733) being a ring-shaped pole piece (733) has an external diameter (L15), an internal diameter (16) and a thickness (L17).

The magnetic assembly (730) and the magnetic-field generating device being a bar dipole magnet (740) are preferably in direct contact, i.e. the distance (d) between the lower surface of the magnetic assembly (730) and the upper surface of the bar dipole magnet (740) is about 0 mm (not shown true to scale in FIG. 7A for the clarity of the drawing). The distance between the upper surface of the magnetic assembly (730) and the surface of the substrate (720) facing said magnetic assembly (730) is illustrated by the distance (h). Preferably, the distance (h) is between about 0.1 and about 10 mm and more preferably between about 0.2 and about 5 mm.

The resulting OEL produced by the apparatus illustrated in FIG. 7A-B is shown in FIG. 7C as seen under different viewing angles by tilting the substrate (720) between −10° and +40°. The so-obtained OEL provides an optical impression of two nested loop-shaped bodies surrounding one central area, i.e. two ring-shaped bodies, wherein both loop-shaped bodies have a size that varies upon tilting the substrate comprising the optical effect layer.

Figure 8A:
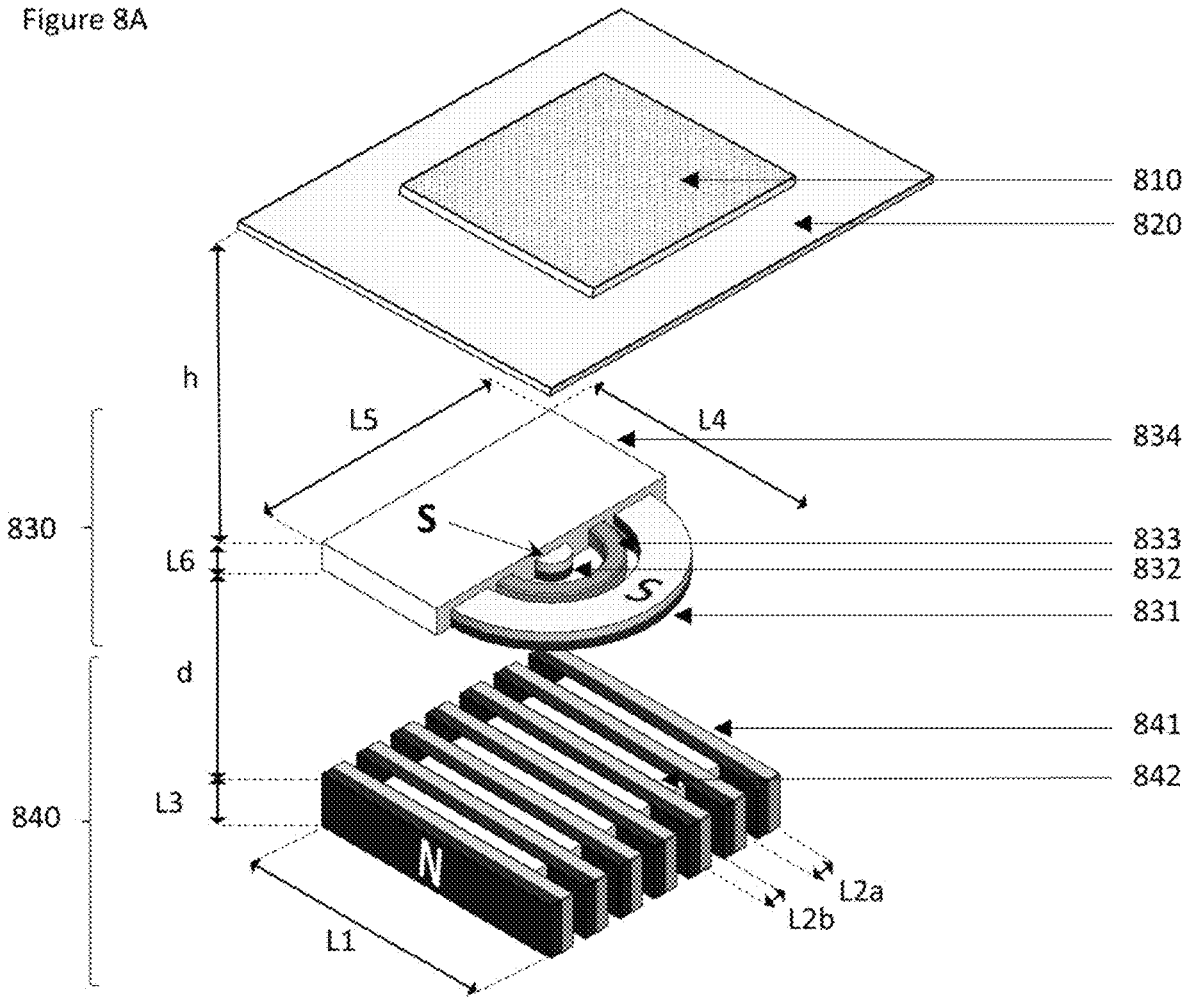
FIG. 8A schematically illustrate an apparatus comprising a) a magnetic assembly (830), said magnetic assembly comprising a supporting matrix (834), a loop-shaped magnetic-field generating device (831), in particular a ring-shaped dipole magnet, a loop-shaped pole piece (833), in particular a ring-shaped pole piece, and a dipole magnet (832); and b) a magnetic-field generating device (840) comprising seven dipole magnets (841) and six spacers (842). Said apparatus is suitable for producing an optical effect layer (810) on a substrate (820).

FIG. 8A-B illustrate an example of an apparatus suitable for producing optical effect layers (OELs) (810) comprising non-spherical magnetic or magnetizable pigment particles on a substrate (820) according to the present invention. The apparatus of FIG. 8A comprises a magnetic-field generating device (840) being a combination of two or more bar dipole magnets (841), said two or more bar dipole magnets (841) being disposed below a magnetic assembly (830), wherein each of the two or more bar dipole magnets (841) has a magnetic axis substantially parallel to the substrate (820) surface and their North pole facing the same direction.

The magnetic-field generating device (840) is a combination of two or more bar dipole magnets (841), seven bar dipole magnets in FIG. 8A, and of one or more spacer pieces (842), six spacer pieces in FIG. 8A, made of a non-magnetic material such as those described herein for the supporting matrix. The one or more spacer pieces (842) are disposed between the two or more bar dipole magnets (841). As shown in FIG. 8A, the arrangement of the two or more bar dipole magnets and the spacer pieces may be symmetrical.

Each of the two or more bar dipole magnets (841) may be a parallelepiped having a length (L1), a width (L2*a*) and a thickness (L3) as shown in FIG. 8A. Each of the spacer pieces (842) may be a parallelepiped having a width (L2*b*) and a thickness (L3).

The magnetic assembly (830) comprises a supporting matrix (834) which may be a parallelepiped having a length (L4), a width (L5) and a thickness (L6) as shown in FIG. 8A.

The magnetic assembly (830) of FIG. 8A comprises a loop-shaped magnetic-field generating device being a ring-shaped dipole magnet (831), a dipole magnet (832) and a loop-shaped pole piece (833) being a ring-shaped pole piece (833) as shown in FIG. 8A-B. As shown in FIGS. 8A and 8B1, the dipole magnet (832) and the loop-shaped pole piece (833) may be disposed symmetrically within the loop of the loop-shaped magnetic-field generating device (831).

The loop-shaped magnetic-field generating device being a ring-shaped dipole magnet (831) has an external diameter (L7), an internal diameter (L8) and a thickness (L10). The magnetic axis of the loop-shaped magnetic-field generating device (831) is substantially perpendicular to the magnetic axis of the magnetic-field generating device (840), i.e. substantially perpendicular to the substrate (820) surface with the South pole facing the substrate (820).

The dipole magnet (832) has a diameter (L9). The magnetic axis of the dipole magnet (832) is substantially perpendicular to the magnetic axis of the magnetic-field generating device (840), i.e. substantially perpendicular to the substrate (820) surface with the South pole facing the substrate (820).

The one or more loop-shaped pole pieces (833) being a ring-shaped pole piece (833) has an external diameter (L15), an internal diameter (L16) and a thickness (L17).

The magnetic assembly (830) and the magnetic-field generating device being a bar dipole magnet (840) are preferably in direct contact, i.e. the distance (d) between the lower surface of the magnetic assembly (830) and the upper surface of the bar dipole magnet (840) is about 0 mm (not shown true to scale in FIG. 8A for the clarity of the drawing). The distance between the upper surface of the magnetic assembly (830) and the surface of the substrate (820) facing said magnetic assembly (830) is illustrated by the distance (h). Preferably, the distance (h) is between about 0.1 and about 10 mm and more preferably between about 0.2 and about 5 mm.

The resulting OEL produced by the apparatus illustrated in FIG. 8A-B is shown in FIG. 8C as seen under different viewing angles by tilting the substrate (820) between 0° and +50°. The so-obtained OEL provides an optical impression of two nested loop-shaped bodies surrounding one central area, i.e. two ring-shaped bodies, wherein both loop-shaped bodies have a size that varies upon tilting the substrate comprising the optical effect layer.

Figure 9A:
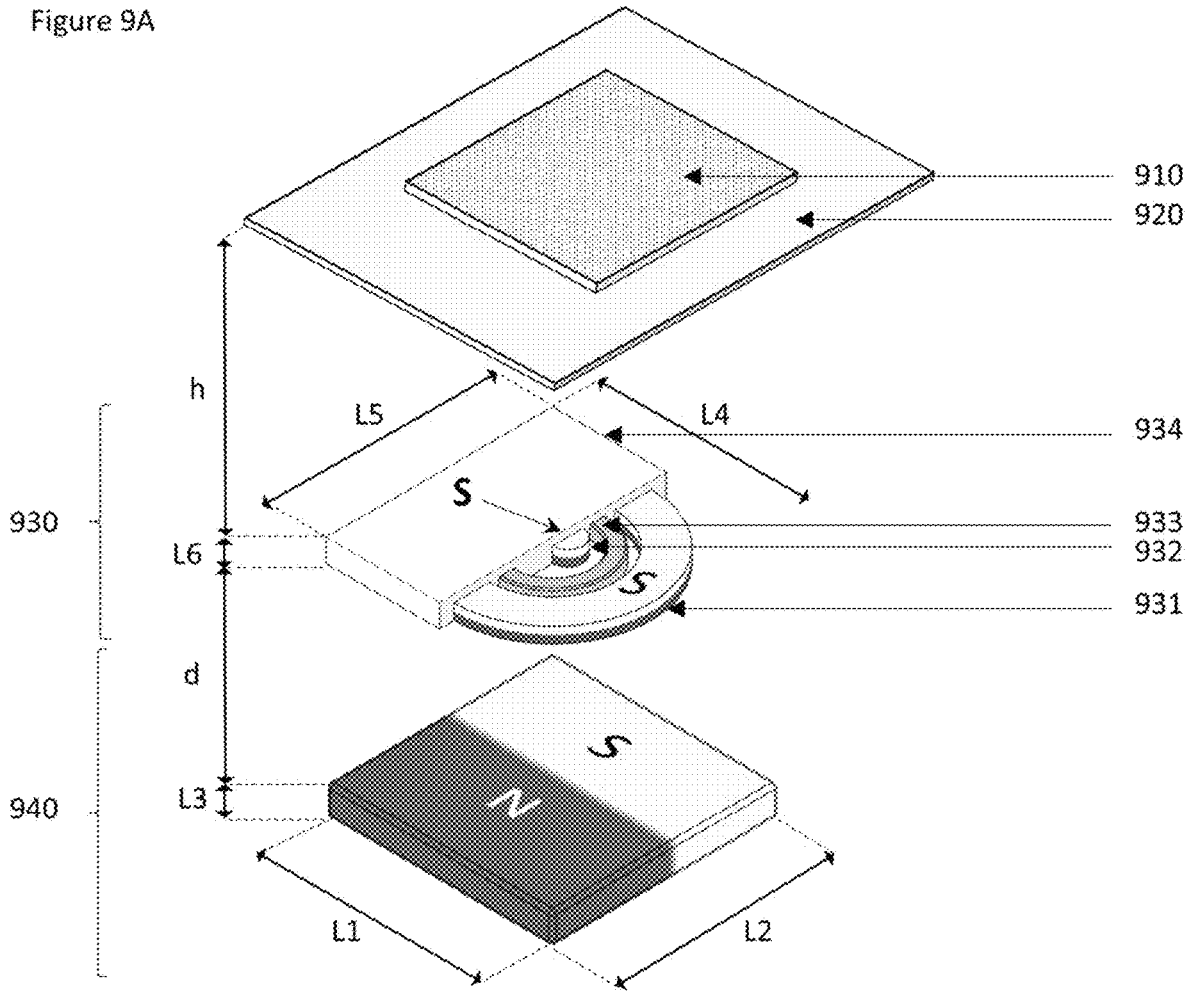
FIG. 9A schematically illustrate an apparatus comprising a) a magnetic assembly (930), said magnetic assembly comprising a supporting matrix (934), a loop-shaped magnetic-field generating device (931), in particular a ring-shaped dipole magnet, a loop-shaped pole piece (933), in particular a ring-shaped pole piece, and a dipole magnet (932); and b) a magnetic-field generating device (940). Said apparatus is suitable for producing an optical effect layer (910) on a substrate (920).

FIG. 9A-B illustrate an example of an apparatus suitable for producing optical effect layers (OELs) (910) comprising non-spherical magnetic or magnetizable pigment particles on a substrate (920) according to the present invention. The apparatus of FIG. 9A comprises a magnetic-field generating device (940) being bar dipole disposed below a magnetic assembly (930). The magnetic-field generating device (940) may be a parallelepiped having a width (L1), a length (L2) and a thickness (L3) as shown in FIG. 9A. The magnetic axis of the magnetic-field generating device (940) is substantially parallel to the substrate (920) surface.

The magnetic assembly (930) comprises a supporting matrix (934) which may be a parallelepiped having a length (L4), a width (L5) and a thickness (L6) as shown in FIG. 9A.

The magnetic assembly (930) of FIG. 9A comprises a loop-shaped magnetic-field generating device being a ring-shaped dipole magnet (931), a dipole magnet (932) and a loop-shaped pole piece (933) being a ring-shaped pole piece (933) as shown in FIG. 9A-B. As shown in FIGS. 9A and 9B1, the dipole magnet (932) may be disposed non-symmetrically within the loop of the loop-shaped magnetic-field generating device (931). As shown in FIGS. 9A and 9B1, the loop-shaped pole piece (933) may be disposed symmetrically within the loop of the loop-shaped magnetic-field generating device (931).

The loop-shaped magnetic-field generating device being a ring-shaped dipole magnet (931) has an external diameter (L7), an internal diameter (L8) and a thickness (L10). The magnetic axis of the loop-shaped magnetic-field generating device (931) is substantially perpendicular to the magnetic axis of the magnetic-field generating device (940), i.e. substantially perpendicular to the substrate (920) surface with the South pole facing the substrate (920).

The dipole magnet (932) has a diameter (L9). The magnetic axis of the dipole magnet (932) is substantially perpendicular to the magnetic axis of the magnetic-field generating device (940), i.e. substantially perpendicular to the substrate (920) surface with the South pole facing the substrate (920).

The loop-shaped pole pieces (933) being a ring-shaped pole piece (933) has an external diameter (L15), an internal diameter (L16) and a thickness (L17).

The magnetic assembly (930) and the magnetic-field generating device being a bar dipole magnet (940) are preferably in direct contact, i.e. the distance (d) between the lower surface of the magnetic assembly (930) and the upper surface of the bar dipole magnet (940) is about 0 mm (not shown true to scale in FIG. 9A for the clarity of the drawing). The distance between the upper surface of the magnetic assembly (930) and the surface of the substrate (920) facing said magnetic assembly (930) is illustrated by the distance h. Preferably, the distance h is between about 0.1 and about 10 mm and more preferably between about 0.2 and about 5 mm.

The resulting OEL produced by the apparatus illustrated in FIG. 9A-B is shown in FIG. 9C as seen under different viewing angles by tilting the substrate (920) between −20° and +30°. The so-obtained OEL provides an optical impression of two nested loop-shaped bodies surrounding one central area, i.e. two ring-shaped bodies, wherein both loop-shaped bodies have a size that varies upon tilting the substrate comprising the optical effect layer.

Figure 10A:
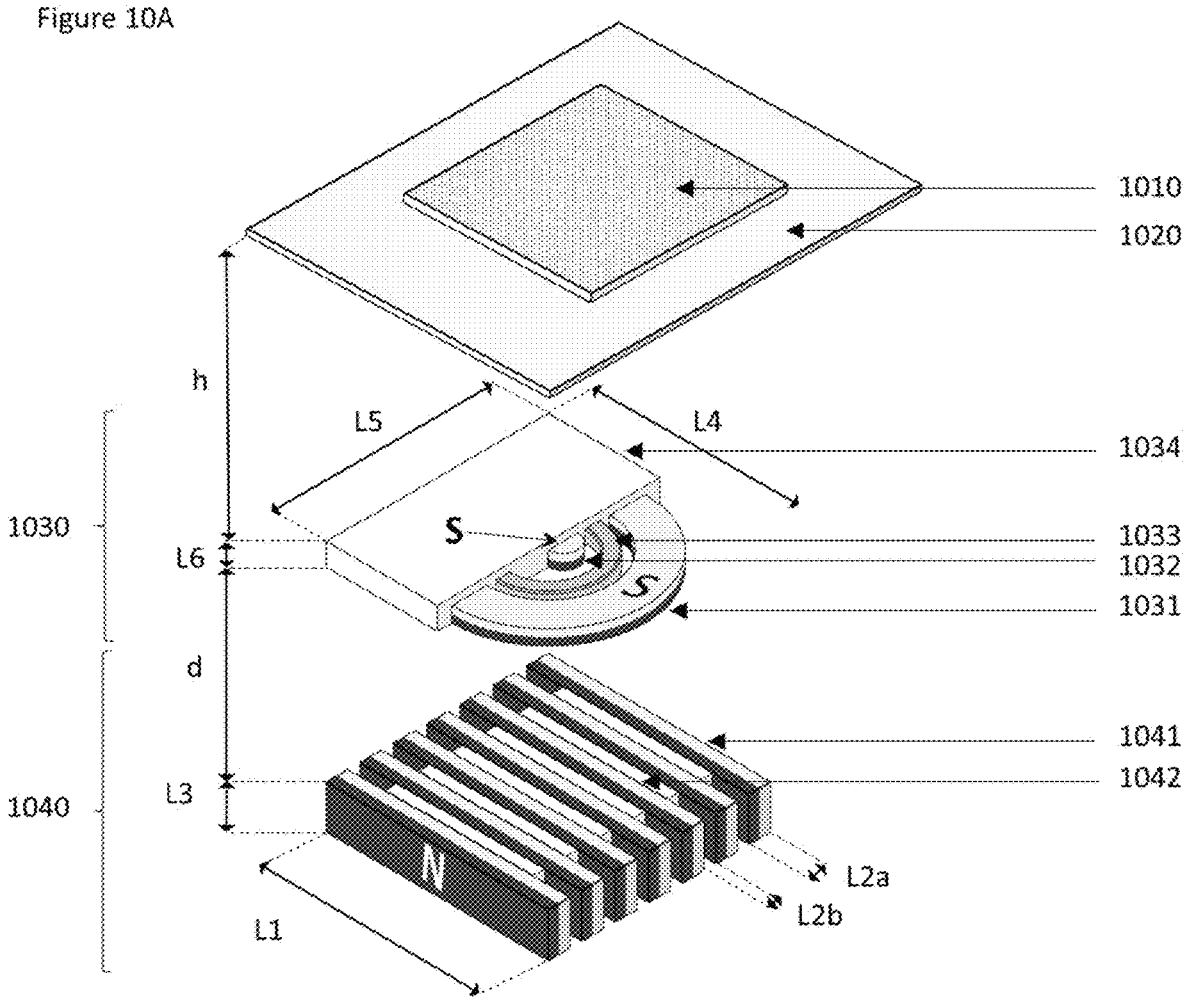
FIG. 10A schematically illustrate an apparatus comprising a) a magnetic assembly (1030), said magnetic assembly comprising a supporting matrix (1034), a loop-shaped magnetic-field generating device (1031), in particular a ring-shaped dipole magnet, a loop-shaped pole piece (1033), in particular a ring-shaped pole piece, and a dipole magnet (1032); and b) a magnetic-field generating device (1040) comprising seven dipole magnets (1041) and six spacers (1042). Said apparatus is suitable for producing an optical effect layer (1010) on a substrate (1020).

FIG. 10A-B illustrate an example of an apparatus suitable for producing optical effect layers (OELs) (1010) comprising non-spherical magnetic or magnetizable pigment particles on a substrate (1020) according to the present invention. The apparatus of FIG. 10A comprises a magnetic-field generating device (1040) being a combination of two or more bar dipole magnets (1041), said magnetic-field generating device (1040) being disposed below a magnetic assembly (1030), wherein each of the two or more bar dipole magnets (1041) has a magnetic axis substantially parallel to the substrate (1020) surface and their North pole facing the same direction.

The magnetic-field generating device (1040) is a combination of two or more bar dipole magnets (1041), seven magnets in FIG. 10A, and of one or more spacer pieces (1042), six spacer pieces in FIG. 10A, independently made of a non-magnetic material such as those described herein for the supporting matrix. The one or more spacer pieces (1042) are disposed between the two or more bar dipole magnets (1041). As shown in FIG. 10A, the arrangement of the two or more bar dipole magnets and the spacer pieces may be symmetrical.

Each of the two or more, in particular seven, bar dipole magnets (1041) may be a parallelepiped having a length (L1), a width (L2*a*) and a thickness (L3) as shown in FIG. 10A. Each of the spacer pieces (1042) may be a parallelepiped having a width (L2*b*) and a thickness (L3).

The magnetic assembly (1030) comprises a supporting matrix (1034) which may be a parallelepiped having a length (L4), a width (L5) and a thickness (L6) as shown in FIG. 10A.

The magnetic assembly (1030) of FIG. 10A comprises a loop-shaped magnetic-field generating device being a ring-shaped dipole magnet (1031), a dipole magnet (1032) and a loop-shaped pole piece (1033) being a ring-shaped pole piece (1033) as shown in FIG. 10A-B. As shown in FIGS. 10A and 10B1, the dipole magnet (1032) may be disposed non-symmetrically within the loop of the loop-shaped magnetic-field generating device (1031). As shown in FIGS. 10A and 10B1, the loop-shaped pole piece (1033) may be disposed symmetrically within the loop of the loop-shaped magnetic-field generating device (1031).

The loop-shaped magnetic-field generating device being a ring-shaped dipole magnet (1031) has an external diameter (L7), an internal diameter (L8) and a thickness (L10). The magnetic axis of the loop-shaped magnetic-field generating device (1031) is substantially perpendicular to the magnetic axis of the magnetic-field generating device (1040), i.e. substantially perpendicular to the substrate (1020) surface with the South pole facing the substrate (1020).

The dipole magnet (1032) has a diameter (L9). The magnetic axis of the dipole magnet (1032) is substantially perpendicular to the magnetic axis of the magnetic-field generating device (1040), i.e. substantially perpendicular to the substrate (1020) surface with the South pole facing the substrate (1020).

The loop-shaped pole pieces (1033) being a ring-shaped pole piece (1033) has an external diameter (L15), an internal diameter (L16) and a thickness (L17).

The magnetic assembly (1030) and the magnetic-field generating device being a bar dipole magnet (1040) are preferably in direct contact, i.e. the distance (d) between the lower surface of the magnetic assembly (1030) and the upper surface of the bar dipole magnet (1040) is about 0 mm (not shown true to scale in FIG. 10A for the clarity of the drawing). The distance between the upper surface of the magnetic assembly (1030) and the surface of the substrate (1020) facing said magnetic assembly (1030) is illustrated by the distance (h). Preferably, the distance (h) is between about 0.1 and about 10 mm and more preferably between about 0.2 and about 5 mm.

The resulting OEL produced by the apparatus illustrated in FIG. 10A-B is shown in FIG. 10C as seen under different viewing angles by tilting the substrate (1020) between −20° and +30°. The so-obtained OEL provides an optical impression of two nested loop-shaped bodies surrounding one central area, i.e. two ring-shaped bodies, wherein both loop-shaped bodies have a size that varies upon tilting the substrate comprising the optical effect layer.

Figure 11A:
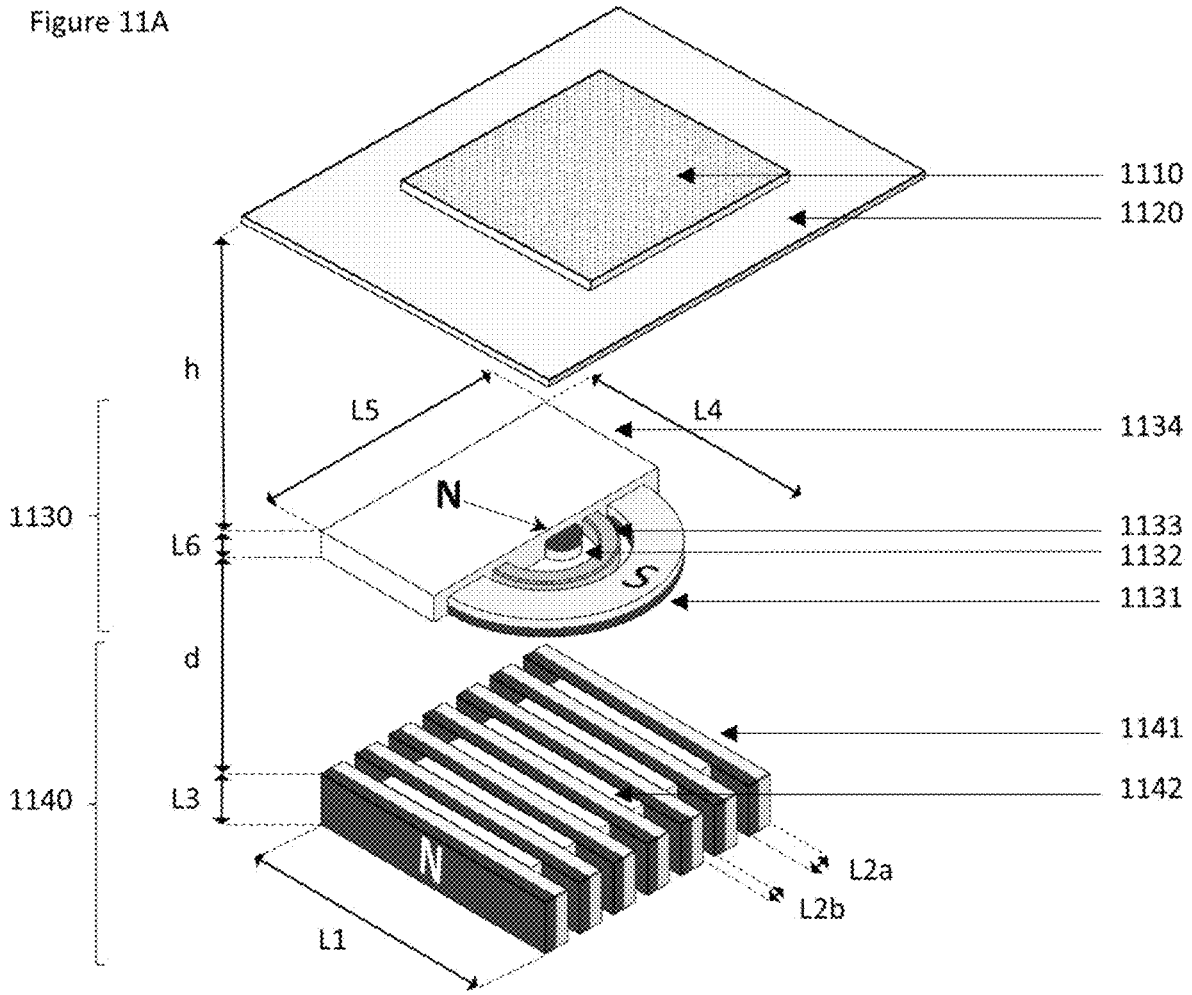
FIG. 11A schematically illustrate an apparatus comprising a) a magnetic assembly (1130), said magnetic assembly comprising a supporting matrix (1134), a loop-shaped magnetic-field generating device (1131), in particular a ring-shaped dipole magnet, a loop-shaped pole piece (1133), in particular a ring-shaped pole piece, and a dipole magnet (1132); and b) a magnetic-field generating device (1140) comprising seven dipole magnets (1141) and six spacers (1142). Said apparatus is suitable for producing an optical effect layer (1110) on a substrate (1120).

FIG. 11A-B illustrate an example of an apparatus suitable for producing optical effect layers (OELs) (1110) comprising non-spherical magnetic or magnetizable pigment particles on a substrate (1120) according to the present invention. The apparatus of FIG. 11A comprises a magnetic-field generating device (1140) being a combination of two or more bar dipole magnets (1141), said magnetic-field generating device (1140) being disposed below a magnetic assembly (1130), wherein each of the two or more bar dipole magnets (1141) has a magnetic axis substantially parallel to the substrate (1120) surface and their North pole facing the same direction.

The magnetic-field generating device (1140) is a combination of two or more bar dipole magnets (1141), seven magnets in FIG. 11A, and of one or more spacer pieces (1142), six spacer pieces in FIG. 11A, independently made of a non-magnetic material such as those described herein for the supporting matrix. The one or more spacer pieces (1142) are disposed between the two or more bar dipole magnets (1141). As shown in FIG. 11A, the arrangement of the two or more bar dipole magnets and the spacer pieces may be symmetrical.

Each of the two or more, in particular seven, bar dipole magnets (1141) may be a parallelepiped having a length (L1), a width (L2*a*) and a thickness (L3) as shown in FIG. 11A. Each of the spacer pieces (1142) may be a parallelepiped having a width (L2*b*) and a thickness (L3).

The magnetic assembly (1130) comprises a supporting matrix (1134) which may be a parallelepiped having a length (L4), a width (L5) and a thickness (L6) as shown in FIG. 11A.

The magnetic assembly (1130) of FIG. 11A comprises a loop-shaped magnetic-field generating device being a ring-shaped dipole magnet (1131), a dipole magnet (1132) and a loop-shaped pole piece (1133) being a ring-shaped pole piece (1133) as shown in FIG. 11A-B. As shown in FIGS. 11A and 11B1, the dipole magnet (1132) may be disposed non-symmetrically within the loop of the loop-shaped magnetic-field generating device (1131). As shown in FIGS. 11A and 11B1, the loop-shaped pole piece (1133) may be disposed symmetrically within the loop of the loop-shaped magnetic-field generating device (1131).

The loop-shaped magnetic-field generating device being a ring-shaped dipole magnet (1131) has an external diameter (L7), an internal diameter (L8) and a thickness (L10). The magnetic axis of the loop-shaped magnetic-field generating device (1131) is substantially perpendicular to the magnetic axis of the magnetic-field generating device (1140), i.e. substantially perpendicular to the substrate (1120) surface with the South pole facing the substrate (1120).

The dipole magnet (1132) has a diameter (L9). The magnetic axis of the dipole magnet (1132) is substantially perpendicular to the magnetic axis of the magnetic-field generating device (1140), i.e. substantially perpendicular to the substrate (1120) surface with the North pole facing the substrate (1120).

The loop-shaped pole pieces (1133) being a ring-shaped pole piece (1133) has an external diameter (L15), an internal diameter (L16) and a thickness (L17).

The magnetic assembly (1130) and the magnetic-field generating device being a bar dipole magnet (1140) are preferably in direct contact, i.e. the distance (d) between the lower surface of the magnetic assembly (1130) and the upper surface of the bar dipole magnet (1140) is about 0 mm (not shown true to scale in FIG. 11A for the clarity of the drawing). The distance between the upper surface of the magnetic assembly (1130) and the surface of the substrate (1120) facing said magnetic assembly (1130) is illustrated by the distance (h). Preferably, the distance (h) is between about 0.1 and about 10 mm and more preferably between about 0.2 and about 5 mm.

The resulting OEL produced by the apparatus illustrated in FIG. 11A-B is shown in FIG. 11C as seen under different viewing angles by tilting the substrate (1120) between −30° and +20°. The so-obtained OEL provides an optical impression of a ring-shaped body having a size that varies upon tilting the substrate comprising the optical effect layer.

Figure 12A:
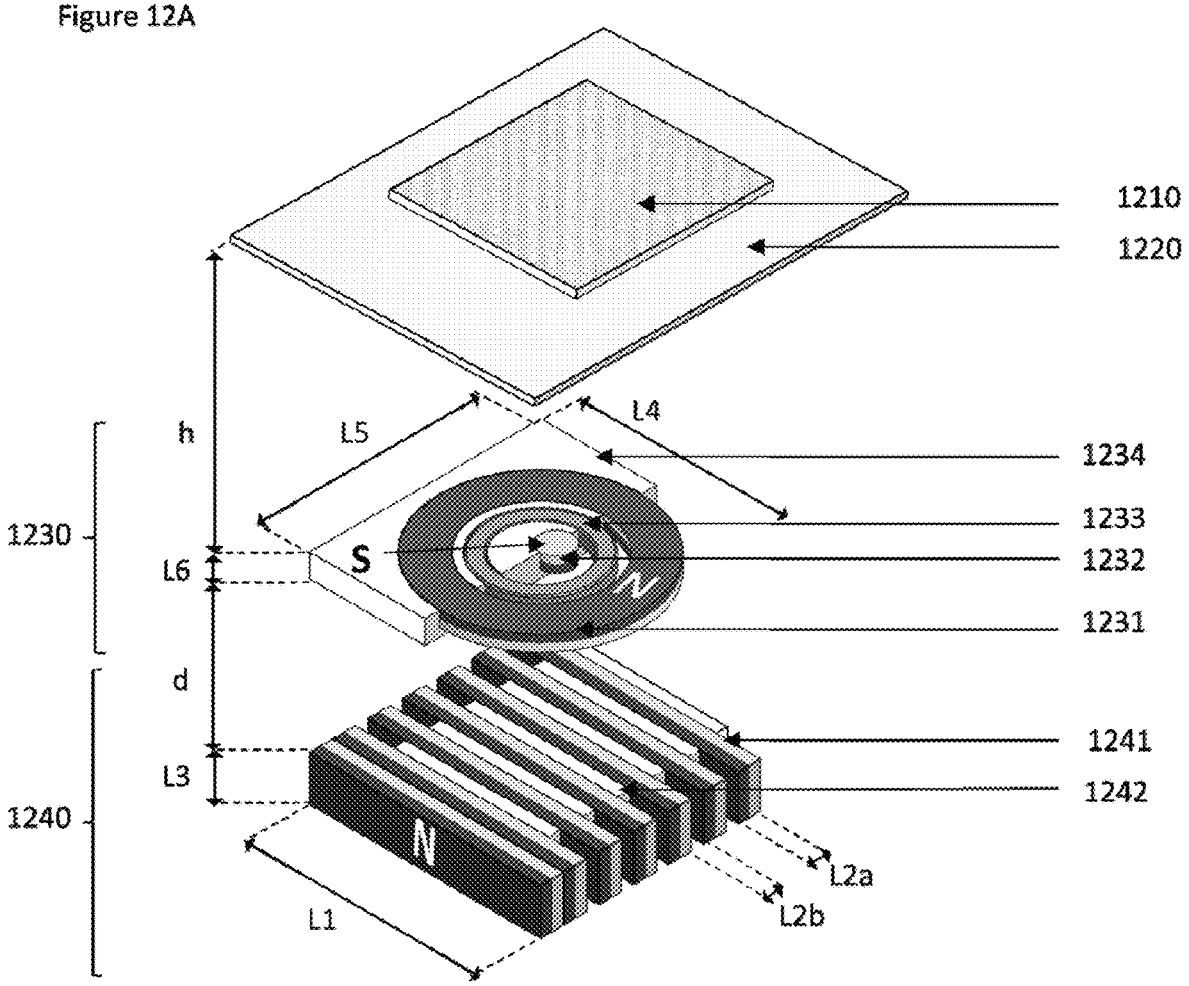
FIG. 12A schematically illustrate an apparatus comprising a) a magnetic assembly (1230), said magnetic assembly comprising a supporting matrix (1234), a loop-shaped magnetic-field generating device (1231), in particular a ring-shaped dipole magnet, a loop-shaped pole piece (1233), in particular a ring-shaped pole piece, and a dipole magnet (1232); and b) a magnetic-field generating device (1240) comprising seven dipole magnets (1241) and six spacers (1242). Said apparatus is suitable for producing an optical effect layer (1210) on a substrate (1220).

FIG. 12A-B illustrate an example of an apparatus suitable for producing optical effect layers (OELs) (1210) comprising non-spherical magnetic or magnetizable pigment particles on a substrate (1220) according to the present invention. The apparatus of FIG. 12A comprises a magnetic-field generating device (1240) being a combination of two or more bar dipole magnets (1241), said magnetic-field generating device (1240) being disposed below a magnetic assembly (1230), wherein each of the two or more bar dipole magnets (1241) has a magnetic axis substantially parallel to the substrate (1120) surface and their North pole facing the same direction.

The magnetic-field generating device (1240) is a combination of two or more bar dipole magnets (1241), seven magnets in FIG. 12A, and of one or more spacer pieces (1242), six spacer pieces in FIG. 12A, independently made of a non-magnetic material such as those described herein for the supporting matrix. The one or more spacer pieces (1242) are disposed between the two or more bar dipole magnets (1241). As shown in FIG. 12A, the arrangement of the two or more bar dipole magnets and the spacer pieces may be non-symmetrical.

Each of the two or more, in particular seven, bar dipole magnets (1241) may be a parallelepiped having a length (L1), a width (L2*a*) and a thickness (L3) as shown in FIG. 12A. Each of the spacer pieces (1242) may be a parallelepiped having a width (L2*b*) and a thickness (L3).

The magnetic assembly (1230) comprises a supporting matrix (1234) which may be a parallelepiped having a length (L4), a width (L5) and a thickness (L6) as shown in FIG. 12A.

The magnetic assembly (1230) of FIG. 12A comprises a loop-shaped magnetic-field generating device being a ring-shaped dipole magnet (1231), a dipole magnet (1232) and a loop-shaped pole piece (1233) being a ring-shaped pole piece (1233) as shown in FIG. 12A-B. As shown in FIGS. 12A and 12B1, the dipole magnet (1232) may be disposed non-symmetrically within the loop of the loop-shaped magnetic-field generating device (1231). As shown in FIGS. 12A and 12B1, the loop-shaped pole piece (1233) may be disposed symmetrically within the loop of the loop-shaped magnetic-field generating device (1231).

The loop-shaped magnetic-field generating device being a ring-shaped dipole magnet (1231) has an external diameter (L7), an internal diameter (L8) and a thickness (L10). The magnetic axis of the loop-shaped magnetic-field generating device (1231) is substantially perpendicular to the magnetic axis of the magnetic-field generating device (1240), i.e. substantially perpendicular to the substrate (1220) surface with the North pole facing the substrate (1220).

The dipole magnet (1232) has a diameter (L9). The magnetic axis of the dipole magnet (1232) is substantially perpendicular to the magnetic axis of the magnetic-field generating device (1240), i.e. substantially perpendicular to the substrate (1220) surface with the South pole facing the substrate (1220).

The loop-shaped pole pieces (1233) being a ring-shaped pole piece (1233) has an external diameter (L15), an internal diameter (L16) and a thickness (L17).

The magnetic assembly (1230) and the magnetic-field generating device being a bar dipole magnet (1240) are preferably in direct contact, i.e. the distance (d) between the lower surface of the magnetic assembly (1230) and the upper surface of the bar dipole magnet (1240) is about 0 mm (not shown true to scale in FIG. 12A for the clarity of the drawing). The distance between the upper surface of the magnetic assembly (1230) and the surface of the substrate (1220) facing said magnetic assembly (1230) is illustrated by the distance (h). Preferably, the distance (h) is between about 0.1 and about 10 mm and more preferably between about 0.2 and about 5 mm.

The resulting OEL produced by the apparatus illustrated in FIG. 12A-B is shown in FIG. 12C as seen under different viewing angles by tilting the substrate (1220) between −30° and +20°. The so-obtained OEL provides an optical impression of a ring-shaped body having a size that varies upon tilting the substrate comprising the optical effect layer.

The present invention further provides printing apparatuses comprising a rotating magnetic cylinder comprising the one or more apparatuses described herein (i.e. the apparatuses comprising the magnetic assembly (130, 230, 330, 430, 530, 630, 730, 830, 930, 1030, 1130, 1230) described herein and the magnetic-field generating device (140, 240, 340, 440, 540, 640, 740, 840, 940, 1040, 1140, 1240) described herein), wherein said one or more apparatuses are mounted to circumferential grooves of the rotating magnetic cylinder as well as printing assemblies comprising a flatbed printing unit comprising one or more of the apparatuses described herein, wherein said one or more apparatuses are mounted to recesses of the flatbed printing unit.

The rotating magnetic cylinder is meant to be used in, or in conjunction with, or being part of a printing or coating equipment, and bearing one or more apparatuses described herein. In an embodiment, the rotating magnetic cylinder is part of a rotary, sheet-fed or web-fed industrial printing press that operates at high printing speed in a continuous way.

The flatbed printing unit is meant to be used in, or in conjunction with, or being part of a printing or coating equipment, and bearing one or more of the apparatuses described herein. In an embodiment, the flatbed printing unit is part of a sheet-fed industrial printing press that operates in a discontinuous way.

The printing apparatuses comprising the rotating magnetic cylinder described herein or the flatbed printing unit described herein may include a substrate feeder for feeding a substrate such as those described herein having thereon a layer of non-spherical magnetic or magnetizable pigment particles described herein, so that the apparatuses generate a magnetic field that acts on the pigment particles to orient them to form an optical effect layer (OEL). In an embodiment of the printing apparatuses comprising a rotating magnetic cylinder described herein, the substrate is fed by the substrate feeder under the form of sheets or a web. In an embodiment of the printing apparatuses comprising a flatbed printing unit described herein, the substrate is fed under the form of sheets.

The printing apparatuses comprising the rotating magnetic cylinder described herein or the flatbed printing unit described herein may include a coating or printing unit for applying the radiation curable coating composition comprising the non-spherical magnetic or magnetizable pigment particles described herein on the substrate described herein, the radiation curable coating composition comprising non-spherical magnetic or magnetizable pigment particles that are oriented by the magnetic-field generated by the apparatuses described herein to form an optical effect layer (OEL). In an embodiment of the printing apparatuses comprising a rotating magnetic cylinder described herein, the coating or printing unit works according to a rotary, continuous process. In an embodiment of the printing apparatuses comprising a flatbed printing unit described herein, the coating or printing unit works according to a longitudinal, discontinuous process.

The printing apparatuses comprising the rotating magnetic cylinder described herein or the flatbed printing unit described herein may include a curing unit for at least partially curing the radiation curable coating composition comprising non-spherical magnetic or magnetizable pigment particles that have been magnetically oriented by the apparatuses described herein, thereby fixing the orientation and position of the non-spherical magnetic or magnetizable pigment particles to produce an optical effect layer (OEL).

The OEL described herein may be provided directly on a substrate on which it shall remain permanently (such as for banknote applications). Alternatively, an OEL may also be provided on a temporary substrate for production purposes, from which the OEL is subsequently removed. This may for example facilitate the production of the OEL, particularly while the binder material is still in its fluid state. Thereafter, after at least partially curing the coating composition for the production of the OEL, the temporary substrate may be removed from the OEL.

Alternatively, an adhesive layer may be present on the OEL or may be present on the substrate comprising an optical effect layer (OEL), said adhesive layer being on the side of the substrate opposite the side where the OEL is provided or on the same side as the OEL and on top of the OEL. Therefore an adhesive layer may be applied to the optical effect layer (OEL) or to the substrate. Such an article may be attached to all kinds of documents or other articles or items without printing or other processes involving machinery and rather high effort. Alternatively, the substrate described herein comprising the OEL described herein may be in the form of a transfer foil, which can be applied to a document or to an article in a separate transfer step. For this purpose, the substrate is provided with a release coating, on which the OEL are produced as described herein. One or more adhesive layers may be applied over the so produced OEL.

Also described herein are substrates comprising more than one, i.e. two, three, four, etc. optical effect layers (OEL) obtained by the process described herein.

Also described herein are articles, in particular security documents, decorative elements or objects, comprising the optical effect layer (OEL) produced according to the present invention. The articles, in particular security documents, decorative elements or objects, may comprise more than one (for example two, three, etc.) OELs produced according to the present invention.

As mentioned hereabove, the optical effect layer (OEL) produced according to the present invention may be used for decorative purposes as well as for protecting and authenticating a security document. Typical examples of decorative elements or objects include without limitation luxury goods, cosmetic packaging, automotive parts, electronic/electrical appliances, furniture and fingernail lacquers.

Security documents include without limitation value documents and value commercial goods. Typical example of value documents include without limitation banknotes, deeds, tickets, checks, vouchers, fiscal stamps and tax labels, agreements and the like, identity documents such as passports, identity cards, visas, driving licenses, bank cards, credit cards, transactions cards, access documents or cards, entrance tickets, public transportation tickets or titles and the like, preferably banknotes, identity documents, right-conferring documents, driving licenses and credit cards. The term "value commercial good" refers to packaging materials, in particular for cosmetic articles, nutraceutical articles, pharmaceutical articles, alcohols, tobacco articles, beverages or foodstuffs, electrical/electronic articles, fabrics or jewelry, i.e. articles that shall be protected against counterfeiting and/or illegal reproduction in order to warrant the content of the packaging like for instance genuine drugs. Examples of these packaging materials include without limitation labels, such as authentication brand labels, tamper evidence labels and seals. It is pointed out that the disclosed substrates, value documents and value commercial goods are given exclusively for exemplifying purposes, without restricting the scope of the invention.

Alternatively, the optical effect layer (OEL) may be produced onto an auxiliary substrate such as for example a security thread, security stripe, a foil, a decal, a window or a label and consequently transferred to a security document in a separate step.

EXAMPLES

Apparatuses depicted in FIG. 1A-12A were used to orient non-spherical optically variable magnetic pigment particles in a printed layer of the UV-curable screen printing ink described in Table 1 so as to produce the optical effect layers (OELs) depicted in FIG. 1C-12C. The UV-curable screen printing ink was applied by hand on a black commercial paper as the substrate, using a T90 silkscreen. The paper substrate carrying the applied layer of the UV-curable screen printing ink was disposed on a magnetic-field-generating device (FIG. 1A-12A). The so-obtained magnetic orientation pattern of the non-spherical optically variable pigment particles was, partially simultaneously to the orientation step, fixed by UV-curing the printed layer comprising the pigment particles using a UV-LED-lamp from Phoseon (Type FireFlex 50×75 mm, 395 nm, 8 W/cm$^2$).

TABLE 1

| UV-curable screen printing ink: | |
|---|---|
| Epoxyacrylate oligomer | 36% |
| Trimethylolpropane triacrylate monomer | 13.5% |
| Tripropyleneglycol diacrylate monomer | 20% |
| Genorad ™ 16 (Rahn) | 1% |
| Aerosil ® 200 (Evonik) | 1% |
| Speedcure TPO-L (Lambson) | 2% |
| IRGACURE ® 500 (BASF) | 6% |
| Genocure EPD (Rahn) | 2% |
| Tego ® Foamex N (Evonik) | 2% |
| Non-spherical optically variable magnetic pigment particles (7 layers)(*) | 16.5% |

(*)gold-to-green optically variable magnetic pigment particles having a flake shape of diameter d50 about 9 μm and thickness about 1 μm, obtained from Viavi Solutions, Santa Rosa, CA.

In Examples 1-12, the supporting matrix (x34, e.g. 134, 234,...,1234) had a length (L4) of about 30 mm, a width (L5) of about 30 mm and a thickness (L6) of about 3 mm and were made of POM. The surface of the supporting matrix (134, 234, 334, 434, 534, 634, 734, 834, 934, 1034, 1134, 1234) comprised grooves having a depth of about 2 mm for receiving the loop-shaped magnetic-field generating device (131, 231, 331, 431, 531, 631, 731, 831, 931, 1031, 1131, 1231), the one or more dipole magnets (132, 232, 332, 432, 532, 632, 732, 832, 932, 1032, 1132, 1232) and/or the loop-shaped pole piece (533, 633, 733, 833, 933, 1033, 1133, 1233) as illustrated schematically in FIG. 1B1-12B1 and in FIG. 1B2-12B2. Examples 1-12 comprised a loop-shaped dipole magnet (131, 231, 331, 431, 531, 631, 731, 831, 931, 1031, 1131, 1231) which were symmetrically disposed within the supporting matrix (134, 234, 334, 434, 534, 634, 734, 834, 934, 1034, 1134, 1234). Examples 6-12 comprised a loop-shaped pole piece (533, 633, 733, 833, 933, 1033, 1133, 1233) which were symmetrically disposed within the supporting matrix (134, 234, 334, 434, 534, 634, 734, 834, 934, 1034, 1134, 1234).

Example 1 (FIG. 1A-1C)

The apparatus used to prepare Example 1 comprised a magnetic assembly (130) being disposed between a magnetic-field generating device (140) and the substrate (120) carrying the coating composition (110) comprising the non-spherical magnetic or magnetizable pigment particles as illustrated in FIG. 1A.

The magnetic assembly (130) comprised a ring-shaped dipole magnet (131), a dipole magnet (132) and a supporting matrix (134).

The ring-shaped dipole magnet (131) had an external diameter (L7) of about 26 mm, an internal diameter (L8) of about 16.5 mm and a thickness (L10) of about 2 mm. The magnetic axis of the a ring-shaped dipole magnet (131) was substantially perpendicular to the magnetic axis of the magnetic-field generating device (140) and substantially perpendicular to the substrate (120) surface, with the North pole facing the substrate (120). The ring-shaped dipole magnet (131) was made of NdFeB N40.

The dipole magnet (132) had an external diameter (L9) of about 4 mm, and a thickness (L11) of about 2 mm. The magnetic axis of the dipole magnet (132) was substantially perpendicular to the magnetic axis of the magnetic-field generating device (140) and substantially perpendicular to the substrate (120) surface, with its South pole facing the substrate (120). The dipole magnet (132) was made of NdFeB N45.

The magnetic-field generating device (140) was made of a bar dipole magnet having a length (L2) of about 30 mm, a width (L1) of about 30 mm and a thickness (L3) of about 4 mm. The magnetic axis of the magnetic-field generating device (140) was substantially parallel to the substrate (120) surface. The magnetic-field generating device (140) was made of NdFeB N30.

The magnetic assembly (130) and the magnetic-field generating device (140) were in direct contact, i.e. the distance (d) between the lower surface of the magnetic assembly (130) and the upper surface of the magnetic-field generating device (140) was about 0 mm (not shown true to scale in FIG. 1A for the clarity of the drawing). The magnetic assembly (130) and the magnetic-field generating device (140) were centered relative to each other, i.e. the midsection of the length (L4) and of the width (L5) of the magnetic assembly (130) was aligned with the midsection of the length (L2) and of the width (L1) of the magnetic-field generating device (140). The distance (h) between the upper surface of the magnetic assembly (130) and the surface of the substrate (120) facing the magnetic assembly (130) was about 5 mm.

The resulting OEL produced with the apparatus illustrated in FIG. 1A-B is shown in FIG. 1C at different viewing angles by tilting the substrate (120) between −30° and +20°.

Example 2 (FIG. 2A-2C)

The apparatus used to prepare Example 2 comprised a magnetic assembly (230) being disposed between a magnetic-field generating device (240) and the substrate (220) carrying the coating composition (210) comprising the non-spherical magnetic or magnetizable pigment particles as illustrated schematically in FIG. 2A.

The magnetic assembly (230) comprised a ring-shaped dipole magnet (231), a dipole magnet (232) and a supporting matrix (234).

The ring-shaped dipole magnet (231) had an external diameter (L7) of about 26 mm, an internal diameter (L8) of about 16.5 mm and a thickness (L10) of about 2 mm. The magnetic axis of the ring-shaped dipole magnet (231) was substantially perpendicular to the magnetic axis of the magnetic-field generating device (240) and substantially perpendicular to the substrate (220) surface, with the North pole facing the substrate (220). The ring-shaped dipole magnet (231) was made of NdFeB N40.

The dipole magnet (232) had an external diameter (L9) of about 4 mm, and a thickness (L11) of about 2 mm. The magnetic axis of the dipole magnet (232) was substantially perpendicular to the magnetic axis of the magnetic-field generating device (240) and substantially perpendicular to the substrate (220) surface, with its North pole facing the substrate (220). The dipole magnet (232) was made of NdFeB N45.

The magnetic-field generating device (240) was a bar dipole magnet having a length (L1) of about 60 mm, a width (L2) of about 30 mm and a thickness (L3) of about 4 mm. The magnetic axis of the magnetic-field generating device (240) was substantially parallel to the substrate (220) surface. The magnetic-field generating device (240) was made of NdFeB N30.

The magnetic assembly (230) and the magnetic-field generating device (240) were in direct contact, i.e. the distance (d) between the lower surface of the magnetic assembly (230) and the upper surface of the magnetic-field generating device (240) was about 0 mm (not shown true to scale in FIG. 2A for the clarity of the drawing). The magnetic assembly (230) and the magnetic-field generating device (240) were centrally aligned relative to each other, i.e. the midsection of the length (L4) and of the width (L5) of the magnetic assembly (230) was aligned with the midsection of the length (L2) and of the width (L1) of the magnetic-field generating device (240). The distance (h) between the upper surface of the magnetic assembly (230) and the surface of the substrate (220) facing the magnetic assembly (230) was about 3 mm.

The resulting OEL produced with the apparatus illustrated in FIG. 2A-B is shown in FIG. 2C at different viewing angles by tilting the substrate (220) between −20° and +30°.

Example 3 (FIG. 3A-3C)

The magnetic apparatus used to prepare Example 3 comprised a magnetic assembly (330) being disposed between a magnetic-field generating device (340) and the substrate (320) carrying the coating composition (310) comprising the non-spherical magnetic or magnetizable pigment particles as illustrated schematically in FIG. 3A.

The magnetic assembly (330) comprised a loop-shaped magnetic-field generating device (331), a dipole magnet (332) and a supporting matrix (334).

The ring-shaped dipole magnet (331) had an external diameter (L7) of about 26 mm, an internal diameter (L8) of about 16.5 mm and a thickness (L10) of about 2 mm. The magnetic axis of the ring-shaped dipole magnet (331) was substantially perpendicular to the magnetic axis of the magnetic-field generating device (340) and substantially perpendicular to the substrate (320) surface, with the South pole facing the substrate (320). The ring-shaped dipole magnet (331) was made of NdFeB N40.

The dipole magnet (332) had an external diameter (L9) of about 4 mm and a thickness (L11) of about 2 mm. The magnetic axis of the dipole magnet (332) was substantially perpendicular to the magnetic axis of the magnetic-field generating device (340) and substantially perpendicular to the substrate (320) surface, with its South pole facing the substrate (320). The center of the dipole magnet (332) is placed at a distance (L12) being about 17 mm from the edge of the supporting matrix (334). The dipole magnet (332) was made of NdFeB N45.

The magnetic-field generating device (340) comprised seven bar dipole magnets (341) and six spacer pieces (342). The seven bar dipole magnets (341) and the six spacer pieces (342) were disposed in an alternating manner as shown in FIG. 3A. Each of the bar dipole magnet (341) had a length (L1) of about 30 mm, a width (L2*a*) of about 3 mm and a thickness (L3) of about 6 mm. Each of the spacer pieces (342) had each a length of about 20 mm, a width (L2*b*) of about 1.5 mm and a thickness (L3) of about 6 mm. Each of the bar dipole magnet (341) had a magnetic axis substantially parallel to the substrate (320) surface. The bar dipole magnets (341) were made of NdFeB N42. The spacer pieces (342) were made of POM.

The magnetic assembly (330) and the magnetic-field generating device (340) were in direct contact, i.e. the distance (d) between the lower surface of the magnetic assembly (330) and the upper surface of the magnetic-field generating device (340) was about 0 mm (not shown true to scale in FIG. 3A for the clarity of the drawing). The magnetic assembly (330) and the magnetic-field generating device (340) were centrally aligned relative to each other, i.e. the midsection of the length (L4) and of the width (L5) of the magnetic assembly (330) was aligned with the midsection of the length (L2) and of the width (L1) of the magnetic-field generating device (340). The distance (h) between the upper surface of the magnetic assembly (330) and the surface of the substrate (320) facing the magnetic assembly (330) was about 4 mm.

The resulting OEL produced with the apparatus illustrated in FIG. 3A-B is shown in FIG. 3C at different viewing angles by tilting the substrate (320) between −20° and +30°.

Example 4 (FIG. 4A-4C)

The apparatus used to prepare Example 4 comprised a magnetic assembly (430) being disposed between a magnetic-field generating device (440) and the substrate (420) carrying the coating composition (410) comprising the non-spherical magnetic or magnetizable pigment particles as illustrated schematically in FIG. 4A.

The magnetic assembly (430) comprised a ring-shaped dipole magnet (431), five dipole magnets (432) and a supporting matrix (434).

The ring-shaped dipole magnet (431) had an external diameter (L7) of about 26 mm, an internal diameter (L8) of about 16.5 mm and a thickness (L10) of about 2 mm. The magnetic axis of the ring-shaped dipole magnet (431) was substantially perpendicular to the magnetic axis of the magnetic-field generating device (440) and substantially perpendicular to the substrate (420) surface, with the North pole facing the substrate (420). The ring-shaped dipole magnet (431) was made of NdFeB N40.

Each of the five dipole magnets (432) had an external diameter (L9) of about 2 mm, and a thickness (L11) of about 2 mm. Each of the five dipole magnets (432) had a magnetic axis substantially perpendicular to the magnetic axis of the magnetic-field generating device (440) and substantially perpendicular to the substrate (420) surface, with the North pole of each of the five dipole magnets (432) facing the substrate (420). The five dipole magnets (432) were disposed so as to form an X-cross as illustrated in FIG. 4B1. The dipole magnet disposed at the center of the X-cross was located at a distance (L13) being about 2.5 mm and (L14) being about 2.5 mm from the dipole magnets disposed at the extremities of the X-cross. The center of the dipole magnet disposed at the center of the X-cross was located at a distance ((L13)+(L12)) being about 17.5 mm from the edge of the supporting matrix (434) as illustrated in FIG. 4B1. The five dipole magnets (432) were made of NdFeB N45.

The magnetic-field generating device (440) comprised eight bar dipole magnets (441) and six spacer pieces (442). The eight bar dipole magnets (441) and the six spacer pieces (442) were disposed in an alternating non-symmetrical manner as shown in FIG. 4A, i.e. two bar dipole magnets (441)

were in direct contact and adjacent to a spacer piece (442), the other six bar dipole magnets being each alternated with a spacer piece (442). The eight bar dipole magnets (441) had each a length (L1) of about 30 mm, a width (L2*a*) of about 3 mm and a thickness (L3) of about 6 mm. Each of the six spacer pieces (442) had length of about 30 mm, a width (L2*b*) of about 1 mm and a thickness (L3) of about 6 mm. The magnetic axis of each of the eight bar dipole magnets (441) was substantially parallel to the substrate (420) surface. The eight bar dipole magnets (441) were made of NdFeB N42. The six spacer pieces (442) were made of POM.

The magnetic assembly (430) and the magnetic-field generating device (440) were in direct contact, i.e. the distance (d) between the lower surface of the magnetic assembly (430) and the upper surface of the magnetic-field generating device (440) was about 0 mm (not shown true to scale in FIG. 4A for the clarity of the drawing). The magnetic assembly (430) and the magnetic-field generating device (440) were centrally aligned relative to each other, i.e. the midsection of the length (L4) and of the width (L5) of the magnetic assembly (430) was aligned with the midsection of the length (L2) and of the width (L1) of the magnetic-field generating device (440). The distance (h) between the upper surface of the magnetic assembly (430) and the surface of the substrate (420) facing the magnetic assembly (430) was about 4 mm.

The resulting OEL produced with the apparatus illustrated in FIG. 4A-B is shown in FIG. 4C at different viewing angles by tilting the substrate (420) between −30° and +20°.

Example 5 (FIG. 5A-5C)

The apparatus used to prepare Example 5 comprised a magnetic assembly (530) being disposed between a magnetic-field generating device (540) and the substrate (520) carrying the coating composition (510) comprising the non-spherical magnetic or magnetizable pigment particles as illustrated schematically in FIG. 5A.

The magnetic assembly (530) comprised a ring-shaped dipole magnet (531), five dipole magnets (532) and a supporting matrix (534).

The ring-shaped dipole magnet (531) had an external diameter (L7) of about 26 mm, an internal diameter (L8) of about 16.5 mm and a thickness (L10) of about 2 mm. The magnetic axis of the loop-shaped magnetic-field generating device (531) was substantially perpendicular to the magnetic axis of the magnetic-field generating device (540) and substantially perpendicular to the substrate (520) surface, with the North pole facing the substrate (520). The ring-shaped dipole magnet (531) was made of NdFeB N40.

Each of the five dipole magnets (532) had an external diameter (L9) of about 2 mm, and a thickness (L11) of about 2 mm. Each of the five dipole magnets (532) had a magnetic axis substantially perpendicular to the magnetic axis of the magnetic-field generating device (540) and substantially perpendicular to the substrate (520) surface, with the South pole of each of the five dipole magnets (532) facing the substrate (520). The five dipole magnets (532) were disposed so as to form an X-cross as illustrated in FIG. 5131. The center of the dipole magnet (532) disposed at the center of the X-cross was located at a distance (L13) being about 2.5 mm and (L14) being about 2.5 mm from the dipole magnets disposed at the extremities of the X-cross. The dipole magnet (532) disposed at the center of the X-cross was located at a distance ((L13)+(L12)) being about 15 mm from the edge of the supporting matrix (534) as illustrated in FIG. 5B1. The five dipole magnets (532) were made of NdFeB N45.

The magnetic-field generating device (540) comprised seven bar dipole magnets (541) and six spacer pieces (542). The seven bar dipole magnets (541) and the six spacer pieces (542) were disposed in an alternating non-symmetrical manner as shown in FIG. 5A, i.e. two bar dipole magnets (541) were in direct contact and adjacent to a spacer piece (542), the other five bar dipole magnets being each alternated with a spacer piece (542). The sixth spacer piece (542) was used to ensure the right positioning of the magnetic-field generating device (540) below the magnetic assembly (530). The seven bar dipole magnets (541) had each a length (L1) of about 30 mm, a width (L2*a*) of about 3 mm and a thickness (L3) of about 6 mm. Each of the six spacer pieces (542) had each a length of about 20 mm, a width (L2*b*) of about 1.5 mm and a thickness (L3) of about 6 mm. The magnetic axis of each of the seven bar dipole magnets (541) was substantially parallel to the substrate (520) surface. The seven bar dipole magnets (541) were made of NdFeB N42. The six spacer pieces (542) were made of POM.

The magnetic assembly (530) and the magnetic-field generating device (540) were in direct contact, i.e. the distance (d) between the lower surface of the magnetic assembly (530) and the upper surface of the magnetic-field generating device (540) was about 0 mm (not shown true to scale in FIG. 5A for the clarity of the drawing). The magnetic assembly (530) and the magnetic-field generating device (540) were centrally aligned relative to each other, i.e. the midsection of the length (L4) and of the width (L5) of the magnetic assembly (530) was aligned with the midsection of the length (L2) and of the width (L1) of the magnetic-field generating device (540). The distance (h) between the upper surface of the magnetic assembly (530) and the surface of the substrate (520) facing the magnetic assembly (530) was about 4 mm.

The resulting OEL produced with the apparatus illustrated in FIG. 5A-B is shown in FIG. 5C at different viewing angles by tilting the substrate (520) between −30° and +20°.

Example 6 (FIG. 6A-6C)

The apparatus used to prepare Example 6 comprised a magnetic assembly (630) being disposed between a magnetic-field generating device (640) and the substrate (620) carrying the coating composition (610) comprising the non-spherical magnetic or magnetizable pigment particles as illustrated schematically in FIG. 6A.

The magnetic assembly (630) comprised a ring-shaped dipole magnet (631), a loop-shaped pole piece (633) and a supporting matrix (634).

The ring-shaped dipole magnet (631) had an external diameter (L7) of about 26 mm, an internal diameter (L8) of about 16.5 mm and a thickness (L10) of about 2 mm. The ring-shaped dipole magnet (631) had a magnetic axis substantially perpendicular to the magnetic axis of the magnetic-field generating device (640) and substantially perpendicular to the substrate (620) surface, with the South pole facing the substrate (620). The ring-shaped dipole magnet (631) was made of NdFeB N40.

The loop-shaped pole piece (633) had an external diameter (L15) of about 14 mm, an internal diameter (L16) of about 10 mm and a thickness (L17) of about 2 mm. The loop-shaped pole piece (633) was centrally aligned with the loop-shaped magnetic-field generating device (631). The loop-shaped pole piece (633) was made of iron.

The magnetic-field generating device (640) comprised seven bar dipole magnets (641) and six spacer pieces (642). The seven bar dipole magnets (641) and the six spacer pieces (642) were disposed in an alternating non-symmetrical manner as shown in FIG. 6A, that is two bar dipole magnets (641) were in direct contact and adjacent to a spacer piece (642), the other five bar dipole magnets being each alternated with a spacer piece (642). The sixth spacer piece (642) was used to ensure the right positioning of the magnetic-field generating device (640) below the magnetic assembly (630). The seven bar dipole magnets (641) had each a length (L1) of about 30 mm, a width (L2*a*) of about 3 mm and a thickness (L3) of about 6 mm. Each of the six spacer pieces (642) had a length of about 20 mm, a width (L2*b*) of about 1.5 mm and a thickness (L3) of about 6 mm. The magnetic axis of each of the seven bar dipole magnets (641) was substantially parallel to the substrate (620) surface. The seven bar dipole magnets (641) were made of NdFeB N42. The six spacer pieces (642) were made of POM.

The magnetic assembly (630) and the magnetic-field generating device (640) were in direct contact, i.e. the distance (d) between the lower surface of the magnetic assembly (630) and the upper surface of the magnetic-field generating device (640) was about 0 mm (not shown true to scale in FIG. 6A for the clarity of the drawing). The magnetic assembly (630) and the magnetic-field generating device (640) were centrally aligned relative to each other, i.e. the midsection of the length (L4) and of the width (L5) of the magnetic assembly (630) was aligned with the midsection of the length (L2) and of the width (L1) of the magnetic-field generating device (640). The distance (h) between the upper surface of the magnetic assembly (630) and the surface of the substrate (620) facing the magnetic assembly (630) was about 4 mm.

The resulting OEL produced with the apparatus illustrated in FIG. 6A-B is shown in FIG. 6C at different viewing angles by tilting the substrate (620) between −30° and +20°.

Example 7 (FIG. 7A-7C)

The apparatus used to prepare Example 7 comprised a magnetic assembly (730) being disposed between a magnetic-field generating device (740) and the substrate (720) carrying the coating composition (710) comprising the non-spherical magnetic or magnetizable pigment particles as illustrated schematically in FIG. 7A.

The magnetic assembly (730) comprised a ring-shaped magnetic-field generating device (731), a dipole magnet (732), a ring-shaped pole piece (733) and a supporting matrix (734).

The ring-shaped magnetic-field generating device (731) had an external diameter (L7) of about 26 mm, an internal diameter (L8) of about 16.5 mm and a thickness (L10) of about 2 mm. The ring-shaped magnetic-field generating device (731) had a magnetic axis substantially perpendicular to the magnetic axis of the magnetic-field generating device (740) and substantially perpendicular to the substrate (720) surface, with the South pole facing the substrate (720). The ring-shaped magnetic-field generating device (731) was made of NdFeB N40.

The dipole magnet (732) had an external diameter (L9) of about 4 mm, and a thickness (L11) of about 2 mm. The dipole magnet (732) had a magnetic axis substantially perpendicular to the magnetic axis of the magnetic-field generating device (740), and substantially perpendicular to the substrate (720) surface, with its South pole facing the substrate (720). The dipole magnet (732) was made of NdFeB N45.

The ring-shaped pole piece (733) had an external diameter (L15) of about 14 mm, an internal diameter (L16) of about 10 mm and a thickness (L17) of about 2 mm. The ring-shaped pole piece (733) was centrally aligned with the ring-shaped magnetic-field generating device (731). The ring-shaped pole piece (733) was made of iron.

The ring-shaped magnetic-field generating device (731), the dipole magnet (732), the ring-shaped pole piece (733) and the supporting matrix (734) were centrally aligned along the length (L4) and the width (L5) of (734).

The magnetic-field generating device (740) was made of a bar dipole magnet having a length (L2) of about 30 mm, a width (L1) of about 30 mm and a thickness (L3) of about 4 mm. The magnetic axis of the magnetic-field generating device (740) was substantially parallel to the substrate (720) surface. The magnetic-field generating device (740) was made of NdFeB N30.

The magnetic assembly (730) and the magnetic-field generating device (740) were in direct contact, i.e. the distance (d) between the lower surface of the magnetic assembly (730) and the upper surface of the magnetic-field generating device (740) was about 0 mm (not shown true to scale in FIG. 7A for the clarity of the drawing). The magnetic assembly (730) and the magnetic-field generating device (740) were centrally aligned relative to each other, i.e. the midsection of the length (L4) and of the width (L5) of the magnetic assembly (730) was aligned with the midsection of the length (L2) and of the width (L1) of the magnetic-field generating device (740). The distance (h) between the upper surface of the magnetic assembly (730) and the surface of the substrate (720) facing the magnetic assembly (730) was about 4 mm.

The resulting OEL produced with the apparatus illustrated in FIG. 7A-B is shown in FIG. 7C at different viewing angles by tilting the substrate (720) between −10° and +40°.

Example 8 (FIG. 8A-8C)

The apparatus used to prepare Example 8 comprised a magnetic assembly (830) being disposed between a magnetic-field generating device (840) and the substrate (820) carrying the coating composition (810) comprising the non-spherical magnetic or magnetizable pigment particles as illustrated schematically in FIG. 8A.

The magnetic assembly (830) comprised a ring-shaped magnetic-field generating device (731), a dipole magnet (832), a ring-shaped pole piece (833) and a supporting matrix (834).

The ring-shaped magnetic-field generating device (831) had an external diameter (L7) of about 26 mm, an internal diameter (L8) of about 16.5 mm and a thickness (L10) of about 2 mm. The ring-shaped magnetic-field generating device (831) had a magnetic axis substantially perpendicular to the magnetic axis of the magnetic-field generating device (840) and substantially perpendicular to the substrate (820) surface, with the South pole facing the substrate (820). The ring-shaped magnetic-field generating device (831) was made of NdFeB N40.

The dipole magnet (832) had an external diameter (L9) of about 4 mm, and a thickness (L11) of about 2 mm. The dipole magnet (832) had a magnetic axis substantially perpendicular to the magnetic axis of the magnetic-field generating device (840), and substantially perpendicular to the substrate (820) surface, with its South pole facing the substrate (820). The dipole magnet (832) was made of NdFeB N45.

The ring-shaped pole piece (833) had an external diameter (L15) of about 14 mm, an internal diameter (L16) of about 10 mm and a thickness (L17) of about 2 mm. The ring-shaped pole piece (833) was made of iron.

The ring-shaped magnetic-field generating device (831), the dipole magnet (832), the ring-shaped pole piece (833) and the supporting matrix (834) were centrally aligned along the length (L4) and the width (L5) of (834).

The magnetic-field generating device (840) comprised seven bar dipole magnets (841) and six spacer pieces (842). The seven bar dipole magnets (841) and the six spacer pieces (842) were disposed in an alternating manner as shown in FIG. 8A. The bar dipole magnet (841) had each a length (L1) of about 30 mm, a width (L2*a*) of about 3 mm and a thickness (L3) of about 6 mm. The spacer pieces (842) had each a length of about 20 mm, a width (L2*b*) of about 1.5 mm and a thickness (L3) of about 6 mm. Each of the seven bar dipole magnets had the magnetic axis of the bar dipole magnets (841) substantially parallel to the substrate (820) surface. Each of the seven bar dipole magnets (841) was made of NdFeB N42. Each of the six spacer pieces (842) was made of POM.

The magnetic assembly (830) and the magnetic-field generating device (840) were in direct contact, i.e. the distance (d) between the upper surface of the magnetic assembly (830) and the upper surface of the magnetic-field generating device (840) was about 0 mm (not shown true to scale in FIG. 8A for the clarity of the drawing). The magnetic assembly (830) and the magnetic-field generating device (840) were centrally aligned relative to each other, i.e. the midsection of the length (L4) and of the width (L5) of the magnetic assembly (830) was aligned with the midsection of the length (L2) and of the width (L1) of the magnetic-field generating device (840). The distance (h) between the upper surface of the magnetic assembly (830) and the surface of the substrate (820) facing the magnetic assembly (830) was about 4 mm.

The resulting OEL produced with the apparatus illustrated in FIG. 8A-B is shown in FIG. 8C at different viewing angles by tilting the substrate (820) between 0° and +50°.

Example 9 (FIG. 9A-9C)

The apparatus used to prepare Example 9 comprised a magnetic assembly (930) being disposed between a magnetic-field generating device (940) and the substrate (920) carrying the coating composition (910) comprising the non-spherical magnetic or magnetizable pigment particles as illustrated schematically in FIG. 9A.

The magnetic assembly (930) comprised a ring-shaped magnetic-field generating device (931), a dipole magnet (932), a ring-shaped pole piece (933) and a supporting matrix (934).

The ring-shaped magnetic-field generating device (931) had an external diameter (L7) of about 26 mm, an internal diameter (L8) of about 16.5 mm and a thickness (L10) of about 2 mm. The magnetic axis of the ring-shaped magnetic-field generating device (931) was substantially perpendicular to the magnetic axis of the magnetic-field generating device (940) and substantially perpendicular to the substrate (920) surface, with the South pole facing the substrate (920). The ring-shaped magnetic-field generating device (931) was made of NdFeB N40.

The dipole magnet (932) had an external diameter (L9) of about 4 mm, and a thickness (L11) of about 2 mm. The magnetic axis of the dipole magnet (932) was substantially perpendicular to the magnetic axis of the magnetic-field generating device (940) and substantially perpendicular to the substrate (920) surface, with the South pole facing the substrate (920). The dipole magnet (932) was made of NdFeB N45.

The ring-shaped pole piece (933) had an external diameter (L15) of about 14 mm, an internal diameter (L16) of about 10 mm and a thickness (L17) of about 2 mm. The ring-shaped pole piece (933) was made of iron.

The ring-shaped magnetic-field generating device (931), the ring-shaped pole piece (933) and the supporting matrix (934) were centrally aligned along the length (L4) and the width (L5) of the supporting matrix (934). The dipole magnet (932) was centrally aligned along the length (L4); the center of the dipole magnet (932) was located at a distance (L12) of about 17 mm from the edge of the supporting matrix along the width (L5).

The magnetic-field generating device (940) was made of a bar dipole magnet having a length (L2) of about 30 mm, a width (L1) of about 30 mm and a thickness (L3) of about 4 mm. The magnetic axis of the magnetic-field generating device (940) was substantially parallel to the substrate (920) surface. The magnetic-field generating device (940) was made of NdFeB N30.

The magnetic assembly (930) and the magnetic-field generating device (940) were in direct contact, i.e. the distance (d) between the lower surface of the magnetic assembly (930) and the upper surface of the magnetic-field generating device (940) was about 0 mm (not shown true to scale in FIG. 9A for the clarity of the drawing). The magnetic assembly (930) and the magnetic-field generating device (940) were centered relative to each other, i.e. the midsection of the length (L4) and of the width (L5) of the magnetic assembly (930) was aligned with the midsection of the length (L2) and of the width (L1) of the magnetic-field generating device (940). The distance (h) between the upper surface of the magnetic assembly (930) and the surface of the substrate (920) facing the magnetic assembly (930) was about 4 mm.

The resulting OEL produced with the apparatus illustrated in FIG. 9A-B is shown in FIG. 9C at different viewing angles by tilting the substrate (920) between −20° and +30°.

Example 10 (FIG. 10A-10C)

The apparatus used to prepare Example 10 comprised a magnetic assembly (1030) being disposed between a magnetic-field generating device (1040) and the substrate (1020) carrying the coating composition (1010) comprising the non-spherical magnetic or magnetizable pigment particles as illustrated schematically in FIG. 10A.

The magnetic assembly (1030) comprised a ring-shaped magnetic-field generating device (1031), a dipole magnet (1032), a ring-shaped pole piece (1033) and a supporting matrix (1034).

The ring-shaped magnetic-field generating device (1031) had an external diameter (L7) of about 26 mm, an internal diameter (L8) of about 16.5 mm and a thickness (L10) of about 2 mm. The magnetic axis of the ring-shaped magnetic-field generating device (1031) was substantially perpendicular to the magnetic axis of the magnetic-field generating device (1040) and substantially perpendicular to the substrate (1020) surface, with the South pole facing the substrate (1020). The ring-shaped magnetic-field generating device (1031) was made of NdFeB N40.

The dipole magnet (1032) had an external diameter (L9) of about 4 mm, and a thickness (L11) of about 2 mm. The magnetic axis of the dipole magnet (1032) was substantially perpendicular to the magnetic axis of the magnetic-field generating device (1040) and substantially perpendicular to the substrate (1020) surface, with the South pole facing the substrate (1020). The dipole magnet (1032) was made of NdFeB N45.

The ring-shaped pole piece (1033) had an external diameter (L15) of about 14 mm, an internal diameter (L16) of about 10 mm and a thickness (L17) of about 2 mm. The ring-shaped pole piece (1033) was made of iron.

The ring-shaped magnetic-field generating device (1031), the ring-shaped pole piece (1033) and the supporting matrix (1034) were centrally aligned along the length (L4) and the width (L5) of the supporting matrix (1034). The dipole magnet (1032) was centrally aligned along the length (L4); the center of the dipole magnet (1032) was located at a distance (L12) of about 17 mm from the edge of the supporting matrix along the width (L5).

The magnetic-field generating device (1040) comprised seven bar dipole magnets (1041) and six spacer pieces (1042). The seven bar dipole magnets (1041) and the six spacer pieces (1042) were disposed in an alternating manner as shown in FIG. 10A. Each of the bar dipole magnet (1041) had a length (L1) of about 30 mm, a width (L2*a*) of about 3 mm and a thickness (L3) of about 6 mm. Each of the spacer pieces (1042) had each a length of about 20 mm, a width (L2*b*) of about 1.5 mm and a thickness (L3) of about 6 mm. Each of the bar dipole magnet (1041) had a magnetic axis substantially parallel to the substrate (1020) surface. The bar dipole magnets (1041) were made of NdFeB N42. The spacer pieces (1042) were made of POM.

The magnetic assembly (1030) and the magnetic-field generating device (1040) were in direct contact, i.e. the distance (d) between the lower surface of the magnetic assembly (1030) and the upper surface of the magnetic-field generating device (1040) was about 0 mm (not shown true to scale in FIG. 10A for the clarity of the drawing). The magnetic assembly (1030) and the magnetic-field generating device (1040) were centrally aligned relative to each other, i.e. the midsection of the length (L4) and of the width (L5) of the magnetic assembly (1030) was aligned with the midsection of the length (L2) and of the width (L1) of the magnetic-field generating device (1040). The distance (h) between the upper surface of the magnetic assembly (1030) and the surface of the substrate (1020) facing the magnetic assembly (1030) was about 4 mm.

The resulting OEL produced with the magnetic assembly illustrated in FIG. 10A is shown in FIG. 10C at different viewing angles by tilting the substrate (1020) between −20° and +30°.

Example 11 (FIG. 11A-11C)

The apparatus used to prepare Example 11 comprised a magnetic assembly (1130) being disposed between a magnetic-field generating device (1140) and the substrate (1120) carrying the coating composition (1110) comprising the non-spherical magnetic or magnetizable pigment particles as illustrated schematically in FIG. 11A.

The magnetic assembly (1130) comprised a ring-shaped magnetic-field generating device (1131), a dipole magnet (1132), a ring-shaped pole piece (1133) and a supporting matrix (1134).

The ring-shaped magnetic-field generating device (1131) had an external diameter (L7) of about 26 mm, an internal diameter (L8) of about 16.5 mm and a thickness (L10) of about 2 mm. The magnetic axis of the ring-shaped magnetic-field generating device (1131) was substantially perpendicular to the magnetic axis of the magnetic-field generating device (1140) and substantially perpendicular to the substrate (1120) surface, with the South pole facing the substrate (1120). The ring-shaped magnetic-field generating device (1131) was made of NdFeB N40.

The dipole magnet (1132) had an external diameter (L9) of about 4 mm, and a thickness (L11) of about 2 mm. The magnetic axis of the dipole magnet (1132) was substantially perpendicular to the magnetic axis of the magnetic-field generating device (1140), substantially perpendicular to the substrate (1120) surface, with the North pole facing the substrate (1120). The dipole magnet (1132) was made of NdFeB N45.

The ring-shaped pole piece (1133) had an external diameter (L15) of about 14 mm, an internal diameter (L16) of about 10 mm and a thickness (L17) of about 2 mm. The ring-shaped pole piece (1133) was made of iron.

The ring-shaped magnetic-field generating device (1131), the ring-shaped pole piece (1133) and the supporting matrix (1134) were centrally aligned along the length (L4) and the width (L5) of the supporting matrix (1134). The dipole magnet (1132) was centrally aligned along the length (L4); the center of the dipole magnet (1132) was located at a distance (L12) of about 17 mm from the edge of the supporting matrix along the width (L5).

The magnetic-field generating device (1140) comprised seven bar dipole magnets (1141) and six spacer pieces (1142). The seven bar dipole magnets (1141) and the six spacer pieces (1142) were disposed in an alternating manner as shown in FIG. 11A. Each of the bar dipole magnet (1141) had a length (L1) of about 30 mm, a width (L2*a*) of about 3 mm and a thickness (L3) of about 6 mm. Each of the spacer pieces (1142) had each a length of about 20 mm, a width (L2*b*) of about 1.5 mm and a thickness (L3) of about 6 mm. Each of the bar dipole magnet (1141) had a magnetic axis substantially parallel to the substrate (1120) surface. The bar dipole magnets (1141) were made of NdFeB N42. The spacer pieces (1142) were made of POM.

The magnetic assembly (1130) and the magnetic-field generating device (1140) were in direct contact, i.e. the distance (d) between the lower surface of the magnetic assembly (1130) and the upper surface magnetic-field generating device (1140) was about 0 mm (not shown true to scale in FIG. 11A for the clarity of the drawing). The magnetic assembly (1130) and the magnetic-field generating device (1140) were centered relative to each other, i.e. the midsection of the length (L4) and of the width (L5) of the magnetic assembly (1130) was aligned with the midsection of the length (L2) and of the width (L1) of the magnetic-field generating device (1140). The distance (h) between the upper surface of the magnetic assembly (1130) and the surface of the substrate (1120) facing the magnetic assembly (1130) was about 4 mm.

The resulting OEL produced with the apparatus illustrated in FIG. 11A is shown in FIG. 11C at different viewing angles by tilting the substrate (1120) between −30° and +20°.

Example 12 (FIG. 12A-12C)

The apparatus used to prepare Example 12 comprised a magnetic assembly (1230) being disposed between a magnetic-field generating device (1240) and the substrate (1220)

carrying the coating composition (1210) comprising the non-spherical magnetic or magnetizable pigment particles as illustrated schematically in FIG. 12A.

The magnetic assembly (1230) comprised a ring-shaped magnetic-field generating device (1231), a dipole magnet (1232), a ring-shaped pole piece (1233) and a supporting matrix (1234).

The ring-shaped magnetic-field generating device (1231) had an external diameter (L7) of about 26 mm, an internal diameter (L8) of about 16.5 mm and a thickness (L10) of about 2 mm. The magnetic axis of the loop-shaped magnetic-field generating device (1231) was substantially perpendicular to the magnetic axis of the magnetic-field generating device (1240) and substantially perpendicular to the substrate (1220) surface, with the North pole facing the substrate (1220). The ring-shaped magnetic-field generating device (1231) was made of NdFeB N40.

The dipole magnet (1232) had an external diameter (L9) of about 4 mm, and a thickness (L11) of about 2 mm. The magnetic axis of the dipole magnet (1232) was substantially perpendicular to the magnetic axis of the magnetic-field generating device (1240), substantially perpendicular to the substrate (1220) surface, with the South pole facing the substrate (1220). The dipole magnet (1232) was made of NdFeB N45.

The ring-shaped pole piece (1233) had an external diameter (L15) of about 14 mm, an internal diameter (L16) of about 10 mm and a thickness (L17) of about 2 mm. The ring-shaped pole piece (1233) was made of iron.

The ring-shaped magnetic-field generating device (1231), the ring-shaped pole piece (1233) and the supporting matrix (1234) were centrally aligned along the length (L4) and the width (L5) of the supporting matrix (1234). The dipole magnet (1232) was centrally aligned along the length (L4); the center of the dipole magnet (1232) was located at a distance (L12) of about 17 mm from the edge of the supporting matrix along the width (L5).

The magnetic-field generating device (1240) comprised seven bar dipole magnets (1241) and six spacer pieces (1242). The seven bar dipole magnets (1241) and the six spacer pieces (1242) were disposed in an alternating non-symmetrical manner as shown in FIG. 5A, i.e. two bar dipole magnets (1241) were in direct contact and adjacent to a spacer piece (1242), the other five bar dipole magnets being each alternated with a spacer piece (1242). The sixth spacer piece (1242) was used to ensure the right positioning of the magnetic-field generating device (1240) below the magnetic assembly (1230). The seven bar dipole magnets (1241) had each a length (L1) of about 30 mm, a width (L2*a*) of about 6 mm and a thickness (L3) of about 6 mm. Each of the six spacer pieces (1242) had each a length of about 20 mm, a width (L2*b*) of about 1.5 mm and a thickness (L3) of about 6 mm. The magnetic axis of each of the seven bar dipole magnets (1241) was substantially parallel to the substrate (1220) surface. The seven bar dipole magnets (1241) were made of NdFeB N42. The five spacer pieces (1242) were made of POM.

The magnetic assembly (1230) and the magnetic-field generating device (1240) were in direct contact, i.e. the distance (d) between the lower surface of the magnetic assembly (1230) and the upper surface of the magnetic-field generating device (1240) was about 0 mm (not shown true to scale in FIG. 12A for the clarity of the drawing). The magnetic assembly (1230) and the magnetic-field generating device (1240) were centrally aligned relative to each other, i.e. the midsection of the length (L4) and of the width (L5) of the magnetic assembly (1230) was aligned with the midsection of the length (L2) and of the width (L1) of the magnetic-field generating device (1240). The distance (h) between the upper surface of the magnetic assembly (1230) and the surface of the substrate (1220) facing the magnetic assembly (1230) was about 4 mm.

The resulting OEL produced with the apparatus illustrated in FIG. 12A is shown in FIG. 12C at different viewing angles by tilting the substrate (1220) between −30° and +20°.

The invention claimed is:

1. A process for producing an optical effect layer on a substrate, said process comprising the steps of:

i) applying on a substrate surface a radiation curable coating composition comprising non-spherical magnetic or magnetizable pigment particles, said radiation curable coating composition being in a first state, ii) exposing the radiation curable coating composition to a magnetic field of an apparatus comprising:

a) a magnetic assembly comprising a non-magnetic supporting matrix and:

a1) a loop-shaped magnetic-field generating device being either a single loop-shaped dipole magnet having a magnetic axis substantially perpendicular to the substrate surface or a combination of two or more dipole magnets disposed in a loop-shaped arrangement, each of the two or more dipole magnets having a magnetic axis substantially perpendicular to the substrate surface and having a same magnetic field direction, and a2) a single dipole magnet having a magnetic axis substantially perpendicular to the substrate surface or two or more dipole magnets having a magnetic axis substantially perpendicular to the substrate surface and having a same magnetic field direction and/or one or more pole pieces, b) a magnetic-field generating device being either a single bar dipole magnet having a magnetic axis substantially parallel to the substrate surface or a combination of two or more bar dipole magnets, each of the two or more bar dipole magnets having a magnetic axis substantially parallel to the substrate surface and having a same magnetic field direction, so as to orient at least a part of the non-spherical magnetic or magnetizable pigment particles, and iii) at least partially curing the radiation curable coating composition of step ii) to a second state so as to fix the non-spherical magnetic or magnetizable pigment particles in their adopted positions and orientations, wherein the optical effect layer provides an optical impression of one or more loop-shaped bodies having a size that varies upon tilting the optical effect layer, wherein the magnetic assembly and the magnetic-field generating device are arranged one on top of the other and are in direct contact, wherein the loop-shaped magnetic-field generating device and the single dipole magnet or the two or more dipole magnets of the magnetic assembly are disposed within the non-magnetic supporting matrix.

2. The process according to claim 1, wherein the magnetic assembly comprises the supporting matrix and:

a1) the loop-shaped magnetic-field generating device, and a2) the single dipole magnet or the two or more dipole magnets and the one or more pole pieces.

3. The process according to claim 1, wherein at least a part of the plurality of non-spherical magnetic or magnetizable particles is constituted by non-spherical optically variable magnetic or magnetizable pigment particles.

4. The process according to claim 3, wherein the optically variable magnetic or magnetizable pigments are selected from the group consisting of magnetic thin-film interference pigments, magnetic cholesteric liquid crystal pigments and mixtures thereof.

5. The process according to claim 1, wherein step iii) is carried out partially simultaneously with the step ii).

6. The process according to claim 1, wherein the non-spherical magnetic or magnetizable particles are platelet-shaped pigment particles, and wherein said process further comprises a step of exposing the radiation curable coating composition to a dynamic magnetic field of a first magnetic-field-generating device so as to bi-axially orient at least a part of the platelet-shaped magnetic or magnetizable pigment particles, said step being carried out after step i) and before step ii).

7. An optical effect layer produced by the process recited in claim 1.

8. A security document or a decorative element or object comprising one or more optical effect layers recited in claim 7.

9. The process according to claim 1, wherein the radiation curable coating composition on the substrate is exposed to the magnetic field of the apparatus above one side of the magnetic assembly and the magnetic-field generating device is arranged on an opposite side of the magnetic assembly.

10. The process according to claim 1, wherein the optical effect layer provides an optical impression of one or more loop-shaped bodies having a size that varies upon tilting the optical effect layer and the one or more loop-shaped bodies appear to continually vary in size as an angle at which the optical effect layer is tilted changes.

11. The process according to claim 1, wherein step i) is carried out by a printing process.

12. The process according to claim 11, wherein the printing process is selected from the group consisting of screen printing, rotogravure printing and flexography printing.

13. The process according to claim 1, wherein the optical effect layer provides an optical impression of one or more loop-shaped bodies having a size that continually increases or continually decreases as the optical effect layer is tilted from a negative viewing angle to a positive viewing angle.

* * * * *